US012760516B2

(12) United States Patent
Scott et al.

(10) Patent No.: US 12,760,516 B2
(45) Date of Patent: Oct. 13, 2026

(54) COUPLING SYSTEM, COUPLER TOOLS AND METHODS OF USE THEREOF

(71) Applicant: HOLMES SOLUTIONS LIMITED PARTNERSHIP, Wellington Central (NZ)

(72) Inventors: Benjamin Thomas Scott, Wellington Central (NZ); Jonathan Keith Roebuck, Wellington Central (NZ); Jeremy Neil Walters, Wellington Central (NZ); Kevin Paul Botman, Wellington Central (NZ); Byron Ronald Van Deun, Wellington Central (NZ)

(73) Assignee: HOLMES SOLUTIONS LP, Wellington (NZ)

( * ) Notice: Subject to any disclaimer, the term of this patent is extended or adjusted under 35 U.S.C. 154(b) by 170 days.

(21) Appl. No.: 18/574,236

(22) PCT Filed: Jun. 28, 2022

(86) PCT No.: PCT/NZ2022/050083

§ 371 (c)(1),
(2) Date: Dec. 26, 2023

(87) PCT Pub. No.: WO2023/277706

PCT Pub. Date: Jan. 5, 2023

(65) Prior Publication Data

US 2024/0141647 A1 May 2, 2024

(30) Foreign Application Priority Data

Jun. 28, 2021 (AU) ..... 2021901949
Dec. 10, 2021 (AU) ..... 2021903998

(51) Int. Cl.
*E04C 3/30* (2006.01)

(52) U.S. Cl.
CPC ..... *E04C 3/30* (2013.01)

(58) Field of Classification Search
CPC ..... E04B 2001/2692; E04B 1/4121; E04C 5/165; E04G 21/12; F16B 2/14; F16B 2/065; F16B 7/02; F16B 7/0426
See application file for complete search history.

(56) References Cited

U.S. PATENT DOCUMENTS 2,699,589 A * 1/1955 Redell ..... F04B 27/047 294/102.1
3,912,406 A 10/1975 Mcgrath
(Continued)

FOREIGN PATENT DOCUMENTS

CN 211899268 U 11/2020
CN 112726584 A 4/2021
(Continued)

OTHER PUBLICATIONS

International Search Report issued by Australian Patent Office on Oct. 12, 2022 for PCT/NZ2022/050083.

*Primary Examiner* — Gisele D Ford
(74) *Attorney, Agent, or Firm* — HOLZER PATEL DRENNAN

(57) ABSTRACT

A coupling system is described comprising an anchor that may releasably connect to a coupled member. Associated tools configured to cooperate with the coupling system and methods of use of the coupling system and release or re-engagement of the coupling system are also described. In one embodiment, the coupling system may further comprise an enclosing member and release member and a related tool or tools to actuate release of the connection and re-engage of the connection as desired.

21 Claims, 59 Drawing Sheets

(56) References Cited

U.S. PATENT DOCUMENTS

| | | | | |
|---|---|---|---|---|
| 4,895,474 | A * | 1/1990 | Eckle | B23B 31/1077 403/292 |
| 9,181,691 | B2 * | 11/2015 | Thompson | E04B 1/4135 |
| 9,482,324 | B2 * | 11/2016 | Johnson | F16H 25/24 |
| 9,719,544 | B2 * | 8/2017 | Bay | F16B 7/025 |
| 9,746,019 | B2 | 8/2017 | Oh et al. | |
| 10,655,358 | B2 * | 5/2020 | Sorkin | E01F 15/06 |
| 11,835,175 | B2 * | 12/2023 | Simek | E04B 1/4121 |
| 2011/0268530 | A1 * | 11/2011 | Heide | F16B 21/16 411/360 |
| 2012/0023862 | A1 * | 2/2012 | Karczewski | E04B 1/486 52/698 |
| 2014/0241816 | A1 | 8/2014 | Koivunen | |
| 2017/0298617 | A1 * | 10/2017 | Espinosa | E04C 5/0645 |
| 2018/0003202 | A1 * | 1/2018 | White | F16G 11/025 |
| 2018/0135676 | A1 | 5/2018 | Taneichi | |
| 2018/0298938 | A1 * | 10/2018 | Droste | F16B 37/0857 |
| 2019/0048915 | A1 * | 2/2019 | Naderlinger | F16B 2/065 |
| 2020/0325673 | A1 * | 10/2020 | Christophersen | F16B 39/36 |
| 2020/0325924 | A1 * | 10/2020 | Serokosz | F16B 13/124 |
| 2022/0259845 | A1 * | 8/2022 | Ziltener | E04B 1/4121 |
| 2022/0260106 | A1 * | 8/2022 | Ziltener | F16B 37/0864 |

FOREIGN PATENT DOCUMENTS

| | | | |
|---|---|---|---|
| DE | 10008684 | C1 | 10/2001 |
| FR | 1523724 | A | 5/1968 |
| JP | H11117403 | A | 4/1999 |
| JP | 2002115370 | A | 4/2002 |
| JP | 2007327308 | A | 12/2007 |
| KR | 20150122426 | A | 11/2015 |
| KR | 102126297 | B1 | 7/2020 |

* cited by examiner

DETAIL A

SECTION B-B

PARTIAL SECTION C-C

SECTION A-A

SECTION A-A

SECTION A-A

DETAIL B

DISENGAGED POSITION

SECTION A-A

COUPLING SYSTEM, COUPLER TOOLS AND METHODS OF USE THEREOF

RELATED APPLICATIONS

This application claims priority from Australia provisional patent application number AU2021901949 filed on 28 Jun. 2021 WIPO DAS code 7B0F and Australia provisional patent application number AU2021903998 filed on 10 Dec. 2021 WIPO DAS code F23A.

TECHNICAL FIELD

Described herein is a coupling system, coupler tools and methods of use thereof. More specifically, a coupling system is described comprising an anchor that may releasably connect to a coupled member.

BACKGROUND ART

Coupling of members is well known and described in the art. The extent of coupling and coupling characteristics (strength, tension or compression, slippage and so on) may be highly variable.

Coupling may be between elongated rods to other elongated rods or from elongated rods to a base plate.

US2019/0323238A1 describes a coupling to couple two 'tendons' together in a sleeve. The assembly is encased inside concrete and used to tension concrete e.g. a foundation. The sleeve comprises a central pressure chamber, pistons on either side of the pressure chamber, wedge jaws that the piston is driven by, the wedges being inside a tapered bore of a chuck. The chuck exterior threads into a coupler body. A tendon is pushed into the tendon passageway until seated within the wedges and then drawn back to tension the wedges in the bore. Hydraulic fluid may be pumped into the pressure chamber to urge the pistons against the wedges to cause locking of the wedges in the tapered bores.

US2018/0016789A1 also describes a two tendon coupler embedded in concrete. The design is similar in nature to US2019/0323238A1 however, the wedges are urged into tension using springs and a central disk is located between each side of the coupler. The wedges and splice chuck body thread into a body encapsulation.

CN210767212U describes a concrete column joint. An upper pre-cast column has an upper rebar and this upper rebar is coupled to a lower section rebar via a connecting sleeve. The lower rebar extends from a lower section precast column, through a cast in-situ part and set up layer and into the connecting sleeve. The connecting sleeve is partly embedded in the set-up layer and partly embedded in the upper precast column. The coupling sleeve threadingly engages the lower rebar and the upper rebar is held in the sleeve via wedges that, when in tension, bear on a tapered wall of the sleeve termed a taper cylinder. The wedges are urged to a tension abutment via a spring, an end of which bears on a baffle ring in the sleeve and the other end on the wedge base.

Art coupling devices and methods including those described above may not be ideal. Common drawbacks of art coupling devices and methods include but are not necessarily limited to:

- Inability to release the anchor once installed;
- Inability to subsequently re-engage the anchor once released;
- Complexity of coupling parts and construction;

- Intrusion of coupling parts to an exterior surface of a column where a column is to be coupled and resulting poor fire resistance and poor aesthetics for the assembled product;
- Lack of strength;
- Inability to withstand lateral loading;
- Heat conduction via mounting rods that may cause adhesive joint failure;
- Out performance of the coupling relative to the way the coupled member is fixed to another component resulting in premature coupling failure;
- Difficulty aligning coupled member ends leading to elongated coupler construction and/or challenges aligning the coupled member ends;
- Addressing the needs of structural materials outside of concrete; and/or
- Linking columns to base plates/substrates and to other columns.

It may be useful to address one or more of the above drawbacks in a coupling system or method or at least provide the public with a choice.

Further aspects and advantages of the coupling system, coupler tools and methods of use thereof will become apparent from the ensuing description that is given by way of example only.

SUMMARY

A coupling system is described comprising an anchor that may releasably connect to a coupled member. Associated tools configured to cooperate with the coupling system and methods of use of the coupling system and release or re-engagement of the coupling system are also described. In one embodiment, the coupling system may further comprise an enclosing member and release member and a related tool or tools to actuate release of the connection and re-engage of the connection as desired.

In a first aspect, there is provided a coupling assembly configured to releasably connect a coupled member to the coupling assembly, the coupling assembly comprising:

- an anchor comprising:
  - at least one jaw, the jaw, or each jaw, having an internal jaw side interfering with movement of the coupled member relative to the anchor and an external taper;
  - a body with an internal taper complementary to, and abutting against, a jaw external taper; and,
- an enclosing member,
  - wherein the enclosing member at least partly surrounds the anchor with an opening therein to allow passage of the coupled member to the anchor inside the enclosing member wherein, the anchor fits snugly within the enclosing member thereby minimising any relative movement between the anchor and enclosing member; and
- a release member;
- wherein the coupling assembly is configured so that, in a first coupled position, the anchor at least one jaw engages the coupled member and therefore prevents separation of the coupled member from the anchor, and, when actuated, the release member forces the anchor at least one jaw to disengage the body and move to a second uncoupled position.

In a second aspect, there is provided a coupling assembly and a coupled member, wherein:

- the coupled member is located within, and is releasably coupled to, the coupling assembly; and wherein the coupling assembly comprises:

an anchor comprising:

at least one jaw, the jaw, or each jaw, having an internal jaw side interfering with movement of the coupled member relative to the anchor and an external taper;

a body with an internal taper complementary to, and abutting against, a jaw external taper; and, an enclosing member, wherein the enclosing member at least partly surrounds the anchor with an opening therein to allow passage of the coupled member to the anchor inside the enclosing member wherein, the anchor fits snugly within the enclosing member thereby minimising any relative movement between the anchor and enclosing member; and a release member;

wherein the coupling assembly is configured so that, in a first coupled position, the anchor at least one jaw engages the coupled member and therefore prevents separation of the coupled member from the anchor, and, when actuated, the release member forces the anchor at least one jaw to disengage the body and move to a second uncoupled position.

In a third aspect, there is provided a coupling assembly configured to couple an end of a first coupled member coaxially to an end of a second coupled member, wherein:

the first and second coupled members are located coaxially within the coupling assembly and wherein the coupled member ends comprise an alignment member configured to align the coupled member ends together coaxially, the first and second coupled member ends engaging each other within the coupling assembly; and wherein the coupling assembly comprises:

an anchor comprising:

at least one jaw, the jaw, or each jaw, having an internal jaw side interfering with movement of the coupled member relative to the anchor and an external taper;

a body with an internal taper complementary to, and abutting against, a jaw external taper; and, an enclosing member, wherein the enclosing member at least partly surrounds the anchor with an opening therein to allow passage of the coupled member to the anchor inside the enclosing member wherein, the anchor fits snugly within the enclosing member thereby minimising any relative movement between the anchor and enclosing member; and wherein the coupling assembly is configured so that the anchor at least one jaw engages the first or second coupled member, the opposing coupled member otherwise fixed to the coupling assembly, the first and second coupled members thereby coupled by the coupling assembly.

In a fourth aspect, there is provided a coupling assembly configured to connect a coupled member to the coupling assembly, the coupling assembly comprising:

an anchor comprising:

at least one jaw, the jaw, or each jaw, having an internal jaw side interfering with movement of the coupled member relative to the anchor and an external taper;

a body with an internal taper complementary to, and abutting against, a jaw external taper; and, end caps, wherein the end caps link to the body, the end caps defining the coupling assembly ends and, wherein one or both end caps comprise an opening therein to allow passage of the coupled member to the anchor inside the body; and wherein the coupling assembly is configured so that the anchor at least one jaw engages the coupled member and therefore prevents separation of the coupled member from the anchor.

In a fifth aspect, there is provided a coupling assembly configured to connect a coupled member to the coupling assembly, the coupling assembly comprising:

an anchor comprising:

at least one jaw, the jaw, or each jaw, having an internal jaw side interfering with movement of the coupled member relative to the anchor and an external taper;

a body with an internal taper complementary to, and abutting against, a jaw external taper; and, an enclosing member, wherein the enclosing member comprises a sleeve and end caps, the sleeve slidingly engaging and surrounding the anchor and the end caps defining the sleeve ends and extent of internal volume inside the enclosing member, one or both end caps comprising an opening therein to allow passage of the coupled member to the anchor inside the enclosing member wherein, the anchor fits snugly within the enclosing member thereby minimising any relative movement between the anchor and enclosing member; and wherein the coupling assembly is configured so that the anchor at least one jaw engages the coupled member and therefore prevents separation of the coupled member from the anchor.

In a sixth aspect, there is provided a column comprising:

at least one coupling assembly substantially as described above; and, at least one coupled member per coupling assembly, the coupled member, or each coupled member, being located intermediate a column and the coupling assembly, the at least one coupled member coupled at a first end to the column via a retention means and, at a second opposing end to the coupling assembly.

In a seventh aspect, there is provided a column assembly, the column assembly connected to a base plate and substrate comprising:

a column;

a base plate fixed to a substrate;

at least one coupled member; and, at least one coupling assembly substantially as described above;

wherein:

the at least one coupled member is located intermediate the column and the at least one coupling assembly, the at least one coupled member coupled at a first end to the column and on an opposing second end to the at least one coupling assembly.

In an eighth aspect, there is provided a column assembly comprising a first column assembly connected vertically to a second column assembly via a connection, the connection comprising:

a first column;

a second column; and at least one connection between the first and second columns, the at least one connection comprising:

a first coupled member coupled to the first column and a second coupled member coupled to the second column and, intermediate the first and second columns, coupling the first and second coupled members together is a coupling assembly substantially as described above.

In a ninth aspect, there is provided a column assembly comprising a first column assembly connected vertically to a second column assembly via a connection, the connection comprising:

a first column;

a second column; and two bearing plates, one bearing plate fastened to the end of each column and the bearing plates abutting each other once the columns are coupled;

at least one connection between the first and second columns and bearing plates, the at least one connection comprising:

a first coupled member coupled to the first column and a second coupled member coupled to the second column and, intermediate the first and second columns, coupling the first and second coupled members together is a coupling assembly substantially as described above.

In a tenth aspect, there is provided a column assembly with a coupled member releasably coupled to the column, the column assembly comprising:

a column;

a coupled member releasably coupled at one end to the column interior and extending from an end or side of the column;

a retention means releasably coupling the coupled member end to the column interior, the retention means comprising a barrel nut and wherein the coupled member end releasably engages the barrel nut and the barrel nut engages the column or a part thereof.

In an eleventh aspect, there is provided a method of releasing a coupled member from a coupling assembly comprising:

selecting the coupling assembly and coupled member substantially as described above;

connecting the coupled member therein; and either inserting a release tool through at least one opening in the enclosing member to urge movement of a release member towards the at least one jaw;

or inserting hydraulic fluid to urge movement of a release member towards the at least one jaw;

thereby causing the at least one jaw to disengage the body of the anchor and allow the at least one jaw to disconnect from the coupled member.

In a twelfth aspect, there is provided a tool configured to release the coupled member from the coupling assembly substantially as described above and optionally, re-engage the coupled member to the coupling assembly substantially as described above, the tool comprising:

at least one tine, one end of the at least one tine interfering with a release member to cause urging of the release member to:

a second uncoupled position from a first coupled position to release the coupled member from the coupling assembly; or a first coupled position from a second uncoupled position to re-engage the coupled member to the coupling assembly.

In a thirteenth aspect, there is provided an alignment tool configured to align the coupled member in the coupling assembly substantially as described above, the alignment tool comprising:

a tongue configured to extend through an opening in the enclosing member and bear on a side of the coupling assembly or part thereof;

connected to the tongue, an elongated member with a guide slot therein, the guide slot elongated in a direction to allow movement of the tongue towards or away from a side of the coupling assembly; and wherein the guide slot in the elongated member is configured to restrict movement of the alignment tool in a single plane of movement relative to at least two extending members, the at least two extending members being located on a bearing plate or base plate.

In a fourteenth aspect, there is provided a method of connecting a coupled member to a coupling assembly by:

selecting at least one coupling assembly substantially as described above;

selecting at least one coupled member;

inserting an end of the at least one coupled member into the at least one coupling assembly; and optionally, apply a coupling force to the at least one coupled member to urge the at least one coupling assembly to connect to the at least one coupled member.

Selected advantages of the coupling system, coupler tools and methods of use thereof may comprise one or more of the following:

Provision for a strong coupling that allows for compression and tightens in response to a tensile force;

Simple construction which allows for a degree of lower tolerance in coupled member placement, particularly in column coupling embodiments;

The coupling system can be released and re-engaged;

The coupling system is highly versatile for many different applications;

In a wooden column, minimal penetration of the column is needed and hence the coupling system and methods meet aesthetic requirements and fire requirements.

BRIEF DESCRIPTION OF THE DRAWINGS

Further aspects of the coupling system, coupler tools and methods of use thereof will become apparent from the following description that is given by way of example only and with reference to the accompanying drawings in which.

DETAILED DESCRIPTION

Figure 1:
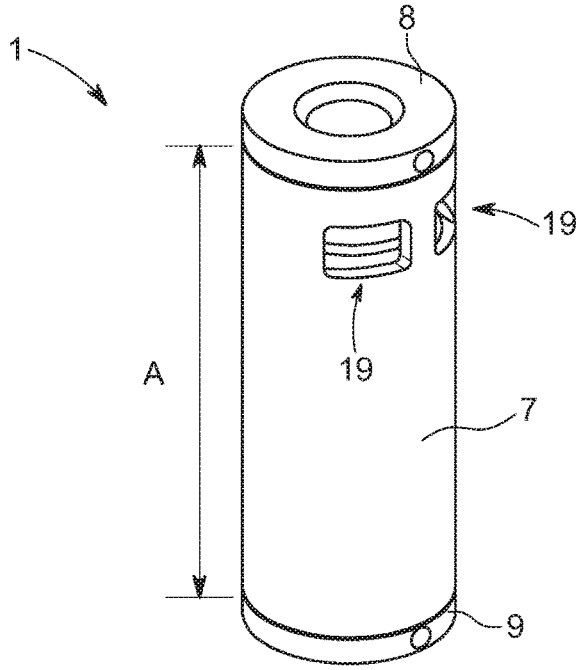
FIG. 1 illustrates a perspective view of an assembled embodiment of the coupling assembly.
Figure 2:
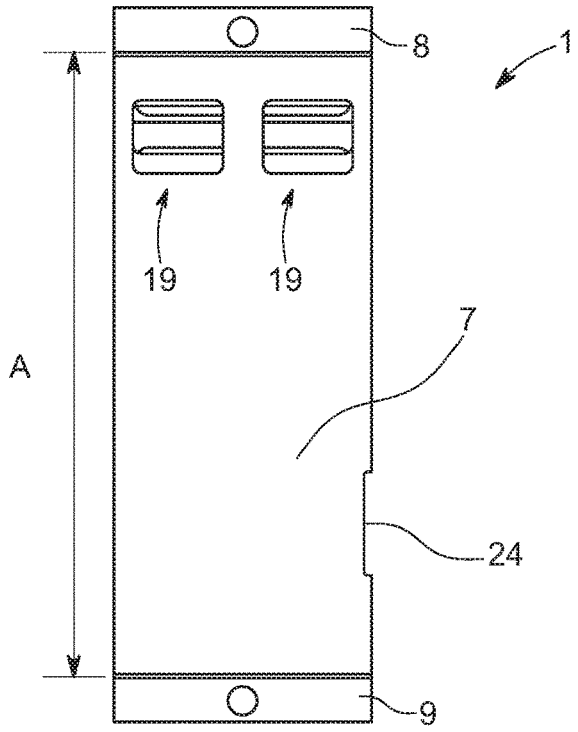
FIG. 2 illustrates a front view of an assembled embodiment of the coupling assembly.
Figure 3:
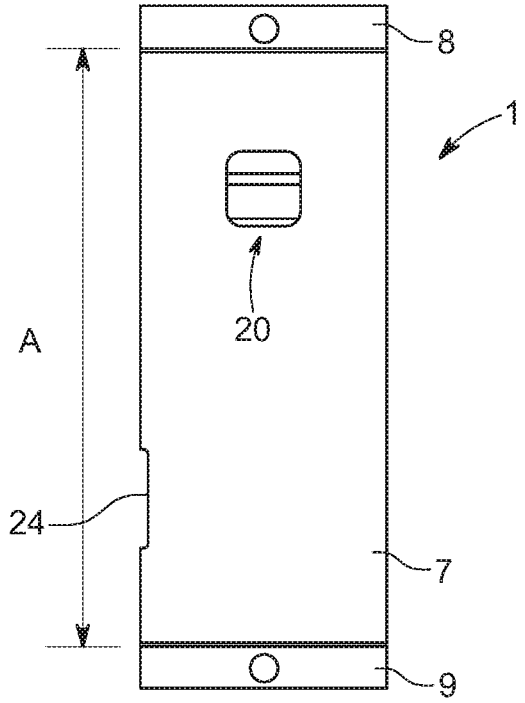
FIG. 3 illustrates a front view of an assembled embodiment of the coupling assembly.
Figure 4:
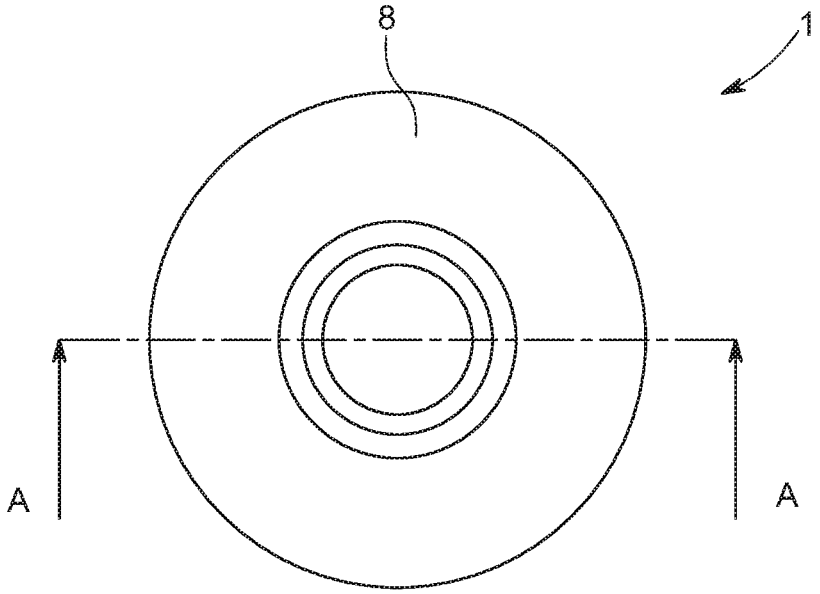
FIG. 4 illustrates a plan view of an assembled embodiment of the coupling assembly.
Figure 5:
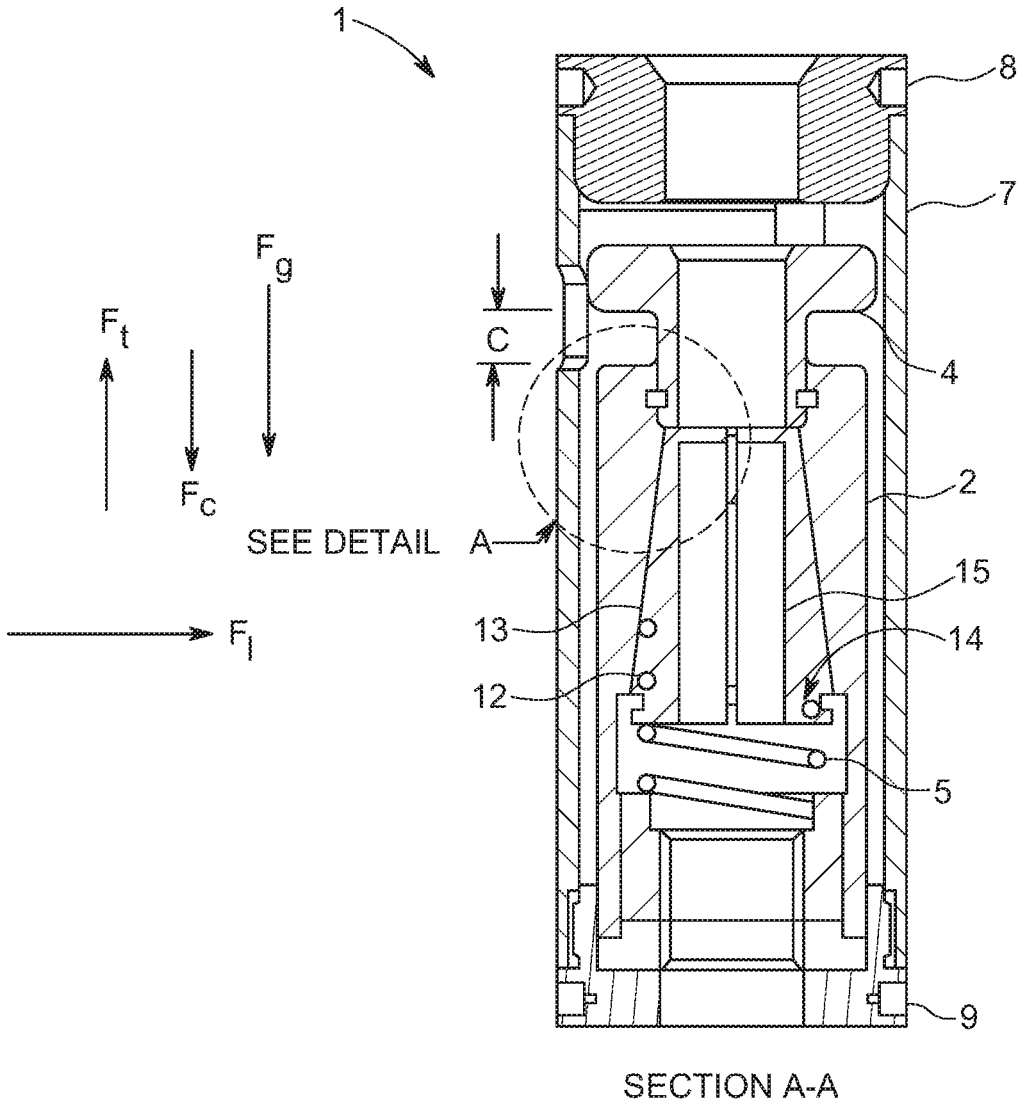
FIG. 5 illustrates a front cross-section view of the assembled coupling assembly in an engaged or armed position.
Figure 6:
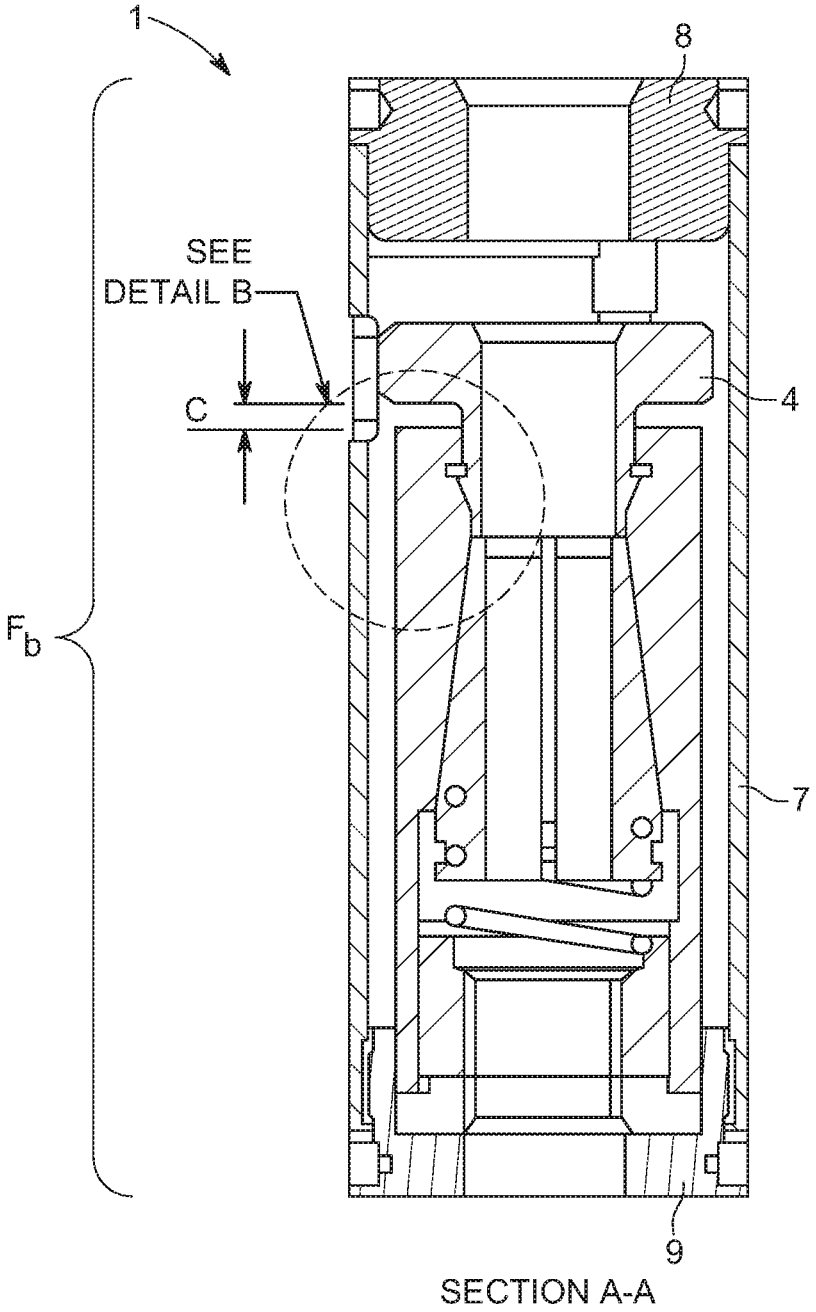
FIG. 6 illustrates a front cross-section view of the assembled coupling assembly in a disengaged or unarmed position.
Figure 7:
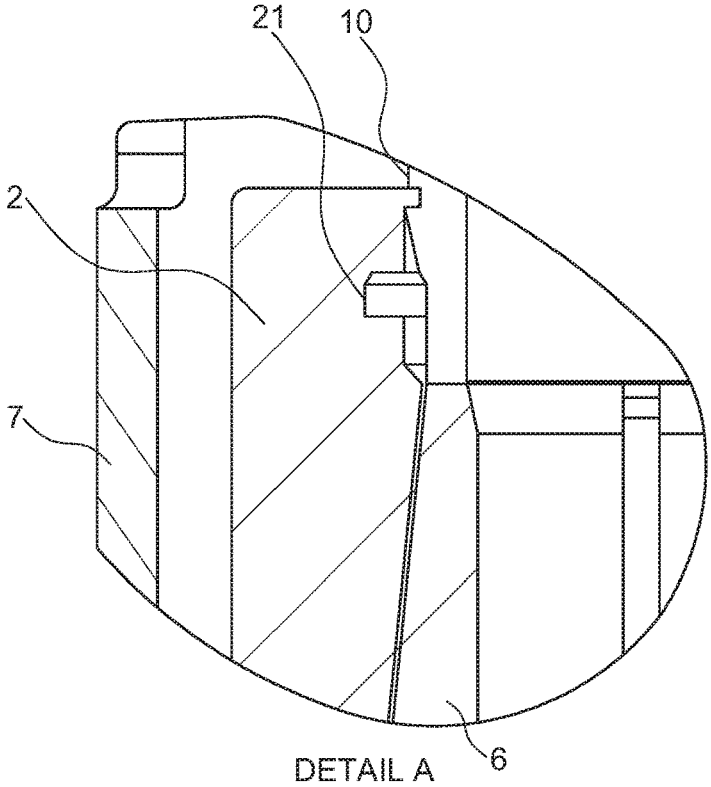
FIG. 7 illustrates a cross-section front view of detail A of the assembled coupling assembly in an engaged position.
Figure 8:
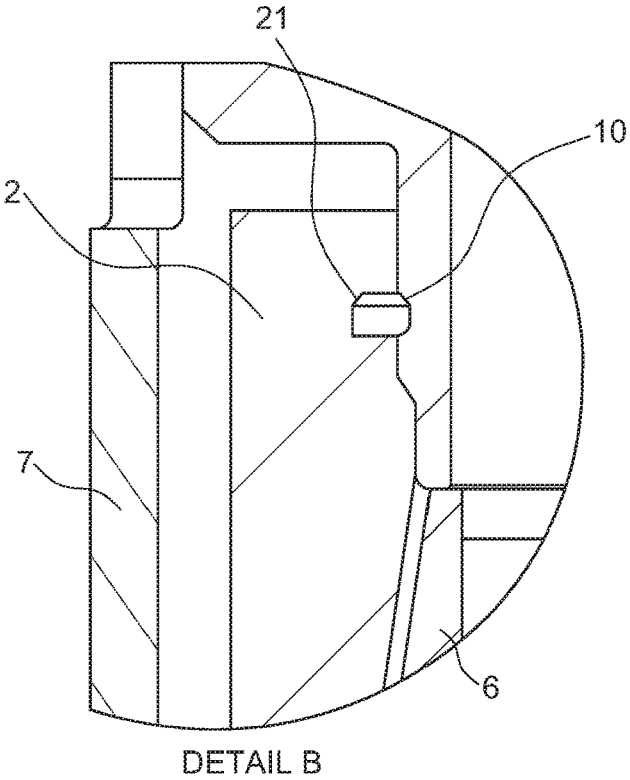
FIG. 8 illustrates a cross-section front view of detail B of the assembled coupling assembly in a disengaged position.
Figure 9:
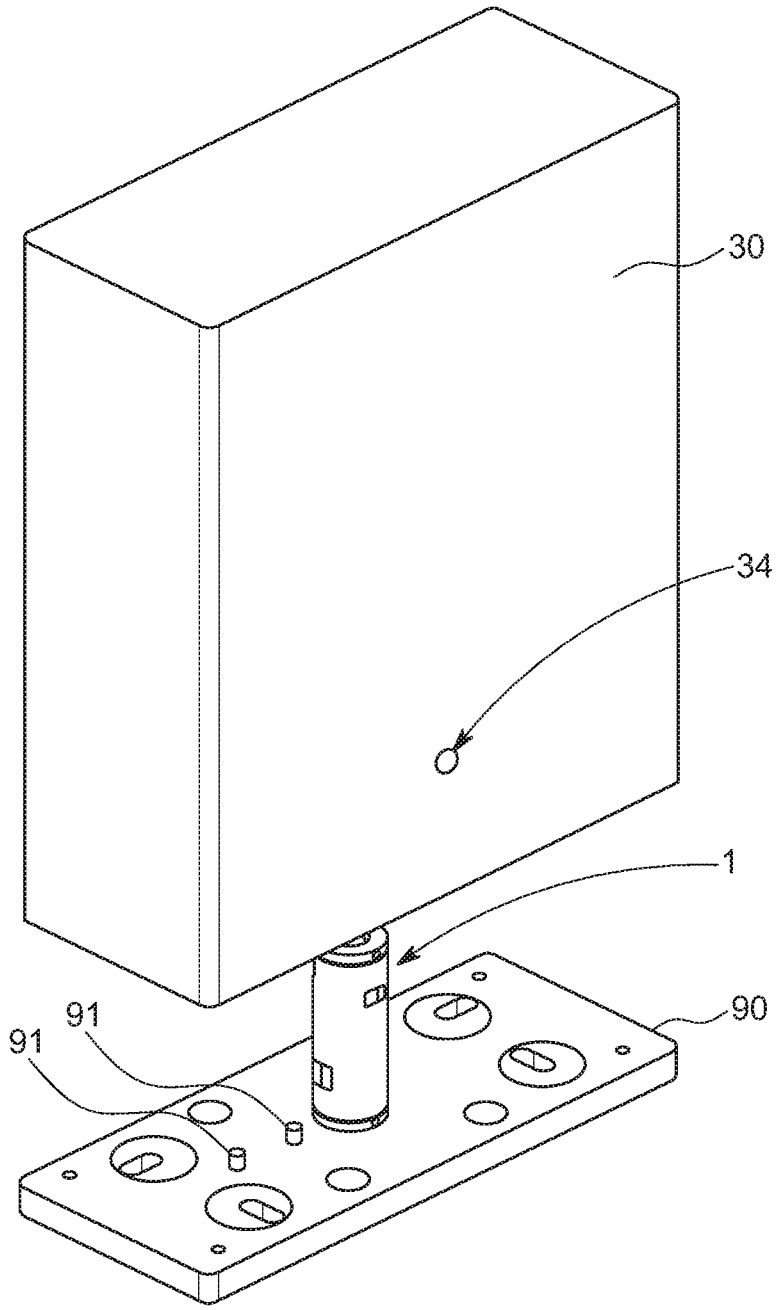
FIG. 9 illustrates a perspective exploded view of a column, coupling assembly and base plate.
Figure 10:
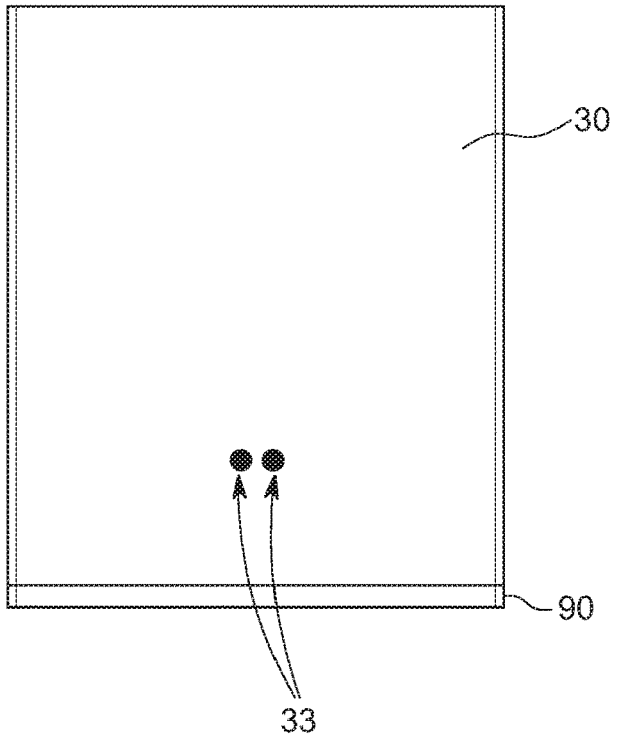
FIG. 10 illustrates a front view of an assembled column, coupling assembly and base plate.
Figure 11:
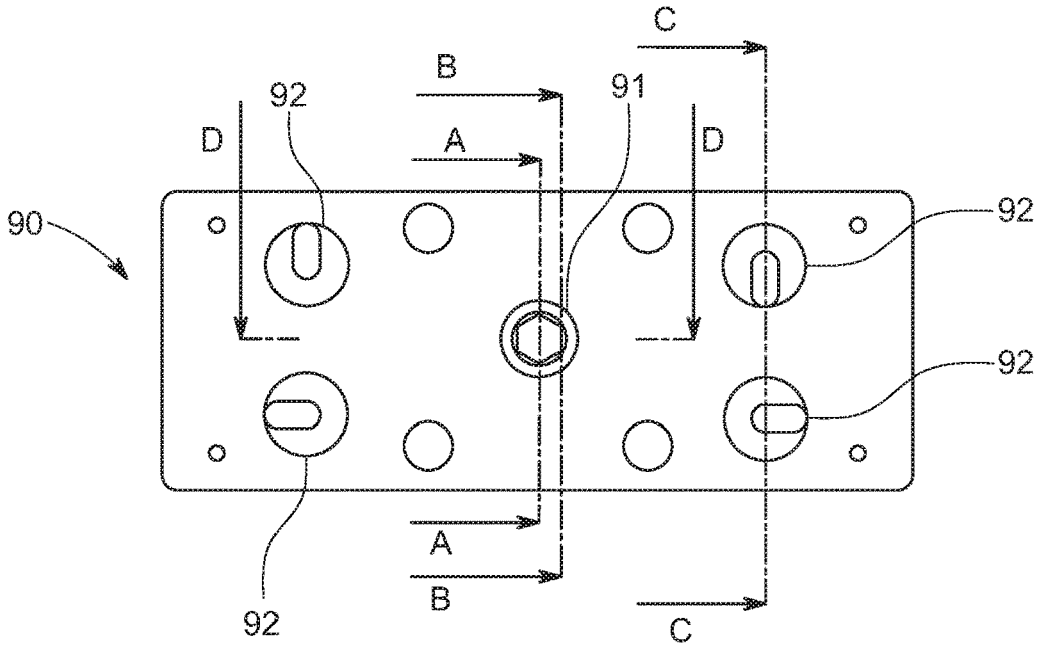
FIG. 11 illustrates a plan view of the base plate showing cross-section points described further below.
Figure 12:
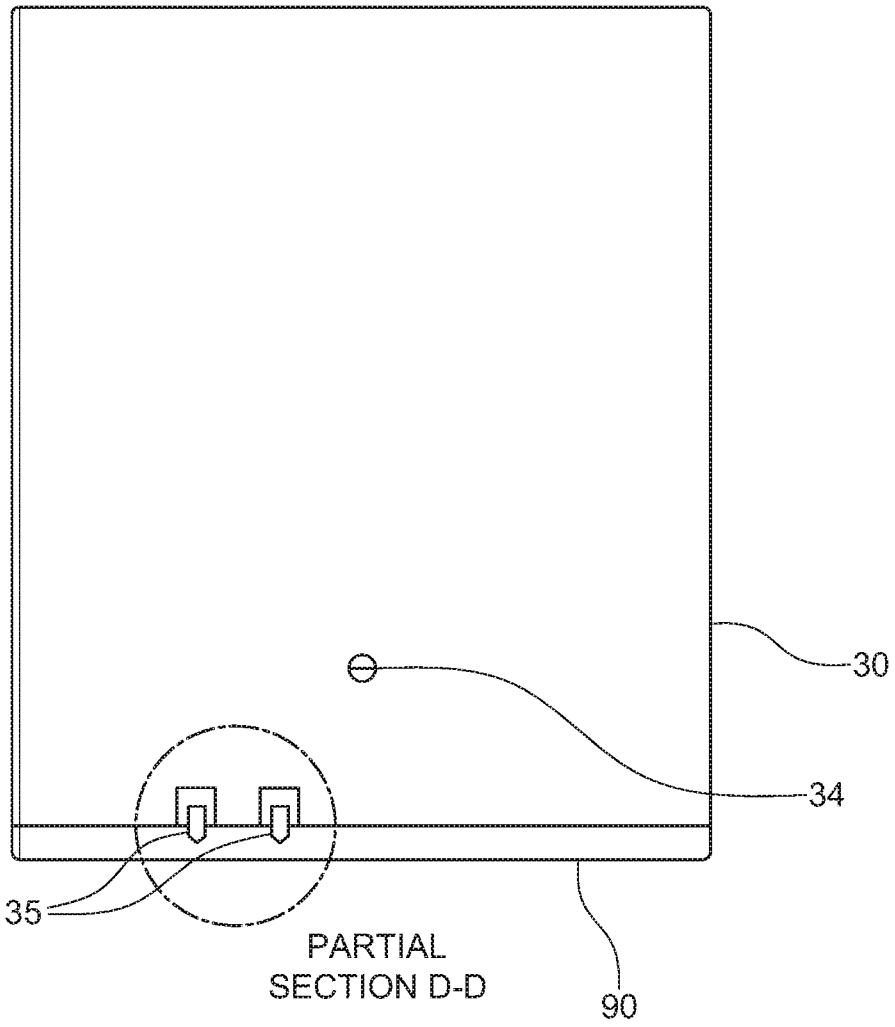
FIG. 12 illustrates a rear partial cross-section view about section DD of the assembled column, coupling assembly and base plate.
Figure 13:
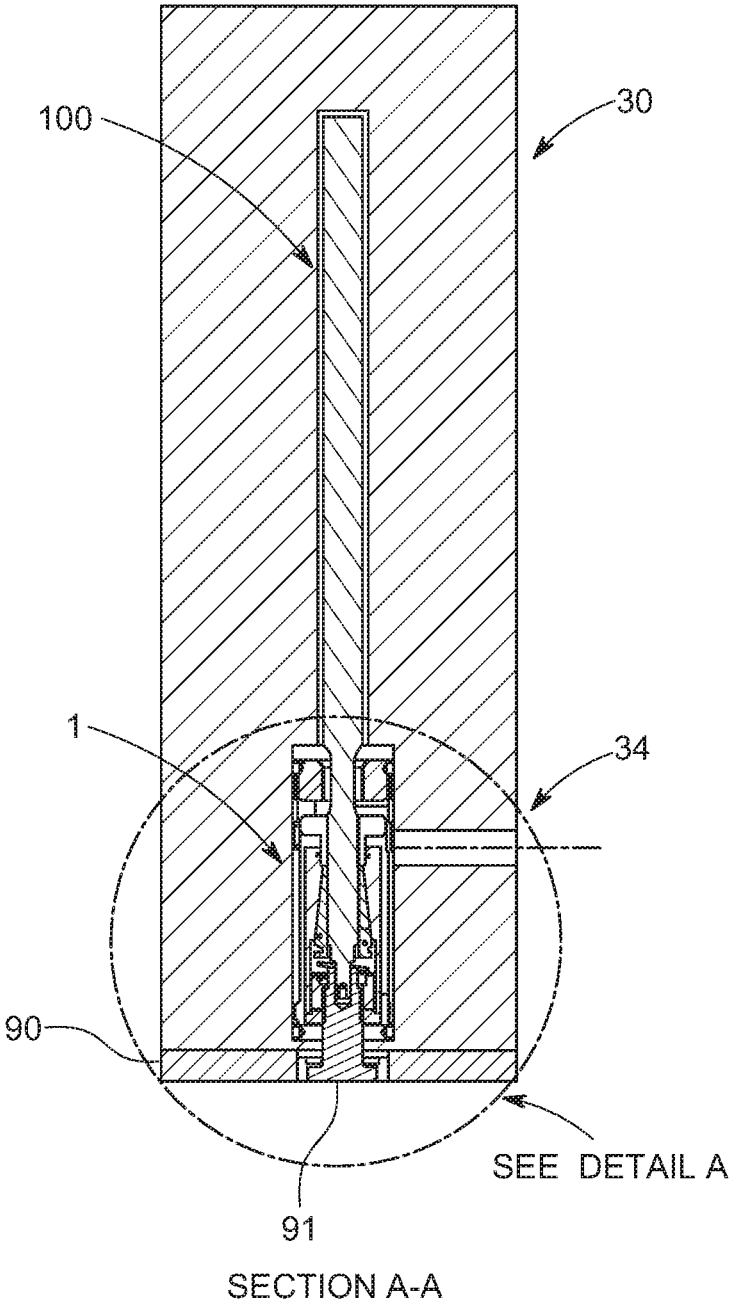
FIG. 13 illustrates a side cross-section view about section AA of the assembled column, coupling assembly and base plate.
Figure 14:
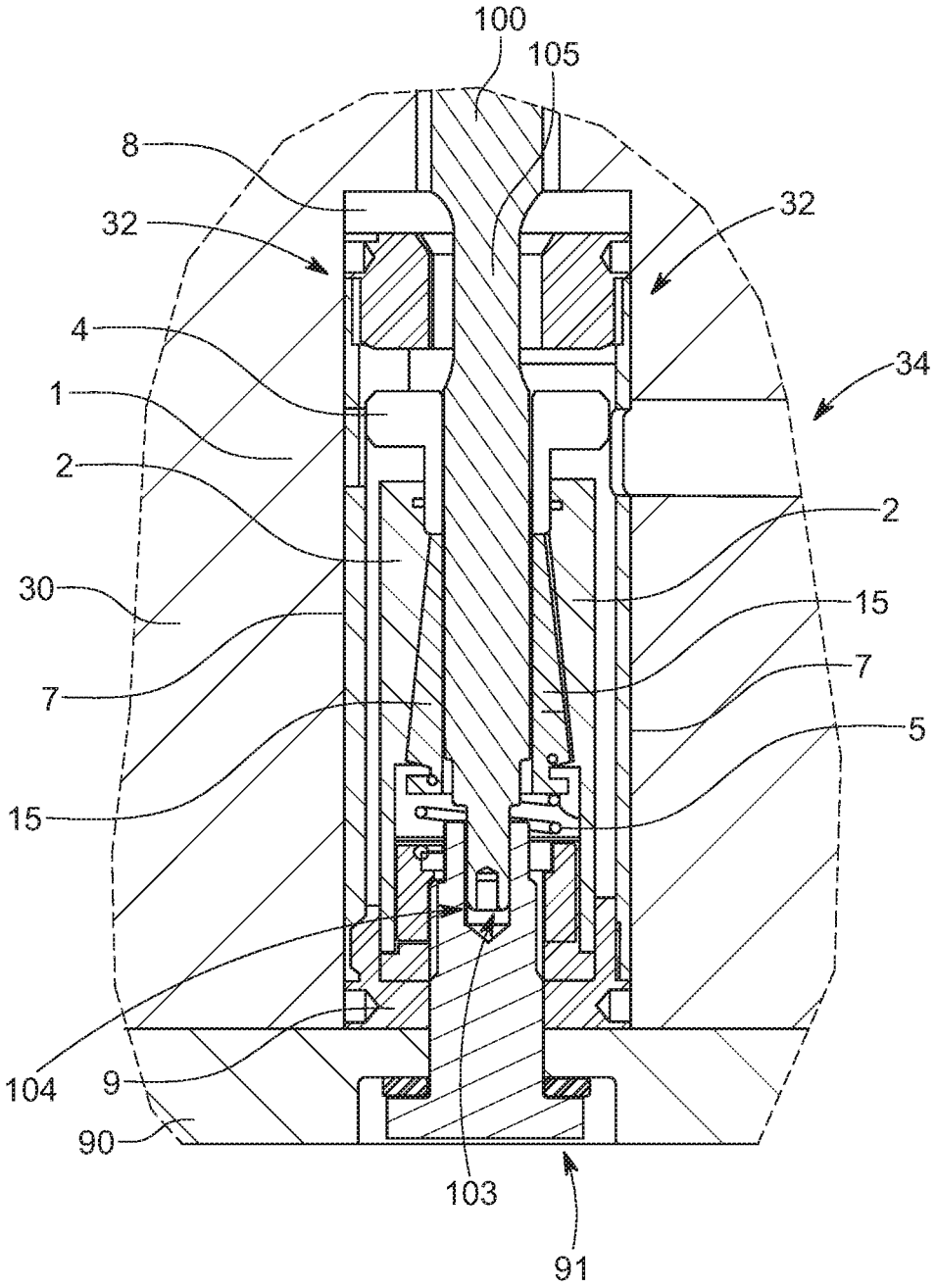
FIG. 14 illustrates a side cross-section view detail A of the column, coupling assembly and base plate.
Figure 15:
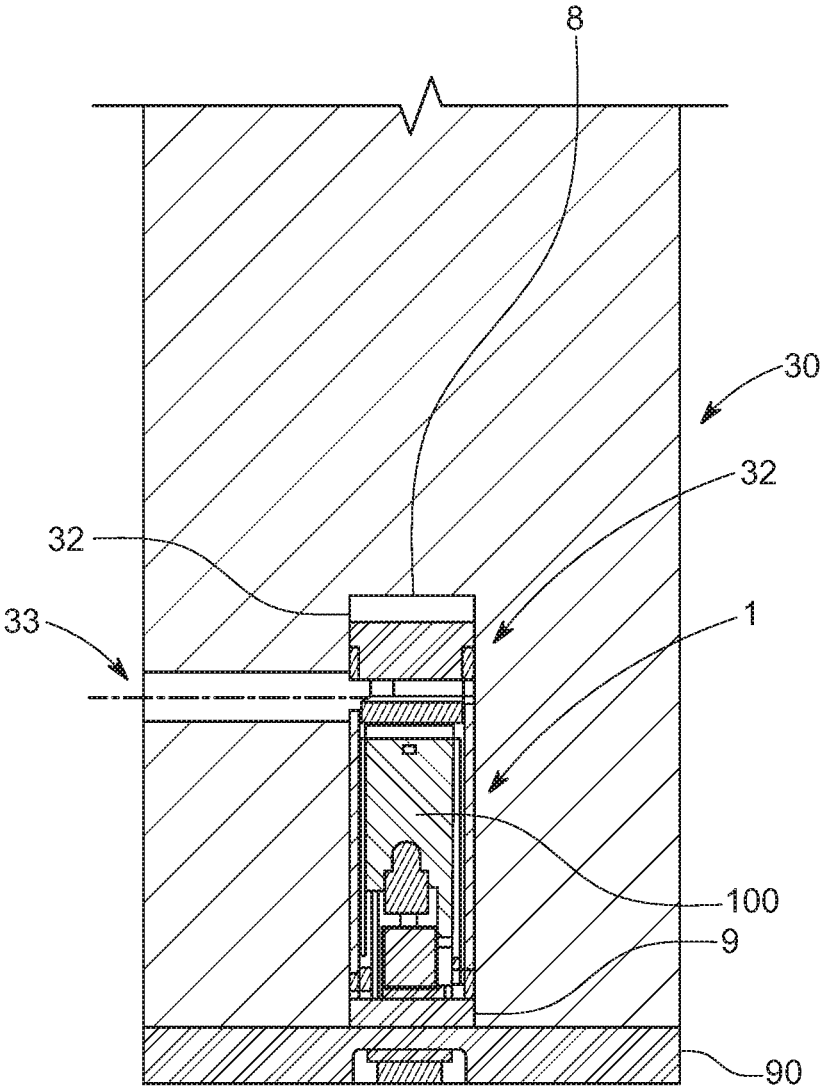
FIG. 15 illustrates a further side cross-section view about section BB of the column, coupling assembly and base plate.
Figure 16:
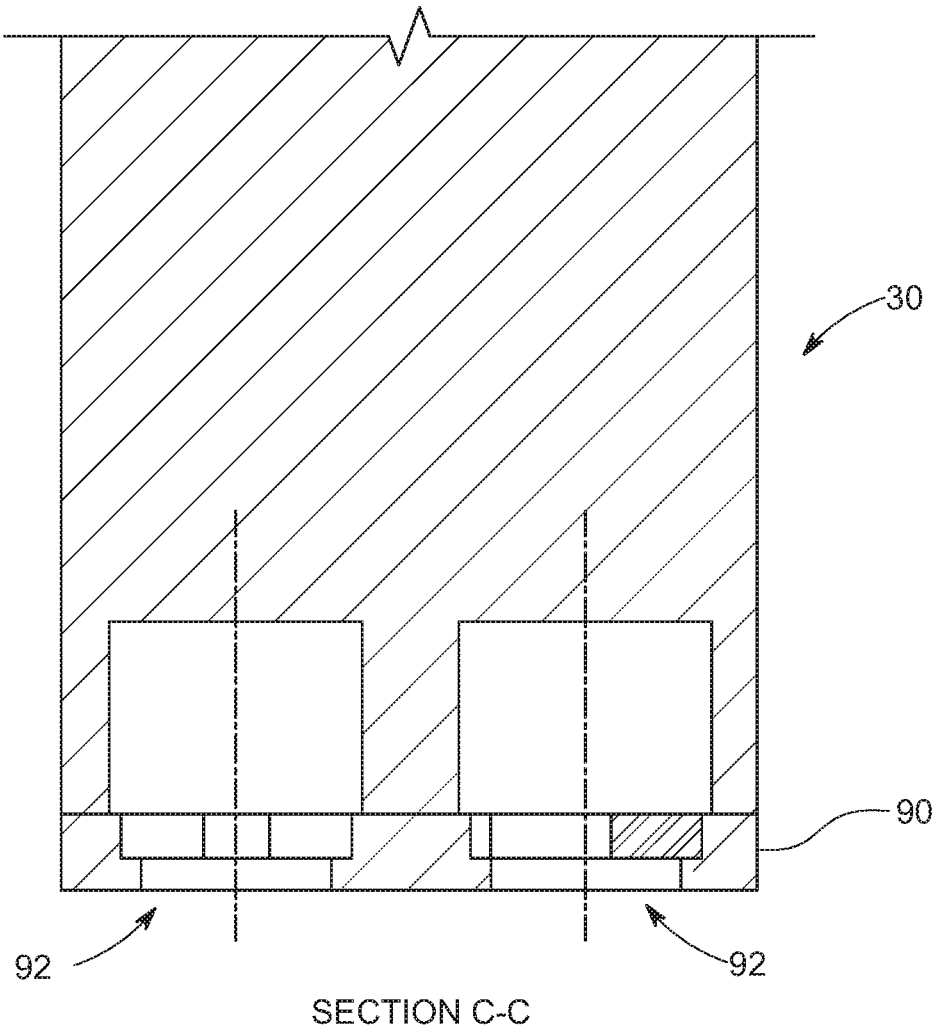
FIG. 16 illustrates a further side cross-section view about section CC of the column and base plate.
Figure 17:
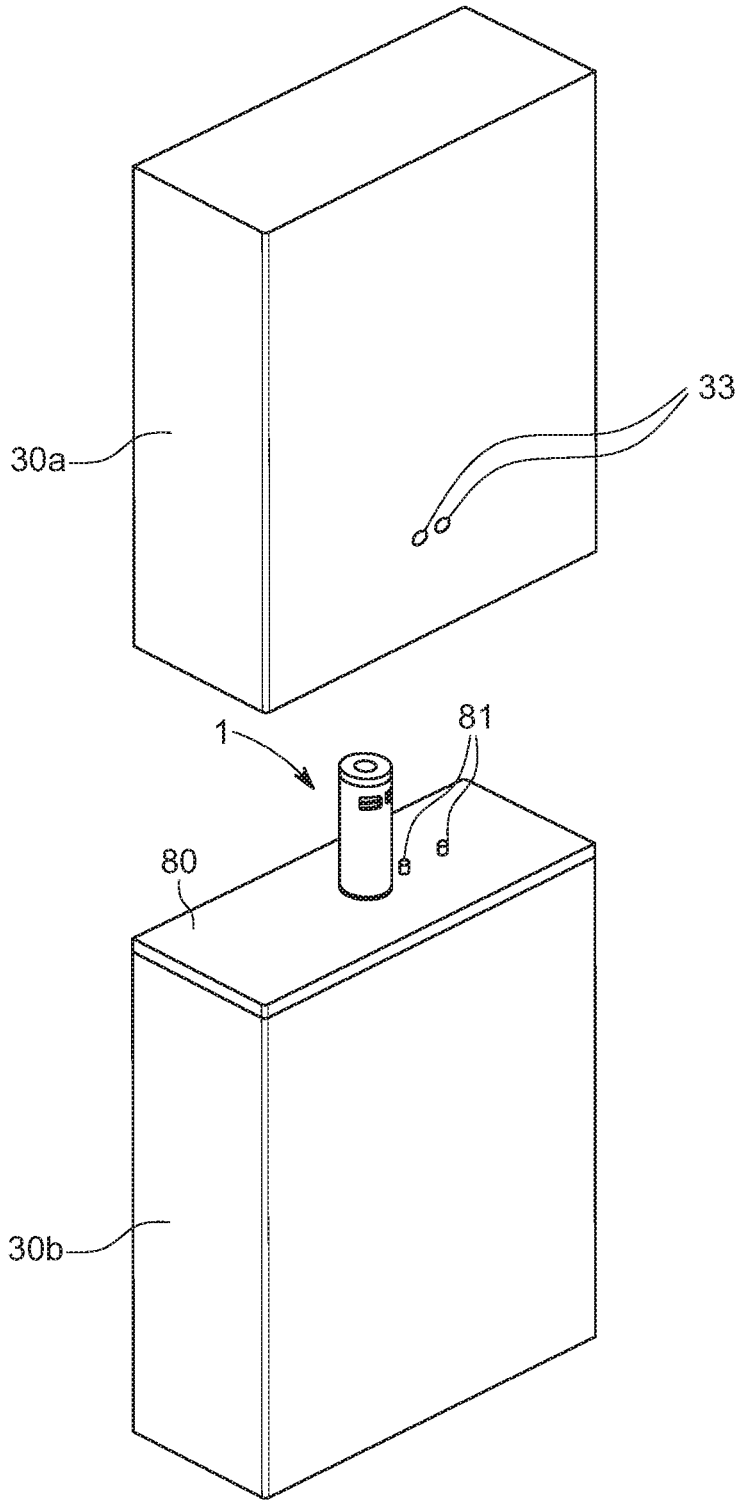
FIG. 17 illustrates a perspective exploded view of a column to column connection incorporating the coupling assembly.
Figure 18:
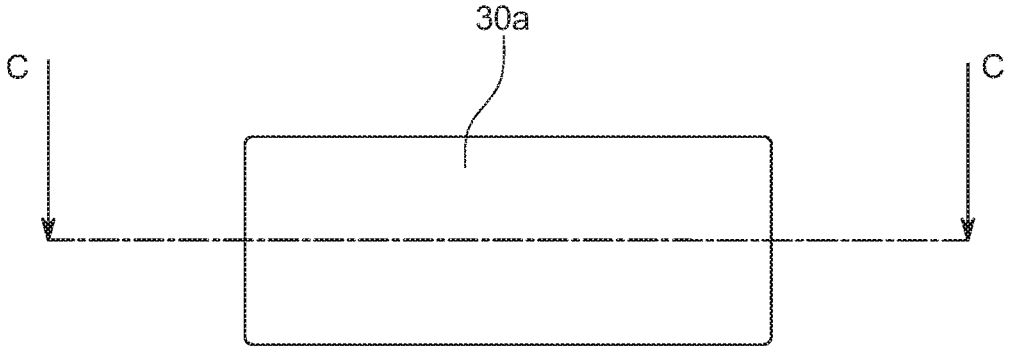
FIG. 18 illustrates a plan view of the connected columns.
Figure 19:
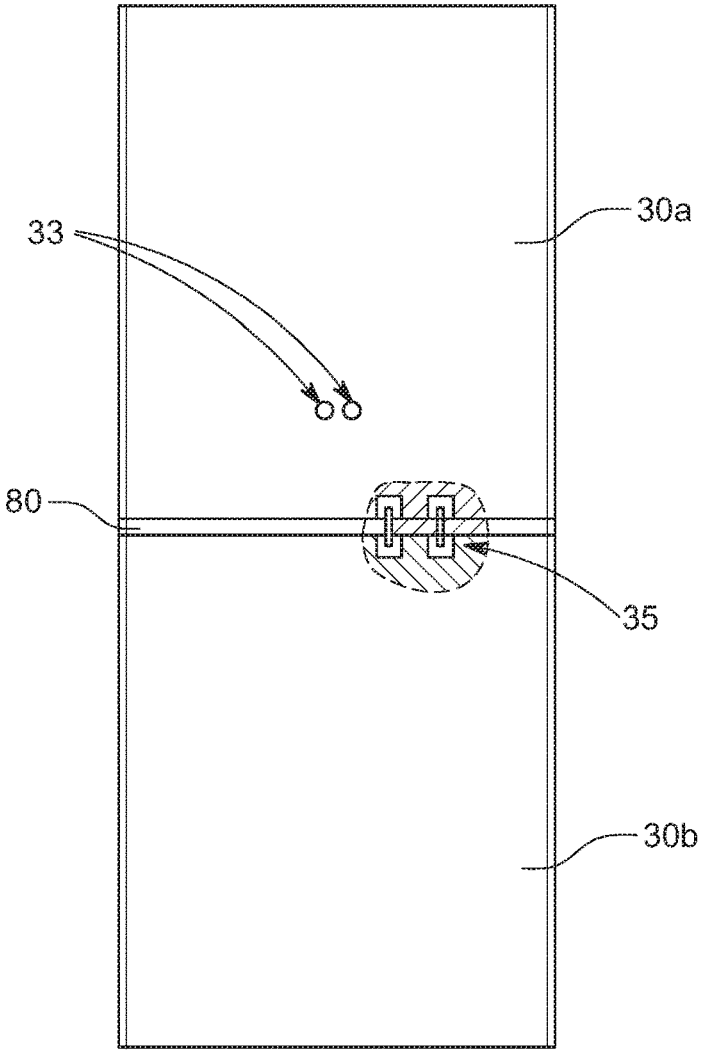
FIG. 19 illustrates a front partial cross-section view about section CC of the assembled column to column connection and a bearing plate between the columns.
Figure 20:
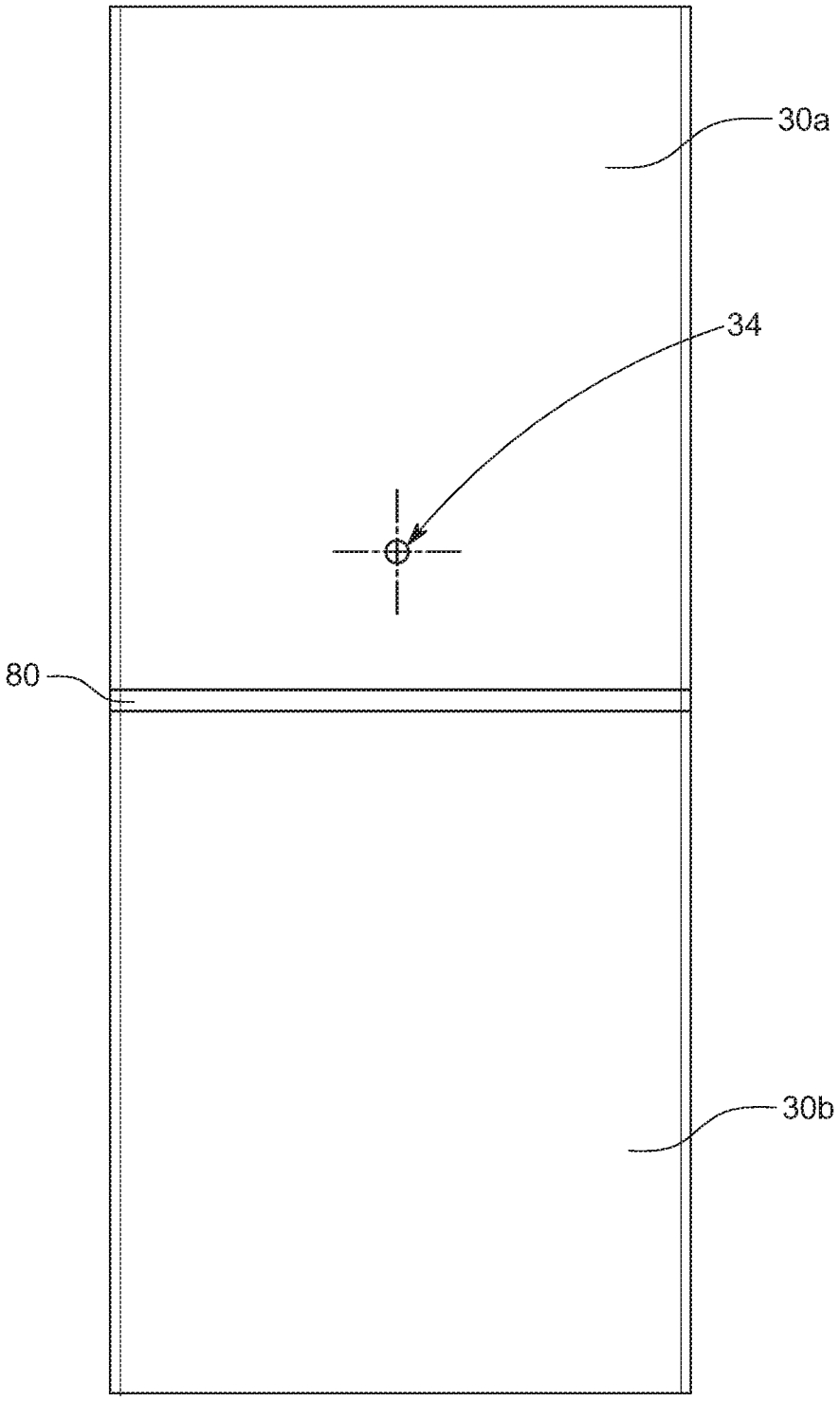
FIG. 20 illustrates a rear view of the assembled column to column connection and a bearing plate between the columns.
Figure 21:
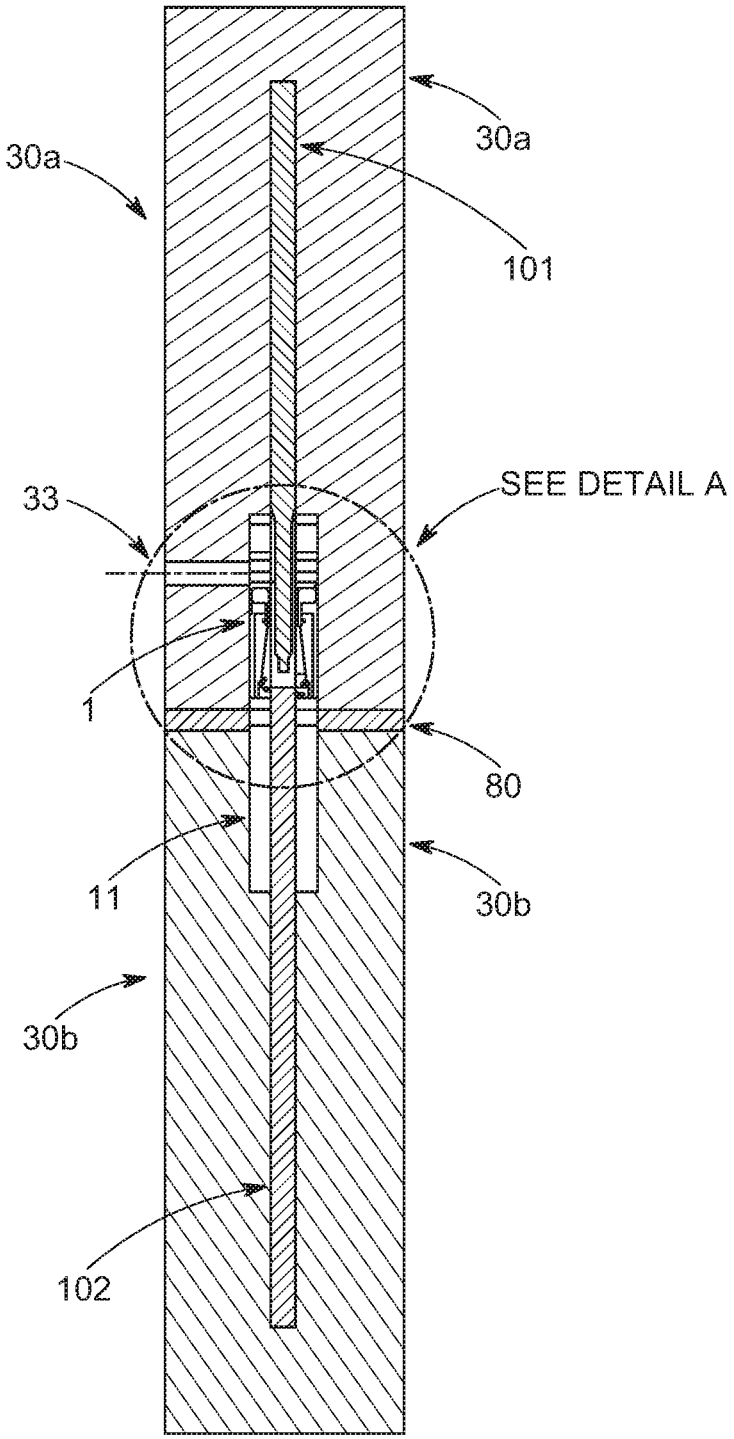
FIG. 21 illustrates a side cross-section view about line AA of the connected columns and coupling assembly.
Figure 22:
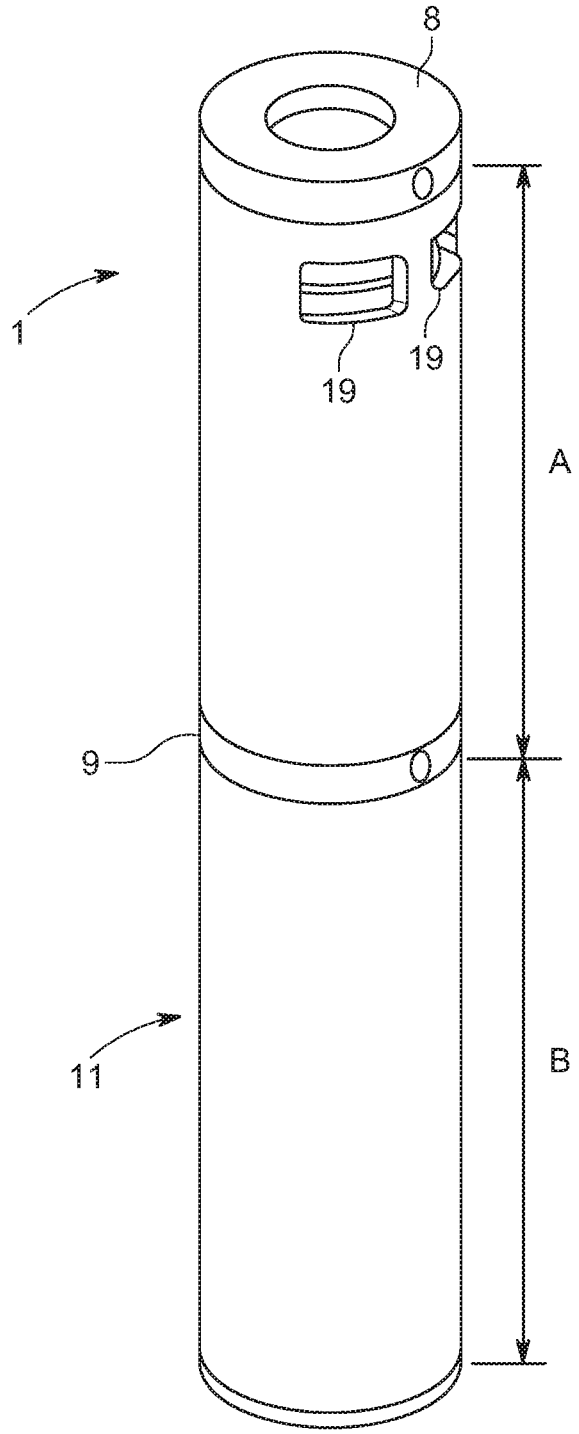
FIG. 22 illustrates a perspective view of the coupling assembly and an extension sleeve with the columns removed.
Figure 23:
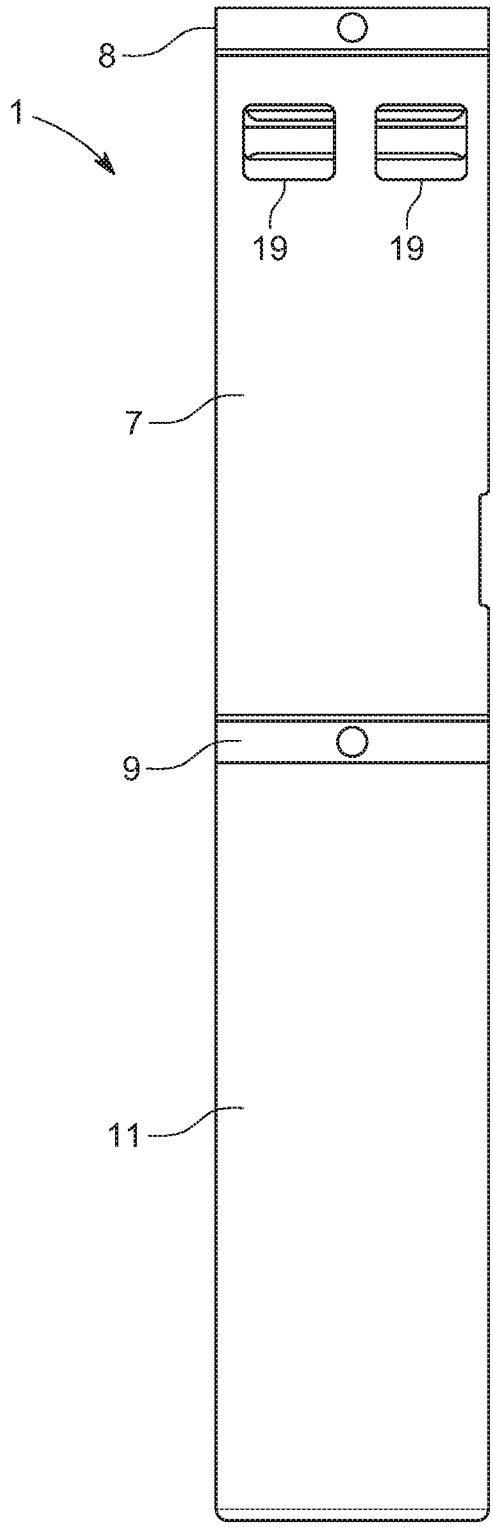
FIG. 23 illustrates a front view of the coupling assembly and extension sleeve with the columns removed.
Figure 24:
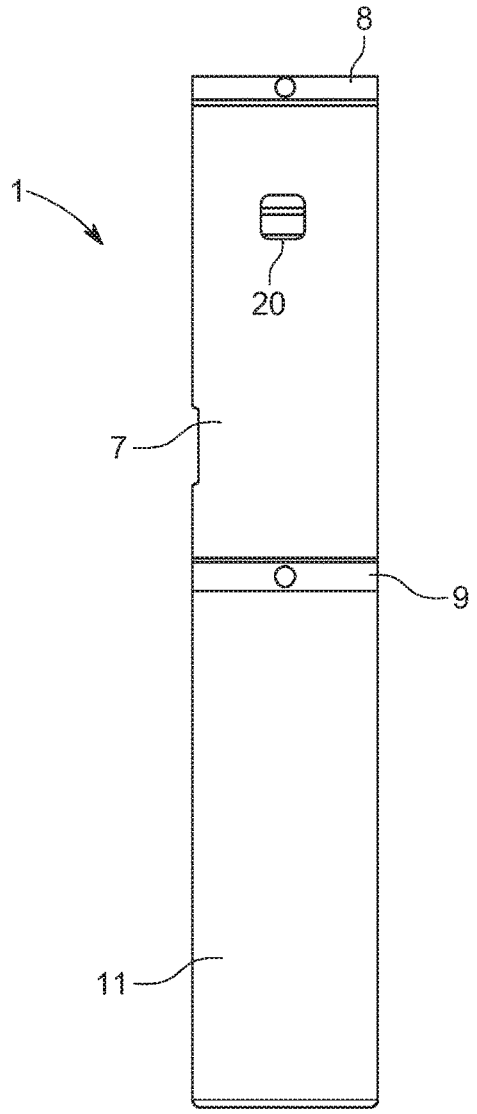
FIG. 24 illustrates a rear view of the coupling assembly and extension sleeve with the columns removed.
Figure 25:
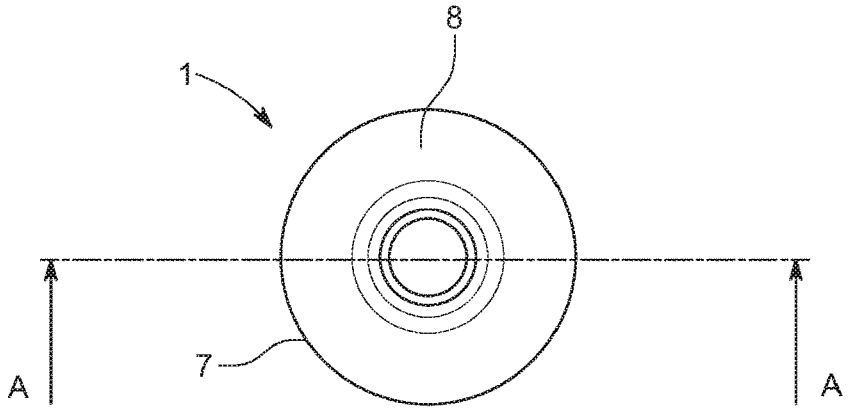
FIG. 25 illustrates a plan view of the coupling assembly and extension sleeve with the columns removed.
Figure 26:
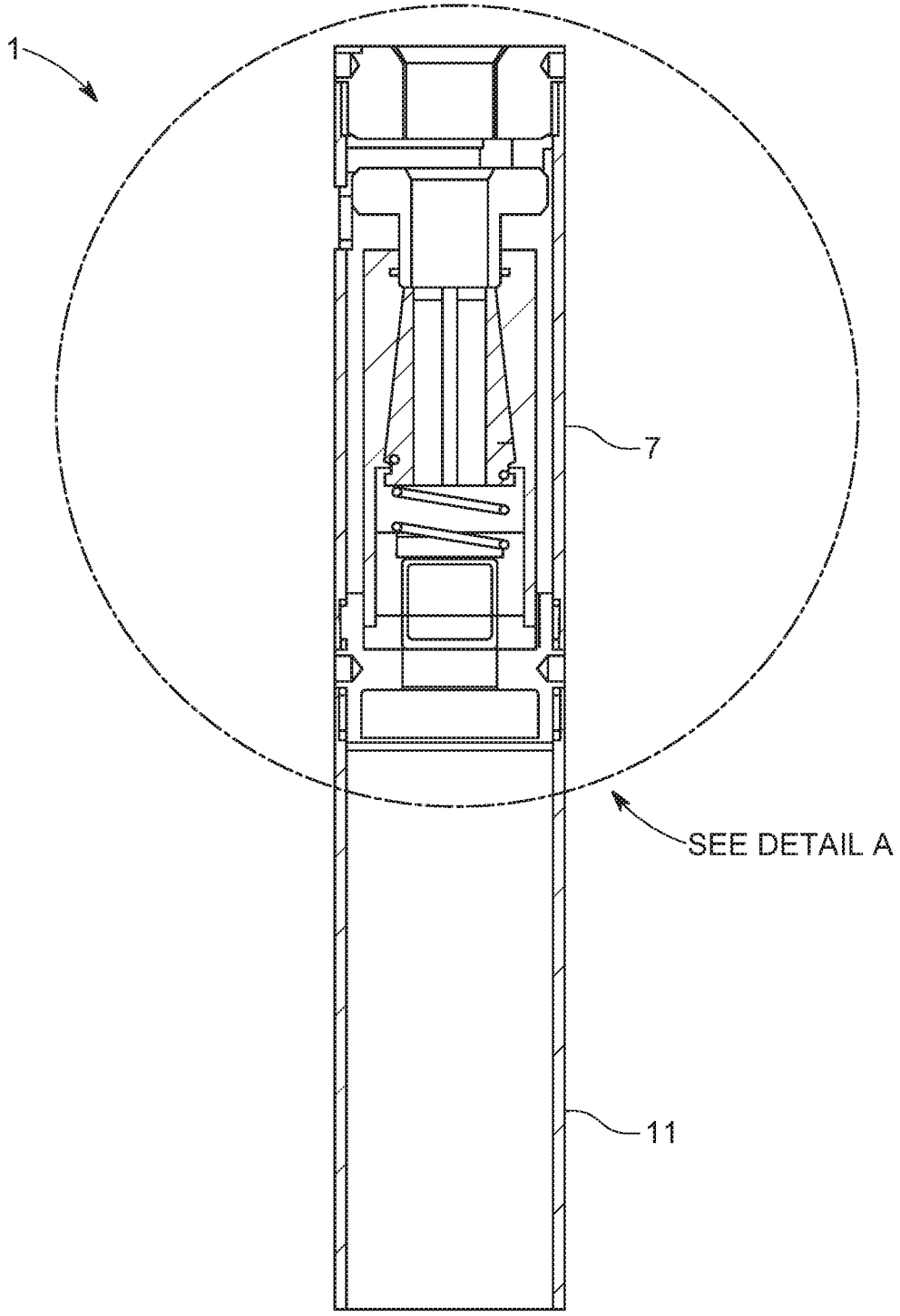
FIG. 26 illustrates a side cross-section view about section AA of the coupling assembly and extension sleeve in an engaged or locked position with the columns removed.
Figure 27:
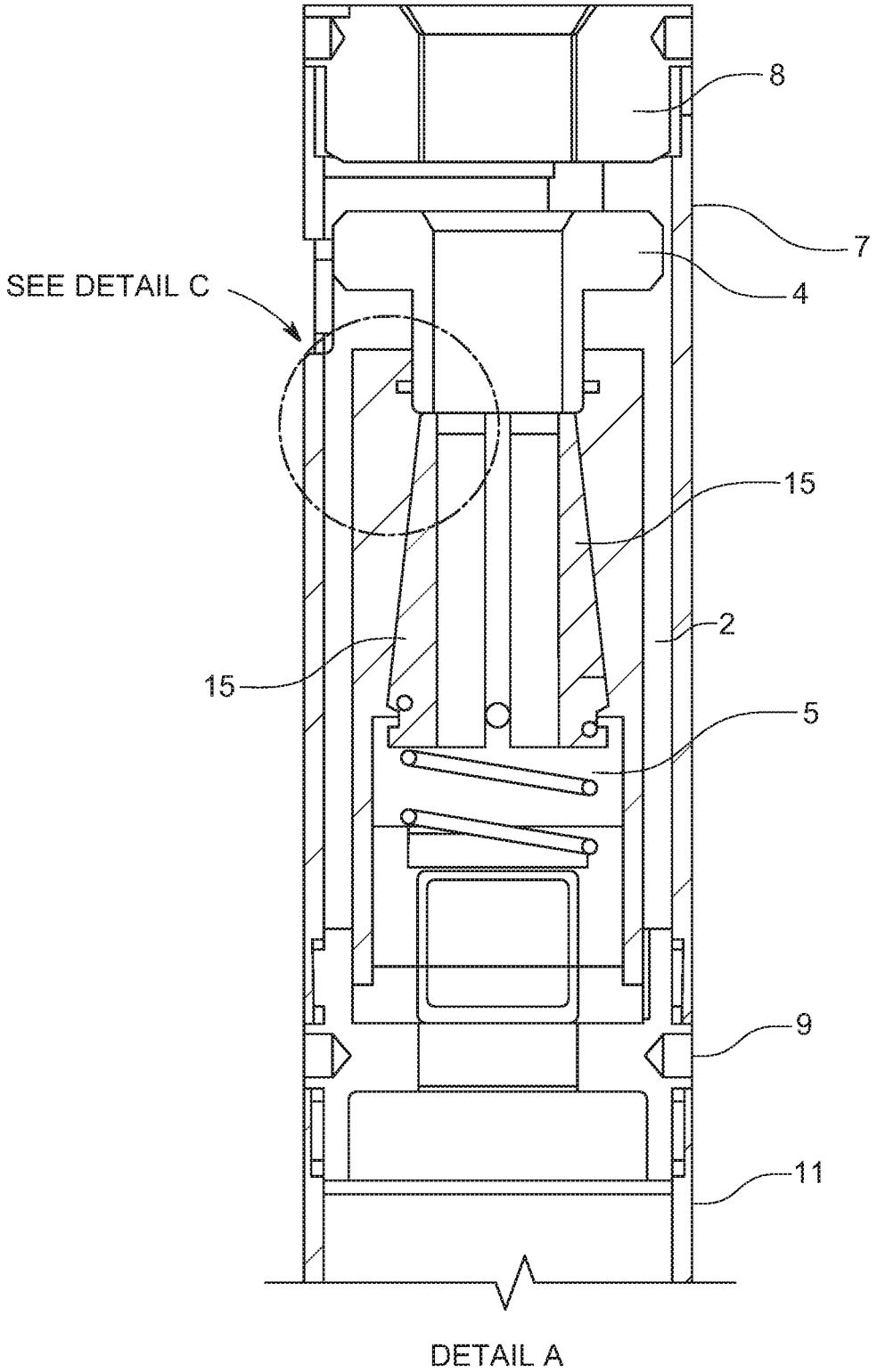
FIG. 27 illustrates a side detail A cross-section view about section AA of the coupling assembly and extension sleeve in an engaged or locked position with the columns removed.
Figure 28:
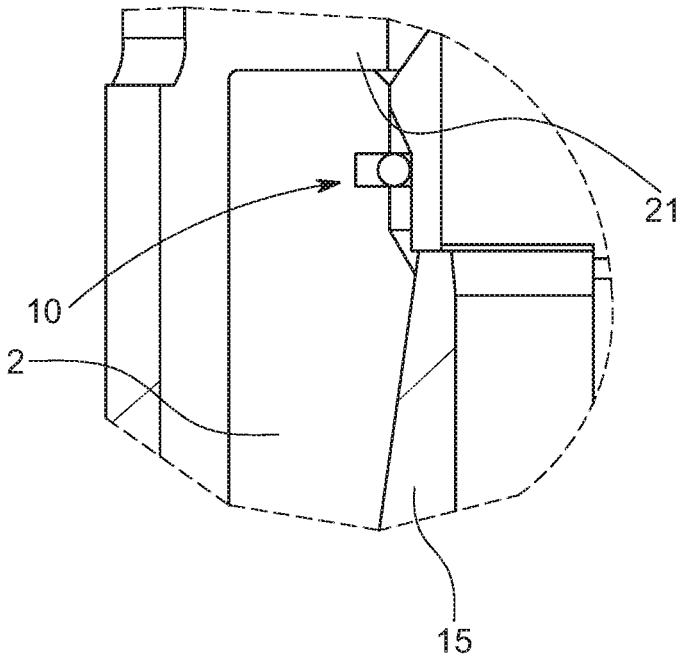
FIG. 28 illustrates a side detail A cross-section view about section AA of the coupling assembly and an extension sleeve in an engaged or locked position with the columns removed.
Figure 29:
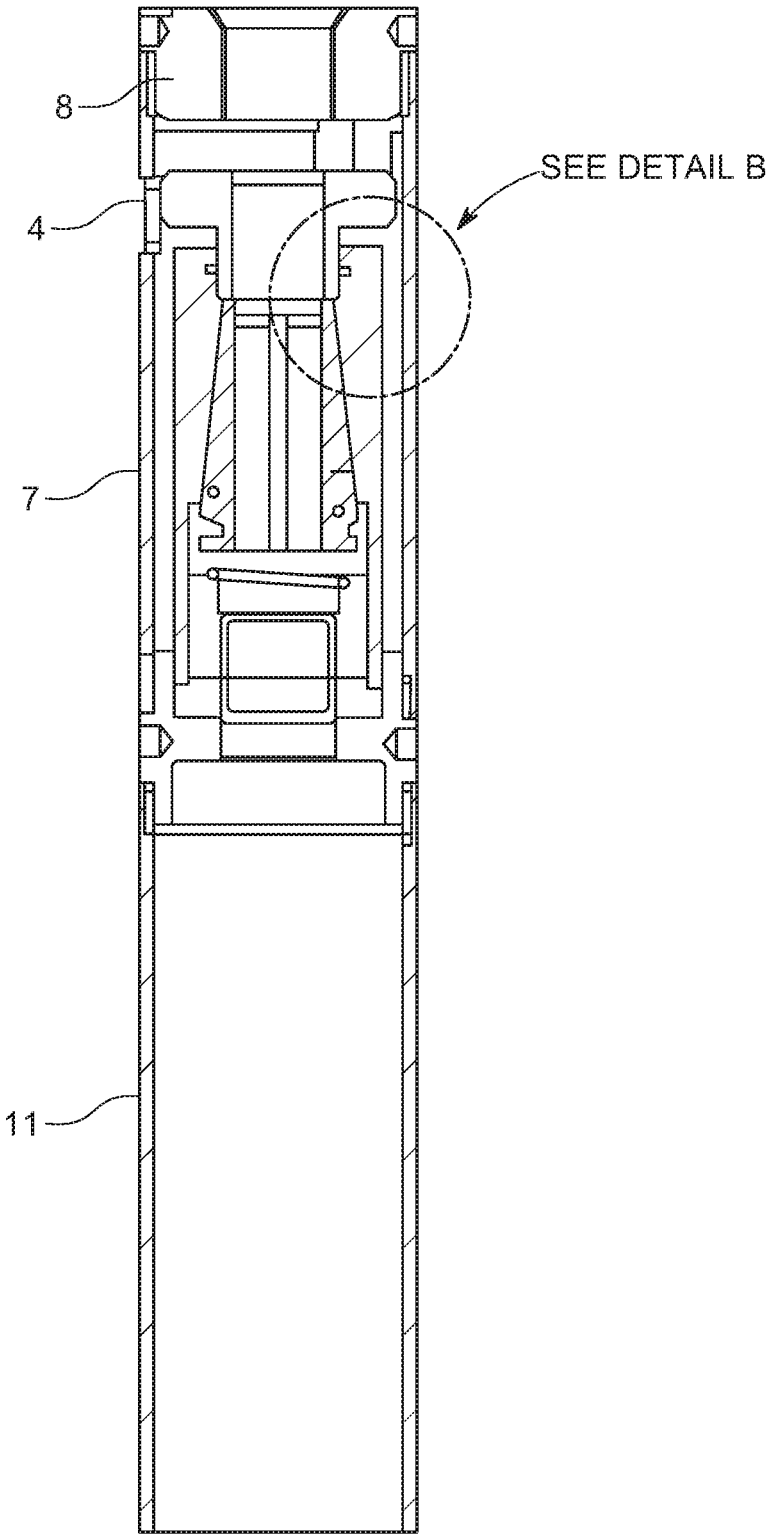
FIG. 29 illustrates a side cross-section view about section AA of the coupling assembly and extension sleeve in a disengaged or unlocked position with the columns removed.
Figure 30:
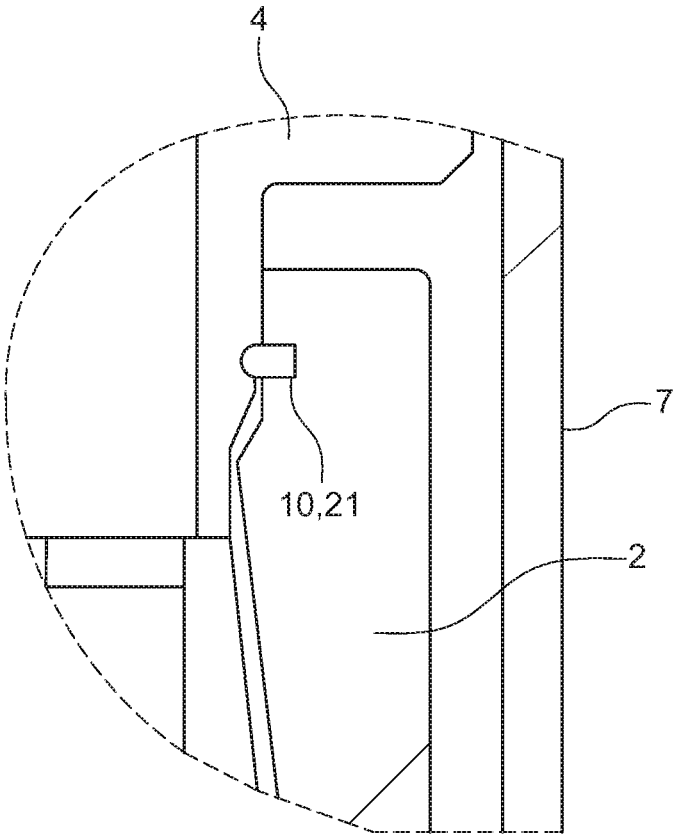
FIG. 30 illustrates a side cross-section view about section AA of detail B the coupling assembly and extension sleeve in a disengaged or unlocked position to show snap ring and groove alignment.
Figure 31:
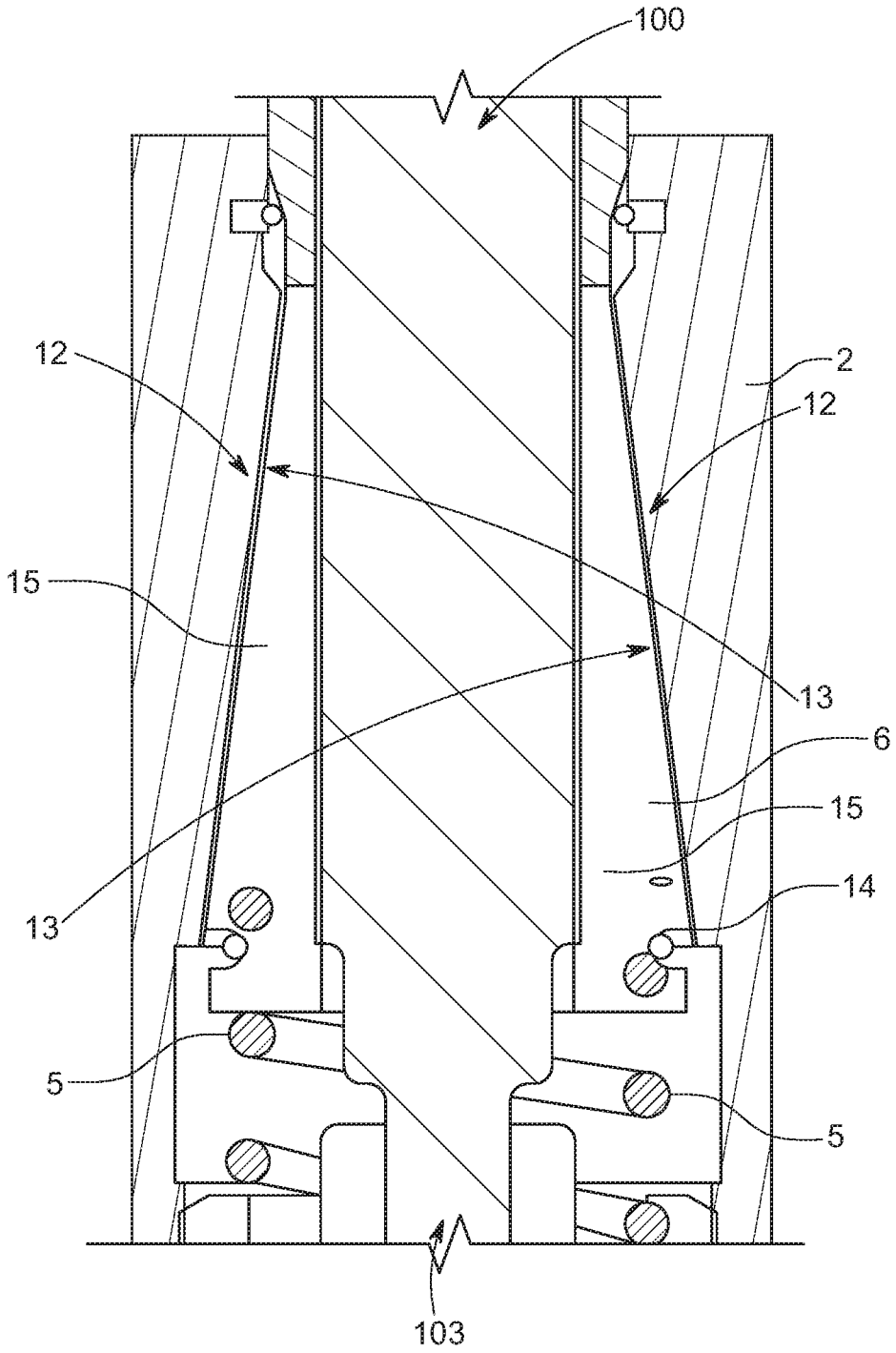
FIG. 31 illustrates a detail cross-section view of the anchor with an enclosing member removed and a rod coupled within the anchor jaw assembly.
Figure 32:
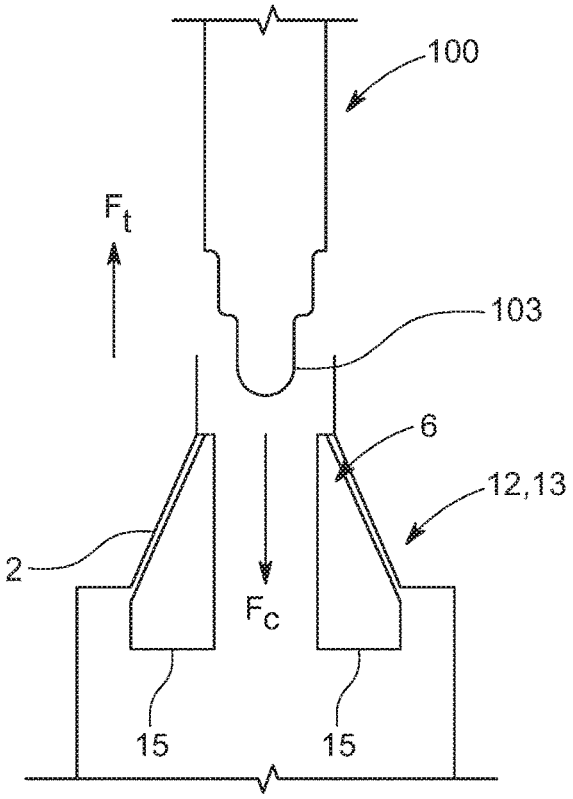
FIG. 32 illustrates a detail cross-section view of the anchor with an enclosing member removed and a rod separate to the anchor jaw assembly.
Figure 33:
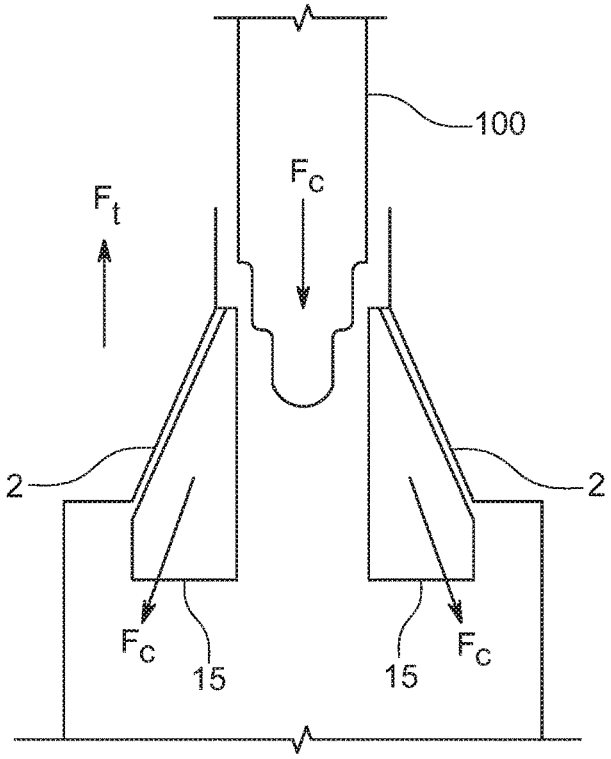
FIG. 33 illustrates a detail cross-section view of the anchor with an enclosing member removed and a rod being introduced to the jaw assembly and the compressive forces being applied.
Figure 34:
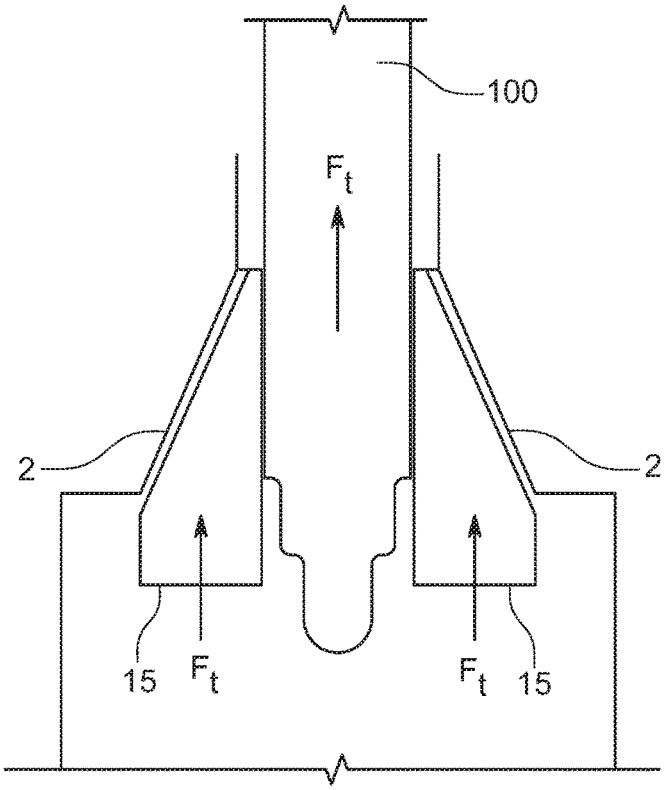
FIG. 34 illustrates a detail cross-section view of the anchor with an enclosing member removed and a rod inserted into the jaw assembly and the tensile force direction causing coupling.
Figure 35:
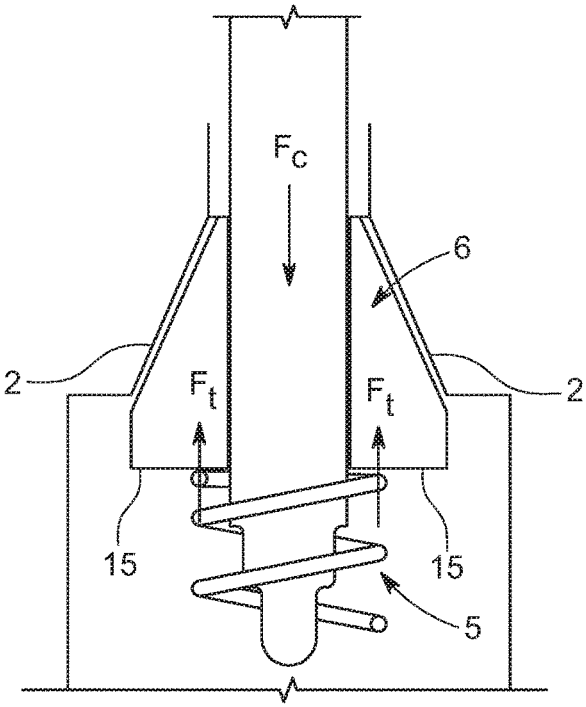
FIG. 35 illustrates a detail cross-section view of the anchor with an enclosing member removed and a rod inserted into the jaw assembly showing the compression spring and resulting energisation of the jaw assembly.

As noted above, a coupling system is described comprising an anchor that may releasably connect to a coupled member. Associated tools configured to cooperate with the coupling system and methods of use of the coupling system and release or re-engagement of the coupling system are also described. In one embodiment, the coupling system may further comprise an enclosing member and release member and a related tool or tools to actuate release of the connection and re-engage of the connection as desired.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'comprise' and grammatical variations thereof shall have an inclusive meaning—i.e. that it will be taken to mean an inclusion of not only the listed components it directly references, but also other non-specified components or elements.

Terms such as 'front', 'forward', 'rear', 'side', 'top', and 'bottom', 'up' and 'down' and grammatical variations thereof as used herein, in the context of the anchor, refer to aspects of the anchor relative to the location and placement of the anchor and anchored member or members.

A Coupling Assembly

In a first aspect, there is provided a coupling assembly configured to releasably connect a coupled member to the coupling assembly, the coupling assembly comprising:

an anchor comprising:

at least one jaw, the jaw, or each jaw, having an internal jaw side interfering with movement of the coupled member relative to the anchor and an external taper;

a body with an internal taper complementary to, and abutting against, a jaw external taper; and, an enclosing member, wherein the enclosing member at least partly surrounds the anchor with an opening therein to allow passage of the coupled member to the anchor inside the enclosing member wherein, the anchor fits snugly within the enclosing member thereby minimising any relative movement between the anchor and enclosing member; and a release member;

wherein the coupling assembly is configured so that, in a first coupled position, the anchor at least one jaw engages the coupled member and therefore prevents separation of the coupled member from the anchor, and, when actuated, the release member forces the anchor at least one jaw to disengage the body and move to a second uncoupled position.

A Coupled Member and Coupling Assembly

In a second aspect, there is provided a coupling assembly and a coupled member, wherein:

the coupled member is located within, and is releasably coupled to, the coupling assembly; and wherein the coupling assembly comprises:

an anchor comprising:

at least one jaw, the jaw, or each jaw, having an internal jaw side interfering with movement of the coupled member relative to the anchor and an external taper;

a body with an internal taper complementary to, and abutting against, a jaw external taper; and, an enclosing member, wherein the enclosing member at least partly surrounds the anchor with an opening therein to allow passage of the coupled member to the anchor inside the enclosing member wherein, the anchor fits snugly within the enclosing member thereby minimising any relative movement between the anchor and enclosing member; and a release member;

wherein the coupling assembly is configured so that, in a first coupled position, the anchor at least one jaw engages the coupled member and therefore prevents separation of the coupled member from the anchor, and, when actuated, the release member forces the anchor at least one jaw to disengage the body and move to a second uncoupled position.

As noted above, the coupling assembly also comprises a coupled member, wherein the coupled member is located within, and is coupled to, the coupling assembly.

As may be understood from the above aspects, the coupling assembly (and optionally a coupled member therein) act to cause a connection preventing removal of a coupled member from the coupling assembly when a tensile force is applied that attempts to remove the coupled member from the coupling assembly. This connection can be released. The enclosing member minimises relative movement between the anchor and coupled member and in doing so addresses overturning loads on the coupling assembly.

Tension and Compression

As noted above, the coupling assembly is configured so that the coupling assembly may have a coupled configuration that prevents separation of the coupled member from the anchor. As described further in this specification, this coupling may be released. Terms such as tensile force or tensile direction may be used herein to refer to an in-use coupled configuration where the anchor jaw(s) engage a coupled member therein corresponding to a force load that attempts to de-couple the coupled member and anchor. Conversely, a compressive force or direction may act to release the jaw(s) from the coupled member therein and allow removal of the coupled member from the anchor. The terms tension and compression or grammatical variations thereof are used as a means herein to explain force directions however, these forces may not always be tension or compression forces alone and are used by way of explanation only.

Jaw Relationship

The anchor operates via an interference arrangement. In one embodiment, when a tensile force is imposed on the coupled member, the tensile force may cause the at least one jaw of the anchor to be drawn against the anchor body internal taper in a first direction and, the internal taper then causes a reaction force on the at least one jaw in a substantially perpendicular direction to the tensile force on the coupled member, imposes the at least one jaw to clamp against the coupled member within the at least one jaw and thereby halt relative movement between the coupled member and the coupling assembly.

The anchor at least one jaw may at least partly disengage the anchor body in the event of an opposite force e.g. a compressive loading being applied to the coupled member. Compressive loading if used, may be in a direction substantially opposite that of a tensile loading.

Jaw Detail

In one embodiment, the at least one jaw may be a jaw assembly comprising at least two, or three, or four separate jaws linked together. The jaws may form a circular cross-section when linked together. The jaws may be linked together via a linking member such as a spring.

Jaw Movement

The at least one jaw may move parallel to a tensile or compressive force imposed on the coupled member. Generally, the coupling assembly may be designed so that a tensile force imposed extends along a longitudinal axis of a coupled member within the coupling assembly (and a longitudinal axis of the coupling assembly). The at least one jaw tends to follow the direction of a force imposed either up or down within the anchor body. Some degree of side or lateral force loading may be supported, this lateral loading being transferred and at least somewhat converted via the enclosing member to a parallel force on the anchor and anchor at least one jaw and body tapers.

Coupled Member

Whilst the coupled member may take various forms and configurations, in one embodiment, the coupled member may be a rod. The rod may have an elongated shape with opposing ends.

For the purposes of this specification, the term 'rod' may be used interchangeably with the term coupled member. Reference to the term rod is not intended to be limiting since other shapes and forms may be used as coupled members e.g. T shaped or L shaped members.

The rod may be a steel rod although other materials could be used such as other types of metal or even woods or composite materials.

In one embodiment, the rod at one end which connects to the coupling assembly, may be substantially smooth. This rod end may not be threaded or otherwise contoured although, optionally threads or ribs or other surface features could be used. An opposing end of the rod distant to the coupling assembly may be threaded or otherwise comprise exterior features.

The rod diameter, at least about an end that connects to the coupling assembly may have a diameter sized to expand the anchor at least one jaw to match the largest rod diameter/size.

Release Member

As noted above, an advantage of the above coupling assembly may be the ability to release the coupled member from the anchor. Optionally, it may also be possible to re-engage or arm the coupling assembly again post release.

Also as noted above, when actuated, the release member forces the anchor at least one jaw to disengage the body and move to a second uncoupled position.

The coupling assembly may comprise a release member that is configured to be urged to force the anchor at least one jaw to disengage from the first coupled position to a second uncoupled position where the anchor at least one jaw is released or moves from the anchor body and allows a coupled member therein to uncouple.

In one embodiment, the release member may comprise a collar and shaft extending from the collar. Urging to release the coupling assembly imposes a force on the collar which in turn urges a compression force on the at least one jaw of the anchor (and not the anchor body), thereby causing the at least one jaw to separate from the body of the anchor i.e. the tapers separate. The force direction to release may be in an opposite direction to the engaged force of the jaws on the anchor.

The release member shaft may be sized to impose an urging force on the at least one jaw and not the anchor body.

The release member collar may have a larger size or diameter than the size or diameter of the release member shaft. The collar may have a diameter or size that complements and slidingly engages the size or diameter of the enclosing member or sleeve.

As may be appreciated from the above, it should be understood that the release member moves up and down within the enclosing member between two positions, a first position being a tension position where the release member is urged away from the at least one jaw and does not impose a compression force on the at least one jaw. A second position may be where the release member moves against a tensile force position and has urged the at least one jaw at least partly from a taper of the body so as to allow a coupled member to release from the anchor.

The release member when not urged, does not interfere with movement of the anchor or anchor body or anchor at least one jaw or a coupled member therein when a tension force is applied.

The release member may be located intermediate the enclosing member and anchor. In one embodiment, the release member may be located between a top cap of the enclosing member and the top of an anchor at least one jaw.

The release member may comprise a bore though the centre longitudinal axis of the release member. This bore may allow passage of the coupled member through the release member. The release member bore size may be a sliding fit to the coupled member. A relatively tight tolerance in fit between the coupled member and release member bore may be important to avoid mis-alignment between the release member, enclosing member and coupled member, particularly when release is urged.

Where a bias member is used to urge tensioning of the anchor at least one jaw, release member movement may be in a direction opposite the bias direction of the bias member i.e. the release member movement counteracts the bias direction.

Release Tool

The release member may be urged from a first tension position to a second compression position via a release tool.

In one embodiment, the release tool may comprise at least one tine and one end of the tine interferes with the release member and causes urging of the release member to a second compression position. The release tool tine may be inserted between the enclosing member or a part thereof e.g. the top cap, and a part of the release member e.g. the top of the release member collar. The tine may comprise an angled ending so that so that as the tine inserts between the enclosing member and release member collar, the size of the tine ending increases and in doing, increases the gap between the enclosing member and release member, urging the release member to the second compression position.

The release tool may comprise two parallel tines with a spacing between the tines. The two tines linked by a release tool body.

Hydraulic Release

As an alternative to the above release tool (or in combination with the release tool), the release member may be released via a hydraulic system. Reasons for release of the coupling may be similar to statements elsewhere in this specification, such as, to release the coupling in case of damage/release to correct an assembly error/or release at end-of-life.

Like in the release tool embodiment above, the release member may be moved or depressed so as to force the at least one jaw up or down and in doing so be urged to force the at least one jaw to disengage from a first coupled position to a second released position where the jaw(s) no longer grip the coupled member therein.

In one embodiment, the hydraulic system may be used in conjunction with the mechanical release tool described above. This might be useful to simplify the mechanical method of coupling release. It may also be possible however to use only a hydraulic system to cause uncoupling.

The hydraulic fluid used in the hydraulic system may be oil or grease. The hydraulic fluid may be pressurised using a manual dispenser (e.g. grease gun), hand pump, electric pump or similar. Pressurisation may occur via an access hole in the column assuming the coupling is used to couple a column or columns. The access hole may be a single hole. The hole may be relatively small so as to minimise any intrusion on the column aesthetics.

In one embodiment the flow path of the hydraulic fluid arrangement may be such that hydraulic pressure imposed by the hydraulic fluid causes acts on a piston. The piston may be housed and sealed by O-rings (or other seals) into a top cap of the coupling.

In a further release member embodiment, once in a release position, the release member is held or maintained in the release position to permit release tool withdrawal. Where a hydraulic system is used, the release position may be achieved using hydraulic pressure, and a mechanical latch such as a snap-ring noted above for the release member may not be needed and could be omitted from the design. The hydraulic pressure alone may be sufficient to retain the release member in position.

A fill point for hydraulic fluid may be fitted with a non-return device (such as a grease nipple or similar). This latches the jaws in a released or uncoupled position by fixing the volume of incompressible fluid, thereby reacting against the bias force of a compressed spring if used.

A similar method may be taken to re-set or re-couple a released coupling using the same tool in case of a change of mind. In an embodiment using hydraulic pressure, coupling of the jaws previously released may be completed by the step of unscrewing a bleed screw for example which may release hydraulic pressure and surplus grease from the coupling device. This in turn reduces pressure on the release member and allows the release member to be urged by the compression spring to an armed position again. To reset the device it may be necessary to lift the coupled member that is connected to allow access to the bleed screw—that is, if for example a change of mind occurs about disconnecting two elements after connection release, then it may be necessary to separate the coupled members to allow resetting of the coupling assembly. A bias on the at least one jaw may then return the at least one jaw to an armed or coupled position again with the hydraulic pressure removed.

The method of coupling re-set such as unscrewing the bleed screw noted may be altered in shape and form to optimise or adjust the reset speed. Slower reset speeds may, for example, be easier to clean up or contain than higher re-set speeds. Excess hydraulic fluid bled from the coupling could be wiped away or captured in a chamber such as a accumulator potentially for re-use. Bias pressure may return the at least one jaw to the armed/coupled position.

Release Tool Access

The release member may be accessed via at least one opening in the enclosing member termed hereafter as at least one release opening.

The at least one release opening may be located proximate an interface between the release member and a part of the enclosing member. For example, the release opening(s) may be located towards the top of the enclosing member to expose an interface between the top of the release member collar and the bottom of an enclosing member top cap.

The release opening(s) may be sufficiently long so that the release opening length matches that extent of movement of the release member between the first and second positions. The release opening(s) may be sufficiently wide to accommodate the release tool or a part thereof described above.

The release tool may insert through the at least one release opening in the enclosing member to reach and urge compression force movement of the release collar to a second position.

The release tool tine or tines may lever against an edge or side of the enclosing member release opening to cause or increase a reaction force on the release member.

The release openings may be aligned about the coupling assembly sleeve in a horizontal plane or around the sleeve diameter or may be axisymmetric. If an external access hole for reset is not provided (e.g. when using a hydraulic release mechanism), then the release access hole detail can be repeated at 90° or 180° intervals around the, for example, a column. Note that reference to these angles should not be seen as limiting. It may be useful to use these angle spacings in square or rectangular column embodiments however, for circular or ovoid cross-section columns, the angles could be at any spacing.

Axisymmetric design may be useful where the coupled member such as a column can still be released even if initially installed in the wrong rotational position.

Release Member Capture

The release member may be releasably captured by the anchor when moved to a second compression position corresponding to an anchor release position.

Capture or placing a halt in movement of the release member relative to the anchor in the uncoupled position may be important to prevent unwanted catching of the jaw(s) and coupled member. Capture of the release member may also be important to hold the second position against the bias member biasing force assuming a bias member is present.

Capture in one embodiment may be achieved by a mating lock ring and opening located between a part of the release member and a part of the anchor, the lock ring and opening engaging together when the release member is in the second compression position. The lock ring may be located on a shaft of the release member or on the body of the anchor or vice versa.

Capture in this way also allows the release tool to be removed from the coupling assembly and the second position of the release member maintained.

As noted above, capture may also occur by retention of hydraulic fluid/pressure on the piston to hold the release position of the piston and release member i.e. to hold a force bearing on the jaws and spring so that the jaws disengage the coupled member. In this embodiment, a snap ring may not be needed.

Manual Release with Lifting Device

The coupling assembly can be used to retain a lifting device such a hook or eye, this lifting device being the coupled member in place of an upper rod. A lifting device could be used as part of the lifting equipment to hoist a column into position. Once lifting is complete, the anchor release mechanism could then be used to quickly disconnect the hook for re-use.

In an alternative release arrangement using a hydraulic system, a secondary manual release method may be provided for low-force situations e.g. lifting of a column or loadings of less than 2 tonnes. The method may use a tool such as a blade, driver or fork levering against an opening in the coupling assembly enclosing member. The tool used may be the arming tool or release tool described elsewhere in this specification. This may be useful to eliminate the potential complexity of providing hydraulic pressure at height.

Manual release may be enabled by providing a separation between the hydraulic piston and the release collar. This may allow the collar to be depressed by a tool, without needing to displace the hydraulically-locked piston.

Release Member Shaft Shape

The release member shaft may further comprise a shaped shaft. The shaft may have a smaller diameter end relative to the shaft base closest to the release member collar. Intermediate the two shaft diameters may be a step, this step being a sloped shoulder. The exact shape and dimensions for the relative diameters and shoulder may vary depending on specific characteristics and nature of the coupling assembly however, this shaped feature was identified by the inventors as being useful to cause smooth action, avoid misalignment and ensure clean capture between the mating lock ring and opening.

Arming and Arming Tool

Post release, the coupling assembly may be re-connected or armed again.

This may be achieved by the release member movement being reversed so as to re-couple the coupled member and anchor and remove any force acting on the at least one jaw that causes decoupling.

Reverse movement may be completed by completing reverse movement of the release collar relative to the anchor so as to urge the release collar to move away from the anchor body and jaws. On doing so, the anchor re-engages to prevent a tension force from moving the coupled member relative to the anchor.

In one embodiment, if the release tool remains engaged in the coupling assembly, arming may occur by removing the release tool and letting the bias force of the bias member causes tension to occur again and this in turn causes the release member to return to a first position.

In an alternative embodiment, particularly useful where the release member is captured in a second compression position, reverse movement to cause re-coupling may occur via an arming tool. The arming tool may be inserted between the release member and anchor body in this case and an upward urging force applied by the arming tool. This force overcomes any capture of the release member and forces the release member to a first tension position.

The arming tool may be inserted through at least one opening in the enclosing member (termed hereafter as an arming opening). The arming opening may be located proximate an interface between the release member and anchor body, for example between an underside of the release member collar and top of the anchor body. The arming tool may like the release tool have a tine or tines and the tine or tines may have an angled ending to urge part separation. If a bias member is present in the coupling assembly and of sufficient bias strength, it may be sufficient to overcome the capture forces between the release member and anchor body and further movement of the release member may occur due to the bias member force. In this embodiment, it may be sufficient for the arming tool to be at least partly rotated so as to introduce a prying force to overcome the capture force.

The arming opening may be sized like the release opening to allow access for the tool to the interface and have a length commensurate with the extent of movement of the release member between the first and second positions.

The arming tool tine or tines may lever against an edge or side of the enclosing member arming opening to cause or increase a reaction force on the release member.

Release Tool and Arming Tool the Same

While in the above description separate tools have been described, it may be appreciated that the same tool may be used for both release and arming. A single tool for both actions may comprise a tine or tines and an angled tine end.

Coupling Activation

The coupling assembly may comprise an activation member configured to impose an engagement force to be applied to the anchor, thereby causing engagement between the at least one jaw and body of the anchor.

In one embodiment, the activation member may be a bias member. The bias member may be located so as to bias the at least one jaw to an engagement position urging the external taper of the at least one jaw to abut the internal taper of the body. In one embodiment, the bias member may be a spring. The spring may be located inside the enclosing member and may abut the base of the at least one jaw and may bias the at least one jaw against the anchor body about the tapers. The spring may rest on an cap of the enclosing member, extending from the cap to the base of the at least one jaw. The spring may be a coil spring.

The engagement force may be a tension force between the at least one jaw and body of the anchor.

Aligned Coupled Members

In a third aspect, there is provided a coupling assembly configured to couple an end of a first coupled member coaxially to an end of a second coupled member, wherein:

- the first and second coupled members are located coaxially within the coupling assembly and wherein the coupled member ends comprise an alignment member configured to align the coupled member ends together coaxially, the first and second coupled member ends engaging each other within the coupling assembly; and wherein the coupling assembly comprises:

an anchor comprising:

- at least one jaw, the jaw, or each jaw, having an internal jaw side interfering with movement of the coupled member relative to the anchor and an external taper;
- a body with an internal taper complementary to, and abutting against, a jaw external taper; and, an enclosing member,

- wherein the enclosing member at least partly surrounds the anchor with an opening therein to allow passage of the coupled member to the anchor inside the enclosing member wherein, the anchor fits snugly within the enclosing member thereby minimising any relative movement between the anchor and enclosing member; and
- wherein the coupling assembly is configured so that the anchor at least one jaw engages the first or second coupled member, the opposing coupled member otherwise fixed to the coupling assembly, the first and second coupled members thereby coupled by the coupling assembly.

Alignment Member

In selected embodiments, one coupled member may be connected to another coupled member via the coupling assembly. For example, one rod may be connected to a further rod. The further rod may be connected to another item such as a column or ground surface. Aligning the two rod ends may be difficult in art couplings due to tight tolerances and inherent lack of tight tolerances during manufacture. The inventors have found that the coupling assembly described may allow for the coupled member ends to align together within the coupling assembly. In part this may be due to the coupling assembly being designed to allow for a degree of rod movement side to side and hence provide some degree of tolerance. This side to side movement may be assisted and/or guided through use of the alignment member described above.

In art coupling designs, the coupled member ends may be kept separate from each other and not meet at all within the coupler. It may be useful to have the coupled member ends meet together coaxially as this may reduce the overall size of the coupling assembly, increase strength through avoiding empty space between the rods and inside the coupler and to limit off set movement of the coupled members within the coupling assembly and hence concentrate any tension axially along the coupled members.

The coupled member ends may engage directly. For example, the ends may abut each other or be received into mating endings. Alternatively, the coupled member ends may engage indirectly via an intermediate member or members. For example, a spacer may be used as an intermediate member that acts as an alignment member to align and engage the coupled member ends.

In one embodiment, the alignment member may be a spigot style ending on each rod end. For example, one rod end may comprise a narrowed male fitting while the opposing rod end has a female fitting. When the rod ends are aligned, the female fitting tends to guide the male ending into place.

In an alternative embodiment, an upper coupled member may be aligned with the coupling assembly via an cone shape section. The cone shape section may be included in the enclosing member e.g. at a top cap, to guide the upper coupled member e.g. a column bore, into position. This cone may also provide protection for a hydraulic fitting described further below during column installation (assuming a hydraulic system is used).

Coupling Assembly With End Caps

In a fourth aspect, there is provided a coupling assembly configured to connect a coupled member to the coupling assembly, the coupling assembly comprising:

an anchor comprising:

- at least one jaw, the jaw, or each jaw, having an internal jaw side interfering with movement of the coupled member relative to the anchor and an external taper;
- a body with an internal taper complementary to, and abutting against, a jaw external taper; and, end caps,

- wherein the end caps link to the body, the end caps defining the coupling assembly ends and, wherein one or both end caps comprise an opening therein to allow passage of the coupled member to the anchor inside the body; and
- wherein the coupling assembly is configured so that the anchor at least one jaw engages the coupled member and therefore prevents separation of the coupled member from the anchor.

End Caps

One, or both, end caps may comprise an opening. The opening may be sized to complement a diameter of a coupled member so that a coupled member may slide or pass through one or both end caps. The end caps may house part or all of the release member (if included) substantially as described above. The end cap or end caps may comprise openings to allow for ingress and optionally egress of hydraulic fluid. The end cap or end caps may allow for passage of a release tool through the end cap or end caps.

Coupling Assembly with Enclosing Member

In a fifth aspect, there is provided a coupling assembly configured to connect a coupled member to the coupling assembly, the coupling assembly comprising:

an anchor comprising:

at least one jaw, the jaw, or each jaw, having an internal jaw side interfering with movement of the coupled member relative to the anchor and an external taper;

a body with an internal taper complementary to, and abutting against, a jaw external taper; and, an enclosing member, wherein the enclosing member comprises a sleeve and end caps, the sleeve slidingly engaging and surrounding the anchor and the end caps defining the sleeve ends and extent of internal volume inside the enclosing member, one or both end caps comprising an opening therein to allow passage of the coupled member to the anchor inside the enclosing member wherein, the anchor fits snugly within the enclosing member thereby minimising any relative movement between the anchor and enclosing member; and wherein the coupling assembly is configured so that the anchor at least one jaw engages the coupled member and therefore prevents separation of the coupled member from the anchor.

Enclosing Member

The coupling assembly may further comprise an enclosing member. The enclosing member may comprise a sleeve linked to the end caps, the sleeve slidingly engaging and surrounding the anchor and the end caps defining the sleeve ends and extent of internal volume inside the enclosing member. The anchor may fit snugly within the enclosing member thereby minimising any relative movement between the anchor and enclosing member.

The enclosing member may be a separate sleeve that fits over and encloses therein, the anchor at least one jaw and body. The enclosing member may further at least partly enclose an end of the coupled member, assuming the coupled member is present. The enclosing member sleeve slidingly engages the anchor. There may be no thread, fastener or adhesive to link the enclosing member and anchor together.

The sleeve may be sufficiently thick and sufficiently long to take up a lateral load on a sleeve side and at least partly transfer this load to a tensile load on the anchor inside the enclosing member.

The enclosing member snugly fits over the anchor to minimise relative movement between the anchor and the enclosing member. The enclosing member may both conceal the coupling assembly and prevent or minimise over turning load forces. This function of the enclosing member may be important in enclosed/concealed connections to prevent/minimise over turning load forces. The enclosing member may provide a compressive edge reaction for column overturning loads. A secondary function of the enclosing member may be to provide fire protection to the anchor jaws and char layer fire protection of the steel connection. As will be described further elsewhere, the enclosing member provides a reaction lever edge or face as well to move anchor related parts to cause coupling or uncoupling of the anchor.

A Column, Coupled Member and Coupling Assembly

In a sixth aspect, there is provided a column comprising:

at least one coupling assembly substantially as described above; and, at least one coupled member per coupling assembly, the coupled member, or each coupled member, being located intermediate a column and the coupling assembly, the at least one coupled member coupled at a first end to the column via a retention means and, at a second opposing end to the coupling assembly.

As noted above, the coupling assembly may be used to connect a column to a base plate/substrate. This aspect may have applications in building construction.

Retention Means

In one embodiment, the coupled member may be connected to the column by a retention means. Retention may be direct between the coupled member and column. Indirect connection is also possible. Connection of the coupled member to the column may be a permanent and non-reversible connection. Examples of retention means may be by use of adhesive between the coupled member and column; threading the coupled member into the column, fastener use to fix the coupled member and column together and combinations thereof.

In one embodiment, the retention means may distribute an axial tension force acting on the coupled member in a direction perpendicular to the coupled member longitudinal axis. The distributed axial force may be distributed beyond an immediate interface between a coupled member and the surrounds in which the coupled member end is enclosed.

In one embodiment, the retention means may be at least one barrel nut, each barrel nut comprising an elongated cylindrical form with an orthogonally angled threaded hole passing through the barrel nut and wherein the barrel nut is inserted into a bore in the column and the coupled member comprises a thread and a threaded end and the thread on the threaded end mates with a thread in the barrel nut. The barrel nut outer surface bears on the bore when an axial tension force is applied to the coupled member, the bore and outer surface of the barrel nut extending perpendicular to the longitudinal axis of the coupled member e.g. a reinforcing rod.

The retention means may be used inside the column described above. In an embodiment where one column is coupled to another column, both the upper and lower columns may use a retention member to retain an upper or lower coupled member to the upper or lower column respectively.

For example, a barrel nut may comprise an elongated cylindrical form with an orthogonally angled threaded hole passing through the barrel nut. The barrel nut is inserted into a bore in the column. The coupled member may comprise a threaded end and this thread mates with the barrel nut threaded hole. The coupled member is inserted through a bore in the column and threaded on the barrel nut inside the column. When a tensile force is applied between the coupled member and the barrel nut, an elongated length of the barrel nut bears on a part of a bore opening in the column and resists withdrawal of the coupled member from the column.

The above barrel nut may be one method of applying tension to a coupled member. In some embodiments, it may be an advantage to apply a small preload to the coupled member. Pre-load may be useful to take out backlash and clearances, resulting in reduced initial slip and improved connection stiffness. In this case a tension nut and washer may be installed at the top of a bore in the column, allowing the rod to be tensioned using a tube spanner.

This barrel nut approach may be used instead of adhesive between the column and coupled member described above. Alternatively the barrel nut or coupled member, or both, may also be adhered to the column as well. The inventors have found that barrel nut use not only provides a way to pre-tension the coupled members but also is a very strong and effective way to link the coupled members to the column.

Further aspects of the barrel nut are described more below.

Retention Means Positioning

In some arrangements, a simple method to achieve the correct rotational position of the anchor may be required, for example to align the release member with access holes in a column.

One method to achieve this may be by the following installation sequence:

- Mark lines showing required rotational position onto anchor and lower plate;
- Pre-install external locking nut onto the anchor;
- Torque the lower rod into the anchor, against a shoulder position-limiter such as that provided by a spigot described elsewhere in this specification;
- Pre-install a lower plate onto column;
- Pre-install a barrel nut into the column;
- Insert the anchor and lower rod into the column, and screw clockwise into the barrel nut until the anchor contacts the lower plate;
- Unscrew anti-clockwise until the position marks align;
- Hold the anchor in position while tightening the external locking nut.

Note that tightening the external locking nut may also pre-tension the lower rod in a similar way to the upper rod tension nut.

Column

A column as described herein may refer to a structural upright slab or pillar. The column may be used to form buildings or other structures and may be load bearing. Columns may be prism shaped with rectangular planar faces, sides and upper and lower ends.

Columns may be manufactured from various structural materials such as concrete, steel and timber. In selected embodiments, the columns are manufactured from laminated timber.

As described elsewhere in this specification, the column top or bottom or front and back faces may be bores or openings to accommodate the coupling assembly or tools used to access the assembly, for example to release to anchor and/or re-arm the anchor.

Bearing Area

The coupling assembly enclosing member, in this aspect, provides a bearing area to transfer a lateral force imposed on the column to a predominantly tensile force on the coupling assembly. This may be important in the event of a seismic event that causes both vertical plane movement and horizontal plane movement. In the inventors experience, the coupling assembly is extremely strong when a column is subjected to lateral loadings and force is transferred almost fully from a lateral loading to a tensile loading on the coupling assembly.

Internal Components

At least 60, or 65, or 70, or 75, or 80, or 85, or 90, or 95, or 100% of a volume of the coupling assembly may be located inside the column. The whole coupling assembly volume may be located inside the column. For example, the coupling assembly may be accommodated almost entirely or entirely within a bore or opening within the column. This may be important for aesthetic reasons—designers of buildings require coupling parts to be hidden from sight so that the building interior columns at least have no or minimal penetrations. This may also be important for fire protection. Exposed metal parts may be conductive to fire and heat allowing fire or heat access to internal parts of the column or coupled member. Where the column is wooden, if a fire or heat can be transmitted inside the column, the column structural strength may be compromised. Further, heat itself transmitted for example along a coupled member may destroy an adhesive link between a coupled member and column. Epoxy adhesives which are widely used between rods and wooden columns rapidly loses structural integrity at or above 70° C. hence preventing possible heat transmittance may be important.

In one embodiment, in the aspect above, the coupled member and coupling assembly are centrally located within the column.

In one embodiment, each column may comprise one coupling assembly and one coupled member. In a further embodiment, two or more coupling assemblies and coupled members may be used.

A Column to Base Coupling

In a seventh aspect, there is provided a column assembly, the column assembly connected to a base plate and substrate comprising:

- a column;
- a base plate fixed to a substrate;
- at least one coupled member; and,
- at least one coupling assembly substantially as described above;

wherein:

- the at least one coupled member is located intermediate the column and the at least one coupling assembly, the at least one coupled member coupled at a first end to the column and on an opposing second end to the at least one coupling assembly.

Substrate

As may be appreciated from the above aspect, a column may be coupled to a base plate and substrate. The substrate may for example by a foundation, the ground, a concrete pad, a pile or piles and so on.

Base Plate

A base plate may be located between column base and a substrate. The column bottom and substrate may be located directly against the base plate and any coupling assembly or assemblies may be hidden within the column and no gap may exist between the column and base plate.

A bolt may be located beneath the base plate that the coupling assembly engages to permanently or semi-permanently connected the coupling assembly and the base plate.

The base plate may have fastening openings and fastening members to allow the base plate to be secured to a substrate.

The base plate may include one or more locating members such as roll pins.

The base plate size may correspond to the size of a column base.

Multiple Coupling Assemblies and Coupled Members

As per other described aspects, the column to base plate connection may be made using one or multiple coupling assemblies and coupled members.

Column to Base Plate Release and Arming

As described above, the coupling assembly may be released to allow separation of the connection between the column and base plate and this connection re-armed through use of the release member. Column release and re-engagement may be useful to allow for removal and replacement of a column perhaps due to column damage or to alter placement of a column.

Column to Column Coupling

In an eighth aspect, there is provided a column assembly comprising a first column assembly connected vertically to a second column assembly via a connection, the connection comprising:

- a first column;
- a second column; and at least one connection between the first and second columns, the at least one connection comprising:

a first coupled member coupled to the first column and a second coupled member coupled to the second column and, intermediate the first and second columns, coupling the first and second coupled members together is a coupling assembly substantially as described above.

Multiple Columns

The above aspect illustrates how two or more columns may be connected using the coupling assembly. Further columns may be attached as to either the first or second column described by use of further coupling assemblies and coupled members.

Columns may be directly connected end to end without intermediate slabs or other building elements between the columns. In one embodiment, the columns may be indirectly connected end to end with a bearing plate located between the first and second column ends.

Extension Sleeve

In this aspect, an extension sleeve may be used. The extension sleeve may mate at one end with the enclosing member, the extension sleeve having a similar diameter and length as the enclosing member. If the enclosing member comprises a sleeve, the extension sleeve may have a similar diameter and length.

The extension sleeve may be located in a bore in the lower column opposite a complementary bore in the first column that houses the connection assembly. The extension sleeve may snug fit into the column bore and may not be adhered or fastened into the bore.

The extension sleeve may enclose part or all of the second coupled member, the second coupled member extending longitudinally along the extension sleeve longitudinal axis.

Multiple Coupling Assemblies and Coupled Members

As per other described aspects, the column to column connection may be made using one or multiple coupling assemblies and coupled members.

Bearing Plate

A single bearing plate may be located between columns. The column bottom and top may be located directly against the bearing plate and any coupling assembly or assemblies may be hidden within the columns and no gap may exist between the columns and bearing plate.

The bearing plate may include one or more locating members such as roll pins.

Column to Column Release and Arming

As described above, the coupling assembly may be released to allow separation of the connection between the columns and this connection re-armed through use of the release member. Column release and re-engagement may be useful to allow for removal and replacement of a column perhaps due to column damage or to alter placement of a column. One advantage the inventors have noted is that, in a multiple column structure where three or more columns are connected using the coupling assembly described, removal of one column can be completed without severe structural impairment.

Alternative Column to Column Connection

In a ninth aspect, there is provided a column assembly comprising a first column assembly connected vertically to a second column assembly via a connection, the connection comprising:

a first column;

a second column; and two bearing plates, one bearing plate fastened to the end of each column and the bearing plates abutting each other once the columns are coupled;

at least one connection between the first and second columns and bearing plates, the at least one connection comprising:

a first coupled member coupled to the first column and a second coupled member coupled to the second column and, intermediate the first and second columns, coupling the first and second coupled members together is a coupling assembly substantially as described above.

Multiple Bearing Plates As may be noted from the above aspect, the coupling assembly may not use an extension sleeve for a lower rod and lower column. Instead, this alternative embodiment of coupling assembly may use top and bottom bearing plates that are fastened using screws to either end of the columns and butted together (uncoupled) about the column ends. The coupling assembly may act to centre the unconnected top and bottom plates and may aligns the upper and lower columns together.

In this embodiment, the load path from an overturning force imposed on the column(s) differs to the earlier embodiments. The load path may run from an upper column, to an upper screw, to the top plate, to the coupling assembly to the bottom plate, to the bottom screw and out to the lower column. The force load path may be via the opposite path to the above described path as well and via multiple screws (upper and lower). The inventors have found that this load path appears to give up to 10 times more resistance to an overturning force than earlier embodiments which may be useful in selected embodiments.

In this further embodiment, the coupling assembly may further comprise pre-tensioning elements that act to tension a coupled member or members against a column or columns prior to an over-turning force being applied. Pre-tensioning minimises any slack in movement prior to the coupling assembly taking effect and the load path noted above being imposed. Without pre-tensioning it is possible that some degree of movement may occur before the load path engages which may not be ideal.

The inventors found that, for typical geometries, higher lateral load capacities can be provided by this screw arrangement compared to timber bearing perpendicular to grain onto an extension tube.

Bearing areas at the contact between internal holes in the plates and external diameters of the anchor components may be designed to support the required loads. The designed for features may be the diameters of the centre hole through each plate, and the bearing plate thickness.

In this alternative arrangement, the optional extension sleeve described elsewhere in this specification may be omitted.

In this alternative arrangement, a tight or snug fit with contact may not be required between the coupling assembly and the column bore diameter. A nominal clearance with no gap may be designed to allow for tolerance and moisture dimension change effects.

Column to Column Coupling Alternate Release Point

In a tenth aspect, there is provided a column assembly with a coupled member releasably coupled to the column, the column assembly comprising:

a column;

a coupled member releasably coupled at one end to the column interior and extending from an end or side of the column;

a retention means releasably coupling the coupled member end to the column interior, the retention means comprising a barrel nut and wherein the coupled member end releasably engages the barrel nut and the barrel nut engages the column or a part thereof.

Retention Means/Barrel Nut

The column may comprise a bore that houses the retention means therein. The barrel nut may have a cylindrical shape with a longitudinal axis. An opening in the barrel nut receives an end of the coupled member. This opening may be orientated so that the barrel nut longitudinal axis is perpendicular to the longitudinal axis of the coupled member. As noted elsewhere in this specification, the retention means or barrel nut extends the load path of a tensile force on the coupled member outwardly from the longitudinal axis of the coupled member and beyond the immediate interface between the coupled member and column.

In one embodiment, the coupled member and barrel nut threadingly engage together. Reversing the thread engagement may allow the coupled member and retention means to uncouple. Alternative methods may be used to achieve releasable coupling.

In one embodiment the barrel nut may comprise a set screw that threads into a bore in the barrel nut and which engages a groove in the coupled member and in doing so, interlocks the set screw and groove and couples the coupled member and barrel nut together. The set screw may be unscrewed to release the coupled member from the barrel nut.

In an alternative embodiment, the barrel nut has a bore and the coupled member end has a cross-hole and the barrel nut bore and coupled member cross-hole receive a through pin which acts to couple the barrel nut and coupled member together. The through pin may be removed again to release the coupled member and barrel nut.

In a further embodiment, the barrel nut is split into two halves that clamp about the coupled member end and are held in place using screws. The coupled member to barrel nut load path may be further enhanced by the coupled member having an enlarged or flanged head, the head bearing on the barrel nut when a tensile force is applied to the coupled member. This split barrel nut embodiment may be further varied by introducing wedge jaws in the interface between the split barrel nut sides and the coupled member. The screws may then clamp the wedges and barrel nut sides to the coupled member. When a tension force is applied the coupled member, the wedge jaws work the further couple the coupled member to the barrel nut. This coupling is however easily reversed by unscrewing the screws to remove the jaws from the coupled member.

In one embodiment, a first column may be linked to a second column using the above approach where a single coupled member extends into either column and at either one end of the coupled member, or at both ends, the above barrel nut retention means is used to releasably connect the coupled member and columns.

In a further embodiment, the above column assembly may further comprise the coupling assembly described elsewhere in this specification. In this embodiment, two coupled members may be linked by the coupling assembly, one coupled member being releasably coupled to a first column and the second coupled member linked to a second column or base plate/substrate. The coupling assembly may be centrally located between the columns or between the column and base plate/substrate. The coupling assembly may be a non-releasable coupling. Alternatively, the coupling assembly may be a releasable coupling hence providing a further release point for the assembly described.

A Method of Release and Engagement of a Coupled Member

In an eleventh aspect, there is provided a method of releasing a coupled member from a coupling assembly comprising:

- selecting the coupling assembly and coupled member substantially as described above;
- connecting the coupled member therein; and
- either inserting a release tool through at least one opening in the enclosing member (if present) and body to urge movement of a release member towards the at least one jaw;
- or inserting hydraulic fluid to urge movement of a release member towards the at least one jaw;
- thereby causing the at least one jaw to disengage the body of the anchor and allow the at least one jaw to disconnect from the coupled member.

Release Member Movement

As noted in the earlier description, the release member is moved between positions to cause compression on the jaw(s) and movement of the jaw(s) from the body to allow disconnection of the coupled member and anchor. The release tool as noted above may be used to force the release member away from a top of the enclosing member and against a tension bias (if present). Alternatively, as noted a hydraulic fluid may be used in a pressure chamber to force the release member away from a top of the enclosing member and against a tension bias (if present). Capture of the release member may occur in the second compression position.

Re-Arming

The method described in the above aspect may be reversed to cause re-arming of the coupling assembly by the further step of:

- inserting an arming tool through at least one opening in the enclosing member (if present) and body to urge movement of the release member away from the at least one jaw to remove a de-coupling force and allow the anchor at least one jaw to re-engage the coupled member.

Single Tool

As noted earlier this this description, a single tool for both release and arming actions may be used. The single tool may for example comprise a tine or tines and an angled tine end.

Quick Release and/or Arming Tool

In a twelfth aspect, there is provided a tool configured to release the coupled member from the coupling assembly substantially as described above and optionally, re-engage the coupled member to the coupling assembly substantially as described above, the tool comprising:

- at least one tine, one end of the at least one tine interfering with a release member to cause urging of the release member to:
  - a second uncoupled position from a first coupled position to release the coupled member from the coupling assembly; or a first coupled position from a second uncoupled position to re-engage the coupled member to the coupling assembly.

Tool Tine Insertion Point

In order to release the coupled member from the coupling assembly, the tool tine may be configured to be inserted between the enclosing member or a part thereof e.g. the top cap, and a part of the release member e.g. the top of the release member collar.

In order to re-engage the coupled member to the coupling assembly, the tool tine may be configured to be inserted between the release member e.g. the bottom of the release member collar and the top of the anchor body or at least one jaw.

Tines

The tine or tines may comprise an angled or tapered ending so that, as the tine inserts or wedges between the enclosing member and release member collar (or anchor body and release member collar), the size of the tine ending increases and, in doing so, increases the gap between the enclosing member and release member or anchor body and release member, urging the release member to the second or first positions respectively.

The tool may comprise two parallel tines with a spacing between the tines. The two tines linked by a tool body.

Alignment Tool

In a thirteenth aspect, there is provided an alignment tool configured to align the coupled member in the coupling assembly substantially as described above, the alignment tool comprising:

- a tongue configured to extend through an opening in the enclosing member and bear on a side of the coupling assembly or part thereof;
- connected to the tongue, an elongated member with a guide slot therein, the guide slot elongated in a direction to allow movement of the tongue towards or away from a side of the coupling assembly; and
- wherein the guide slot in the elongated member is configured to restrict movement of the alignment tool in a single plane of movement relative to at least two extending members, the at least two extending members being located on a bearing plate or base plate.

Handle

The alignment tool further comprises a handle extending from the elongated member.

U-Shape

The alignment tool has a U-shape cross-section, the lower part of the U-shape corresponding to the elongated member and the tongue and handle if present raised relative to the elongated member.

Extending Members

The extending members may be roll pins. The extending members are attached to the bearing plate or base plate. The extending members may be located along a central longitudinal axis of the bearing plate or base plate off set from the coupling assembly.

Location Hole

The enclosing member comprises a location hole or holes that the tongue of the alignment tool passes through in order to bear on the coupling assembly.

Method of Coupling

In a fourteenth aspect, there is provided a method of connecting a coupled member to a coupling assembly by:

- selecting at least one coupling assembly substantially as described above;
- selecting at least one coupled member;
- inserting an end of the at least one coupled member into the at least one coupling assembly; and
- optionally, apply a coupling force to the at least one coupled member to urge the at least one coupling assembly to connect to the at least one coupled member.

As may be appreciated from the above description, the coupled member may extend at one end from a column and the column may be connected to the coupling assembly via the above method.

The coupling assembly may be attached to a base plate and the coupled member (and column if present) may be connected to the base plate (and substrate to which the base plate may be attached).

The coupling assembly may be attached to a bearing plate and the coupling assembly used to connect two columns together via a second coupled member, one end of which is linked to the second column, optionally via an extension sleeve on the second column.

Selected advantages of the coupling system, coupler tools and methods of use thereof may comprise one or more of the following:

- Provision for a strong coupling that allows for compression and tightens in response to a tensile force;
- Simple construction which allows for a degree of lower tolerance in coupled member placement, particularly in column coupling embodiments;
- The coupling system can be released and re-engaged;
- The coupling system is highly versatile for many different applications;
- In a wooden column, minimal penetration of the column is needed and hence the coupling system and methods meet aesthetic requirements and fire requirements.

The embodiments described above may also be said broadly to consist in the parts, elements and features referred to or indicated in the specification of the application, individually or collectively, and any or all combinations of any two or more said parts, elements or features.

Further, where specific integers are mentioned herein which have known equivalents in the art to which the embodiments relate, such known equivalents are deemed to be incorporated herein as if individually set forth.

WORKING EXAMPLES

The above described coupling system, coupler tools and methods of use thereof are now described by reference to specific examples.

Figure 54:
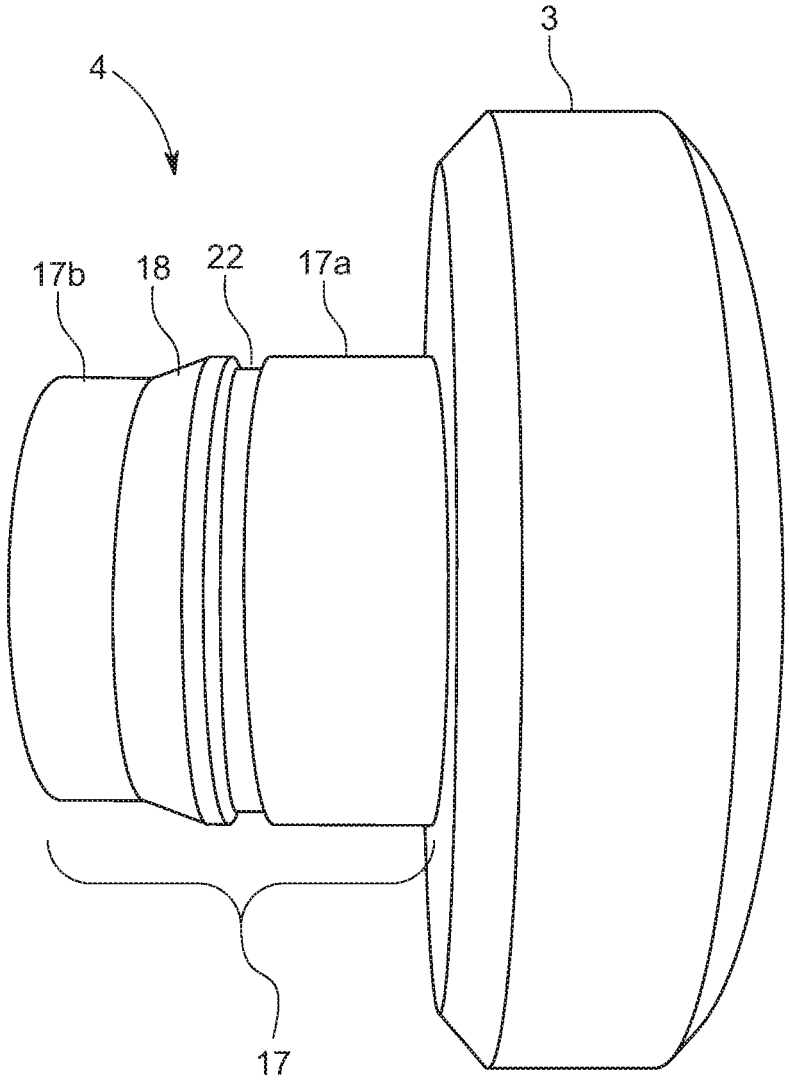
FIG. 54 illustrates a detail side view of an embodiment of release member.

For the purposes of examples 1-7 and FIGS. 1-54, the following parts and their item numbers are referred to:

Coupling assembly 1
Anchor body 2
Release member 4
Release member collar 3
Release member shaft 17
Upper shaft 17*a*
Lower shaft 17*b*
Release collar shoulder 18
Bias member/compression spring 5
Jaw assembly 6
Enclosing member/sleeve 7
Sleeve length A
Cap upper/top cap 8
Cap lower/bottom cap 9
Snap ring 10
Tension force Ft
Compression force Fc
Lateral force Fl
Extension sleeve 11
Extension sleeve length B
Anchor body internal taper 12
Jaw outer taper 13
Jaw spring clip 14
Jaw 15
Bearing area on the sleeve Fb
Gravity F g
Release opening 19
Arming opening 20
Snap ring 21
Opening in release member shaft 22
Offset in sleeve release and arming opening positions 23

Sleeve guide slot 24
Rod 100
Upper rod 101
Lower rod 102
Rod male spigot 103
Rod female spigot 104
Ductile failure region/mechanical fuse 105
Column 30
Column bore 32
Upper column 30*a*
Lower column 30*b*
Release tool holes in column 33
Arming tool hole in column 34
Spring pins 35
Radial tolerance $R_t$
Release tool 40
Tines 41
Angled tine endings 42
Release tool body 43
Hammer 50
Arming tool 60
Arming tool tine 61
Arming tool angled end 62
Rotation direction $F_z$
Alignment tool 70
Handle 71
Elongated member with a guide slot 72
Tongue 73
Bearing plate 80
Roll pin 81
Base plate 90
Ground bolt 91
Anchor pockets 92

Example 1

FIGS. 1 to 8 show the coupling assembly 1 and parts thereof absent of a coupled member (rod 100 hereafter) therein. The coupling assembly 1 embodiment shown in the Figures comprises an anchor, the anchor having a jaw assembly 6 with three jaws 15 in total in a circular shape held together using a spring clip 14. The jaws 15 are characterised by having an external taper 13 that interferes with movement of a rod 100 relative to the anchor jaws 15. The anchor further comprises a body 2 with an internal taper 12 complementary to, and abutting against, a jaw external taper 13.

The coupling assembly 1 also has an enclosing member (sleeve 7 hereafter), shown in the Figures as a sleeve 7 that fits over the anchor jaws 15 assembly and body 2. The sleeve 7 has a top cap 8 and a bottom cap 9 and an opening in both caps to allow passage of a rod 100 to the anchor. The anchor body 2 diameter is identical or very close to the sleeve 7 diameter with a relatively tight radial tolerance $R_t$ to ensure a snug fit and minimise relative movement between the anchor and sleeve 7.

A spring 5 may be used to pre-engage the anchor. The spring 5 as shown in the Figures is located at the base of the jaw assembly 6 so as to bias the jaw and body 2 tapers 12, 13 together and hence to a tension position urging the external taper 13 of the at least one jaw to abut the internal taper 12 of the body 2. The spring 5 as shown is located inside the sleeve 7, at one end abutting the base of the jaw assembly 6 and at the opposing end abutting the bottom cap 9 of the coupling assembly 1.

Figure 49:
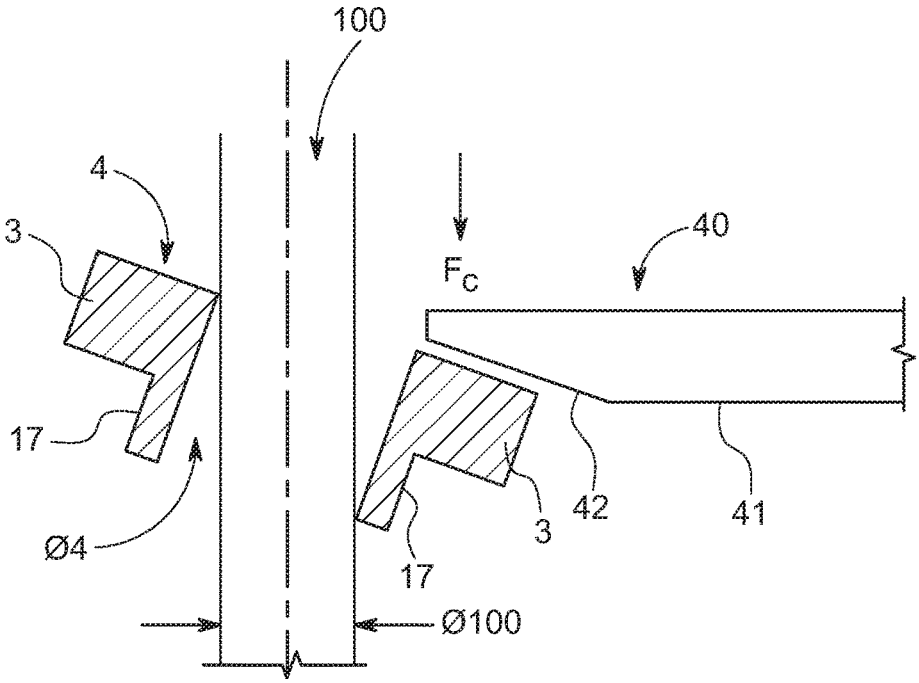
FIG. 49 illustrates a schematic side cross-section view of a quick release tool causing eccentric loading on the release member.
Figure 50:
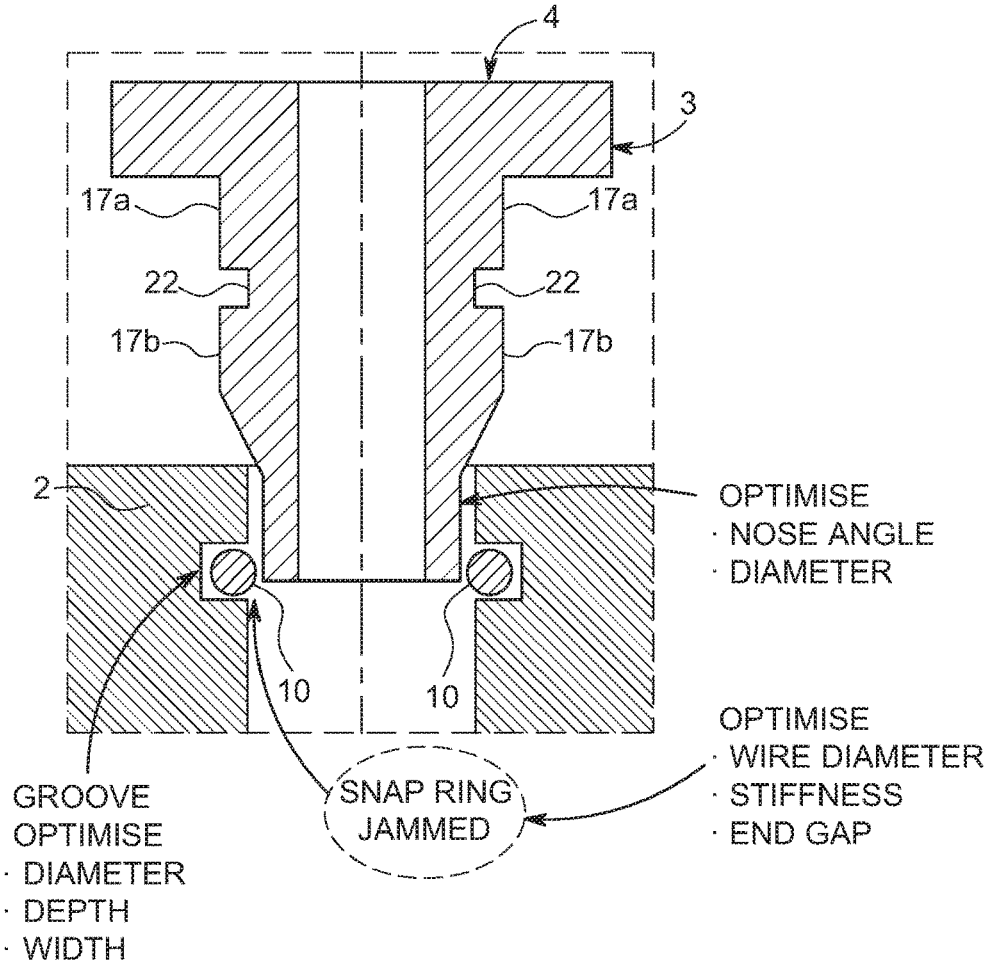
FIG. 50 illustrates a schematic side cross-section view of the release member and anchor body illustrating ways to address misalignment.

The coupling assembly 1 further comprises a release member 4. In the embodiment shown in the Figures, the release member 4 is located between the sleeve 7 top cap 8 and the anchor. The release member 4 comprises a collar 3 and a shaft 17. The collar 3 has a diameter similar to or matching the sleeve 7 internal diameter. The shaft 17 has a smaller diameter. The shaft 17 ends bears on the jaw assembly 6. The release member 4 is configured to be urged by a compression force Fc to move in a compression force Fc direction downwards to cause disengagement of the anchor jaws 15 from a first or jaw coupled position to a second jaw released position about distance C. As illustrated in FIGS. 49 and 50, the release member 4 collar 3 may be subjected to eccentric loading to force release member 4 movement and tight tolerances between the collar 3 and sleeve 7 may be important to avoid mis-alignment illustrated in FIGS. 49 and 50.

The release member 4 has a bore though the centre longitudinal axis to allow passage of rod 100 through the release member 4. The release member 4 bore size being a sliding fit to the coupled member. A relatively tight tolerance in fit between the coupled member and release member 4 bore may be important to avoid mis-alignment between the release member 4, enclosing member and coupled member, particularly when release is urged.

The release member 4 when urged to the second position is acting against the bias direction of the bias member. In this embodiment, the release member 4 may be releasably captured by the anchor in the second compression position. Capture in the embodiment shown is achieved by a mating snap ring 21 and opening 22 located between the release member 4 shaft 17 and the anchor body 2, the snap ring 21 and opening 22 engaging together when the release member 4 is in the second compression position.

This capture may be reversed and the release member 4 move back to a first position. Separate tools to achieve release member 4 movement are discussed further below.

As shown in FIG. 54, the release member 4 may in one embodiment have a particular shape, in this example comprising a lower shaft 17*b* portion and upper shaft 17*a* portion, the two portions including an angled step or shoulder 18 so that the diameter of the shaft 17 increases in the upper portion.

FIGS. 31 to 35 show a rod 100 connected to the coupling assembly 1. In operation, when a tensile force is imposed on the rod 100 attempting to draw the rod 100 from the coupling assembly 1, the tensile force causes the taper 13 of the jaw assembly 6 to bear against the anchor body 2 taper 12 in a first direction and, the tapers 12, 13 then causes a reaction force on the jaws 15 in a substantially perpendicular direction to the tensile force causing the jaws 15 to bear on the rod 100 and thereby halt relative movement between the rod 100 and the coupling assembly 1.

Opposite compressive movement may cause the anchor jaws 15 to disengage the anchor body 2 about the tapers 12, 13.

The rod 100 at one end which connects to the coupling assembly 1, has a smooth exterior while an opposing end of the rod 100 distant to the coupling assembly 1 may be threaded. The rod 100 diameter at the coupling assembly 1 has a diameter that corresponds to the jaw cross-section opening.

In some embodiments, opposing rods 101, 102 may be connected together via the coupling assembly 1. Rod 101 to rod 102 connection is described further below in the context of column 30*a* to column 30*b* connections. One aspect of this rod 101 to rod 102 design may be the use of a spigot ending to the rods 101, 102, one rod 101 end having a male 103 ending and the opposing rod 102 end having a female 104 end. On connection, the rod 101, 102 ends may align together using the spigot form.

Example 2

In this example, and with particular reference to FIGS. 9 to 16, 36 an embodiment is shown where a column 30 is coupled to a base plate 90 via the coupling assembly 1. In this embodiment, the column 30 comprises a coupling assembly 1 like that described above and a rod 100 therein, the rod 100 and coupling assembly 1 being located inside a bore 32 within the column 30. The rod 100 is coupled to the column 30 interior and to the coupling assembly 1. The coupling assembly 1 is attached to a base plate 90 in this example.

The rod 100 may be connected to the column 30 via a permanent and non-reversible connection such as by use of adhesive between the rod 100 and column 30; threading the coupled member into the column 30, and/or use of a fastener or fasteners to fix the rod 100 and column 30 together. One embodiment of connection using a fastener may be to use a barrel nut located inside the column 30 that the rod 100 threads into at one end. The barrel nut is located within a bore 32 in the column 30 and if a tension force Ft is applied, the barrel nut exterior bears on the column 30 bore 32 opening sides.

Figure 36:
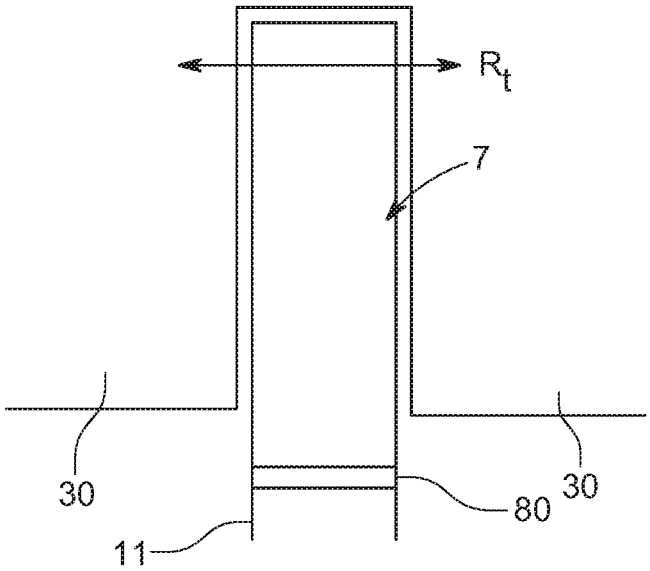
FIG. 36 illustrates schematic cross-section views (top and bottom) of the relationship between the coupling assembly enclosing member (sleeve) and a surrounding column.
Figure 36:
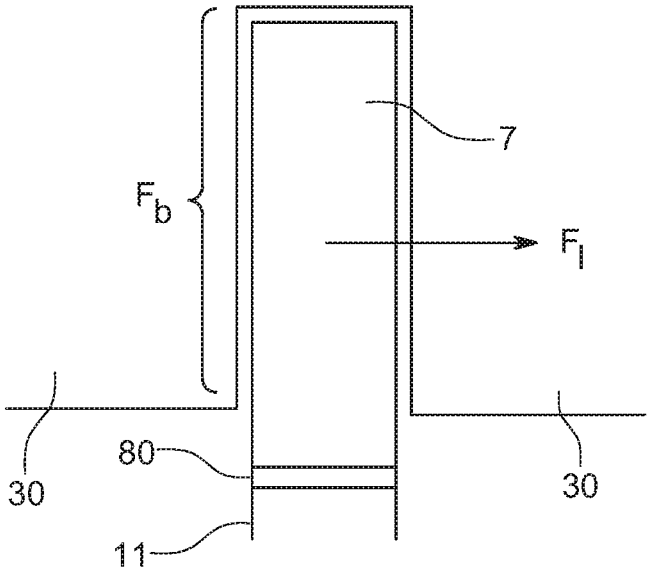
Figure 37:
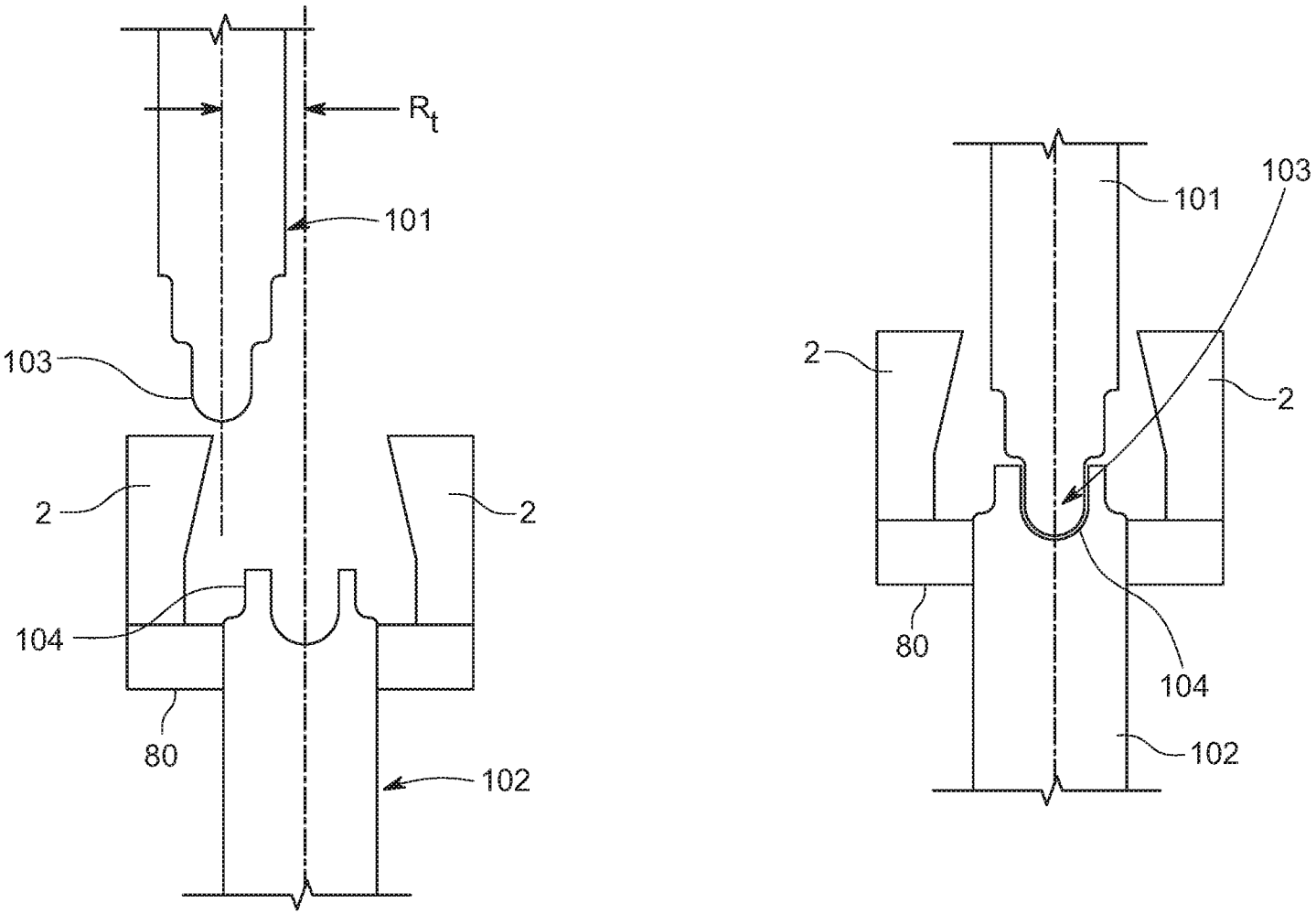
FIG. 37 illustrates schematic cross-section views (left and right) of the relationship between the coupling assembly and a further rod connected via the anchor body.
Figure 38:
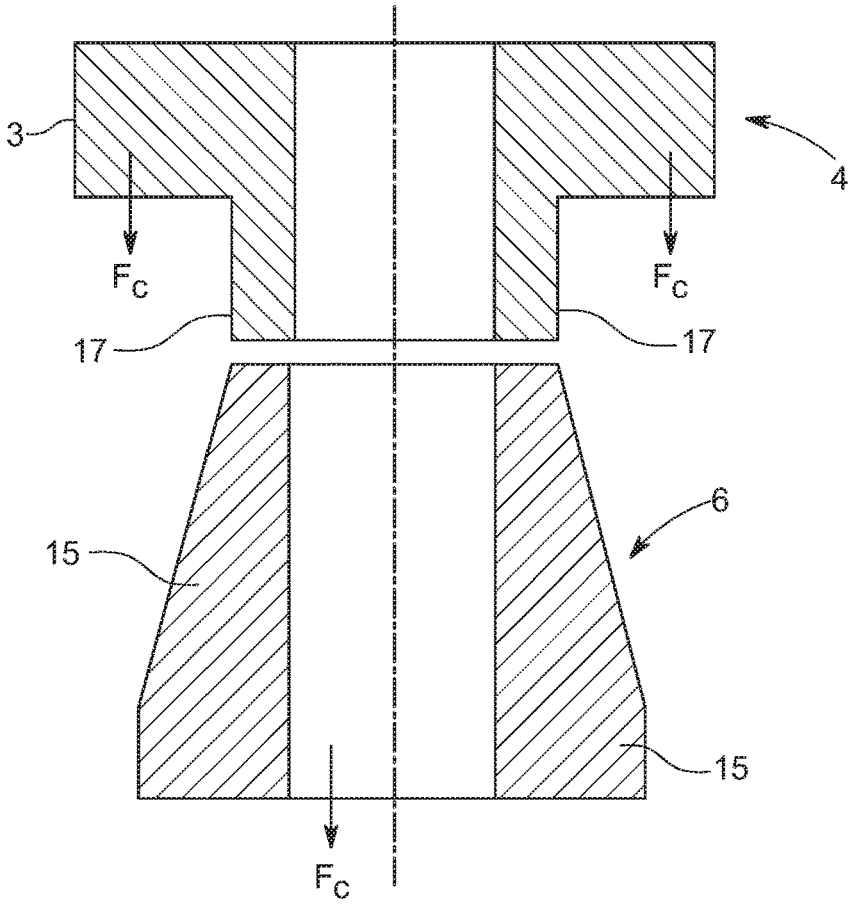
FIG. 38 illustrates a schematic cross-section view of the force relationship between the coupling assembly release member and jaw assembly during a disengagement action.
Figure 39:
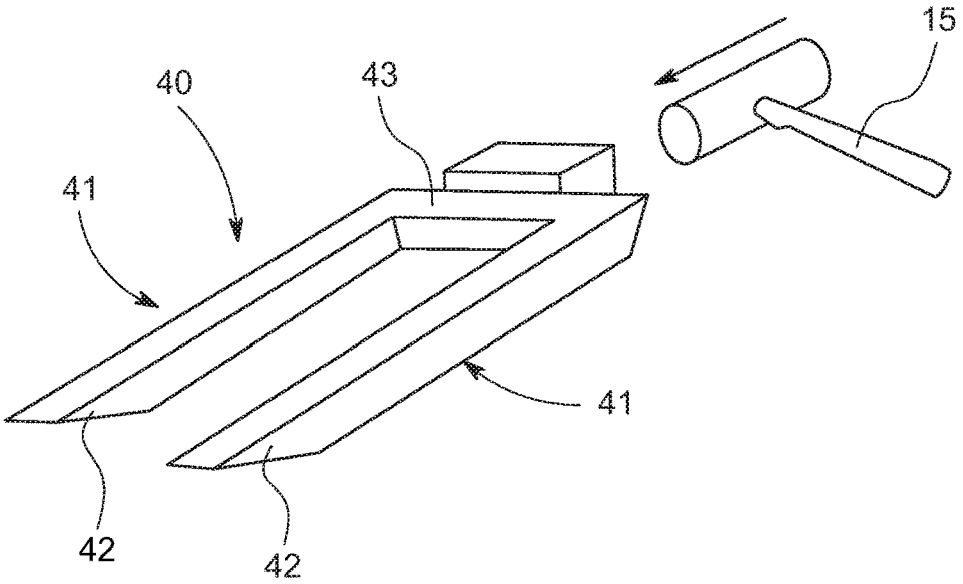
FIG. 39 illustrates a schematic perspective view of a quick release tool and hammer that may be used to cause disengagement of the coupling assembly.
Figure 40:
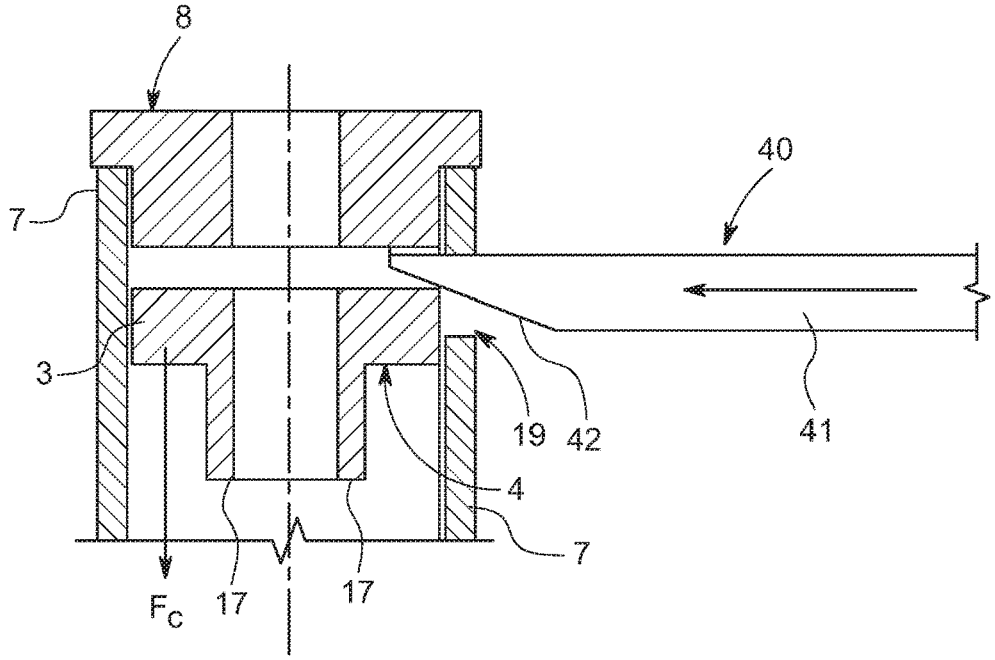
FIG. 40 illustrates a schematic cross-section view of a quick release tool beginning to be driven between the top cap and release member of the coupling assembly to cause disengagement.
Figure 41:
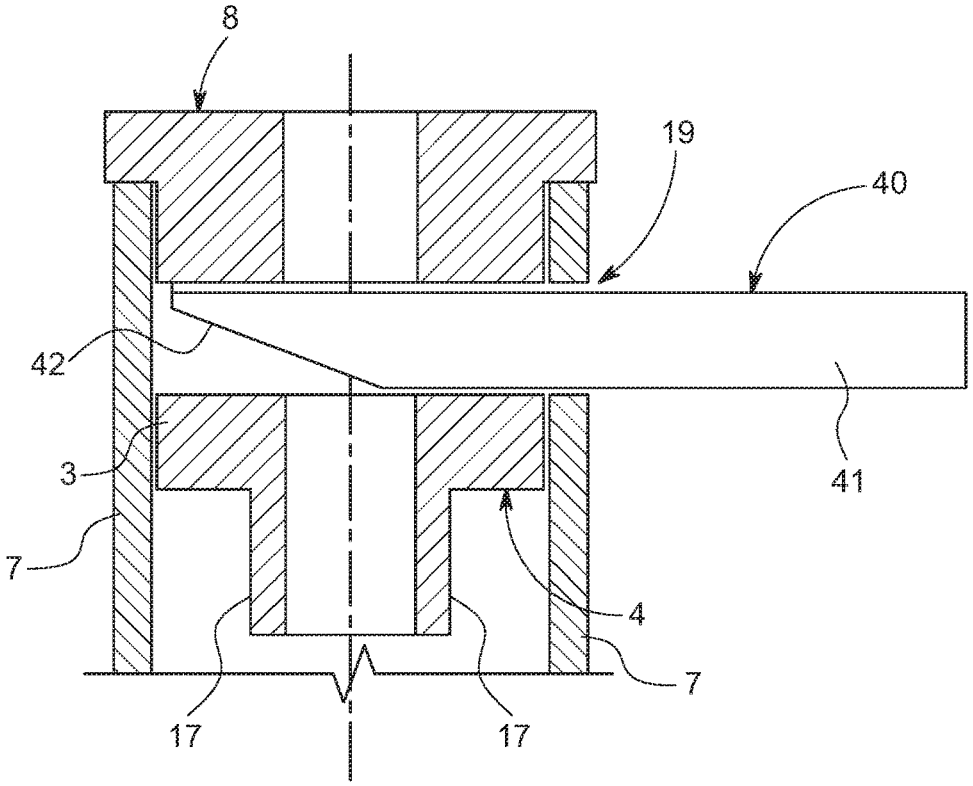
FIG. 41 illustrates a schematic cross-section view of a quick release tool fully driven between the top cap and release member of the coupling assembly, the release member moved relative to the top cap and the jaws urged to a disengaged position.
Figure 42:
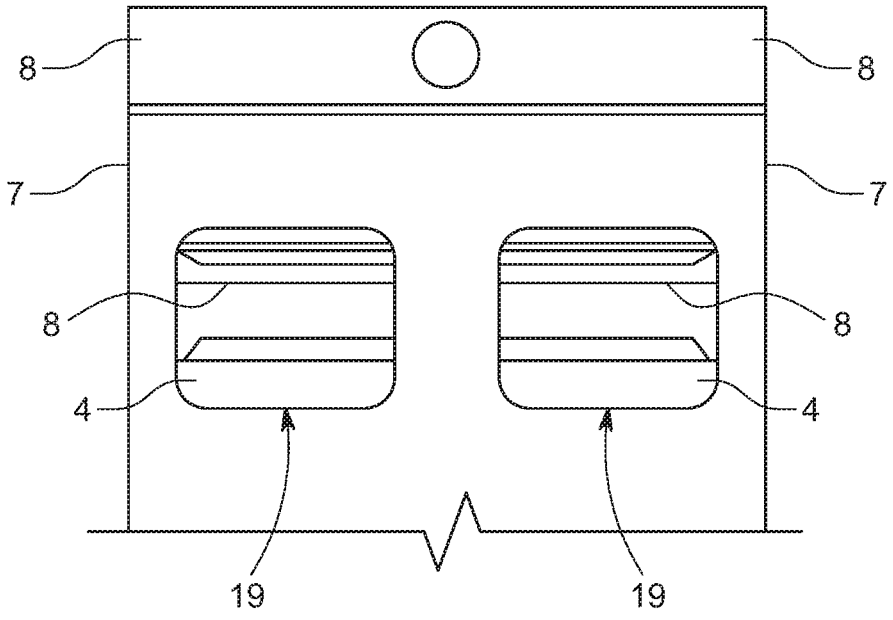
FIG. 42 illustrates detail front view of the enclosing member/sleeve exterior to show the quick release tool access holes in the sleeve.
Figure 43:
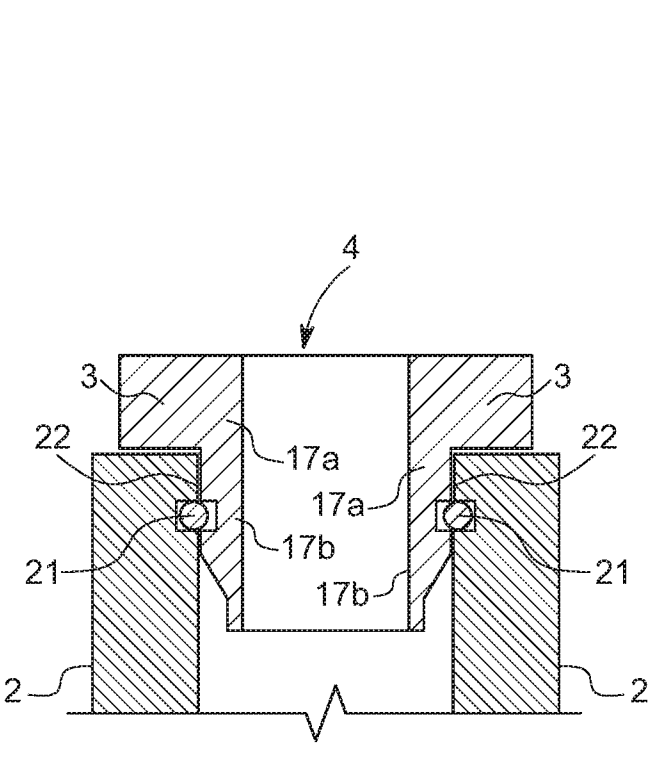
FIG. 43 illustrate detail front views of the anchor body and release member in an uncoupled position (left) and coupled position (right)
Figure 43:
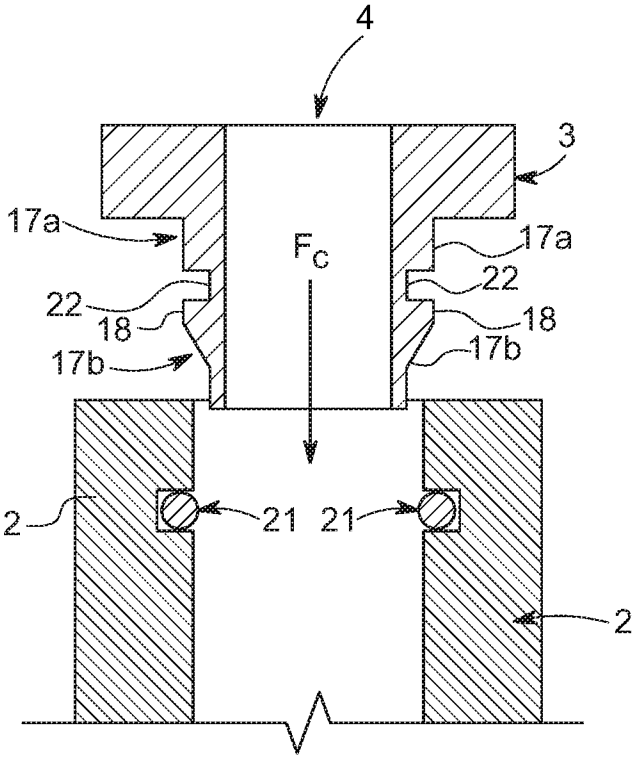
Figure 44:
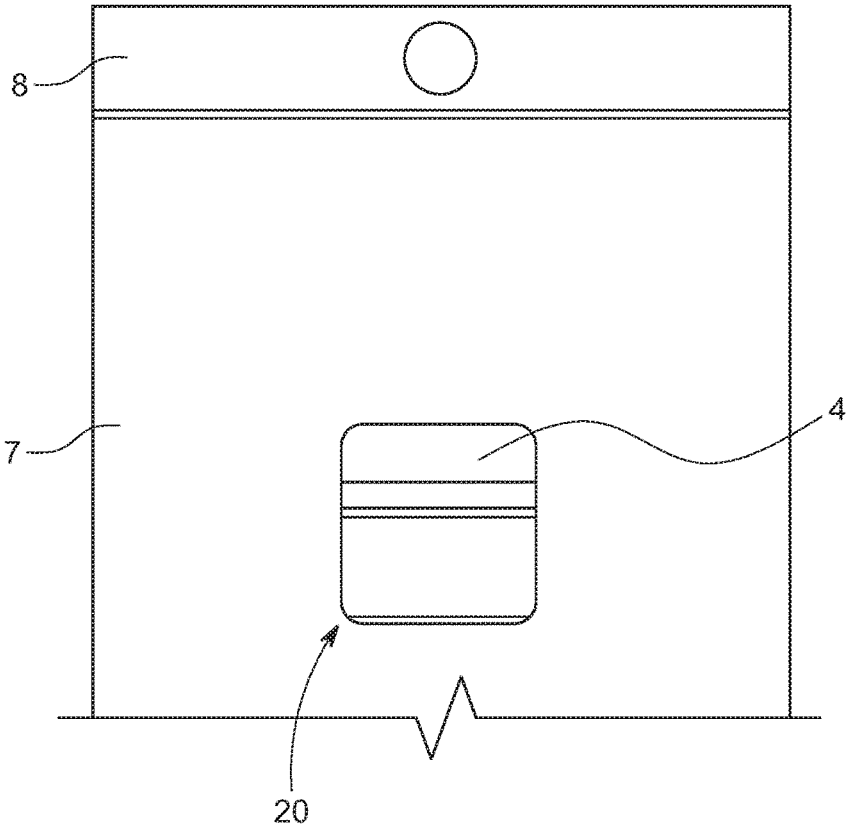
FIG. 44 illustrates a detail rear view of the enclosing member/sleeve exterior to show the re-engagement opening for tool access.
Figure 45:
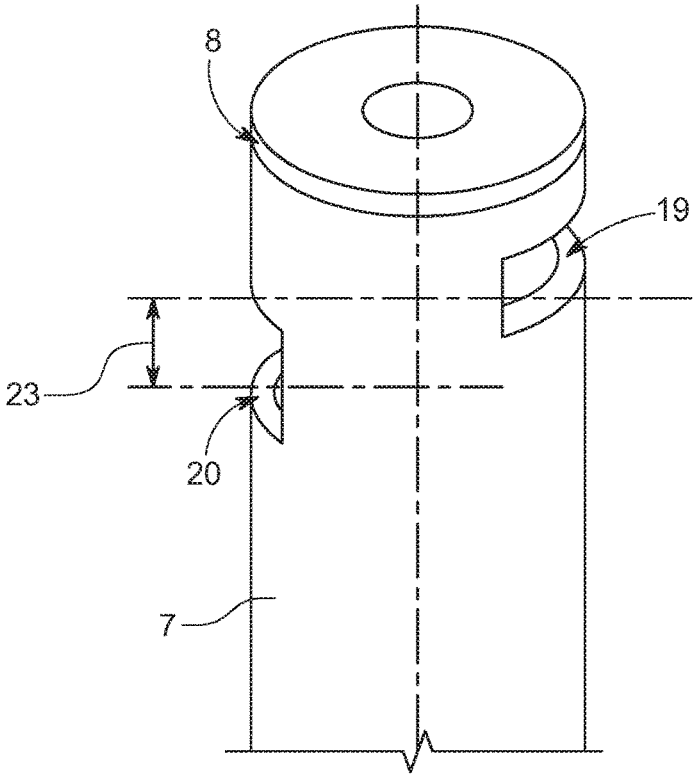
FIG. 45 illustrates a perspective side view of the enclosing member/sleeve exterior to show the relative positions of re-engagement opening and disengagement openings for tool access.
Figure 46:
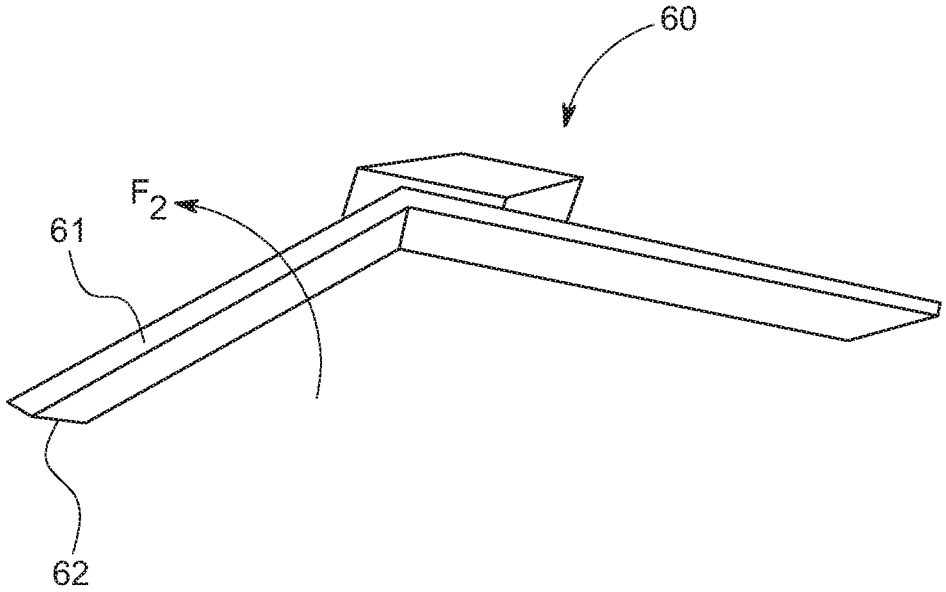
FIG. 46 illustrates a perspective view of an embodiment of an arming tool.
Figure 47:
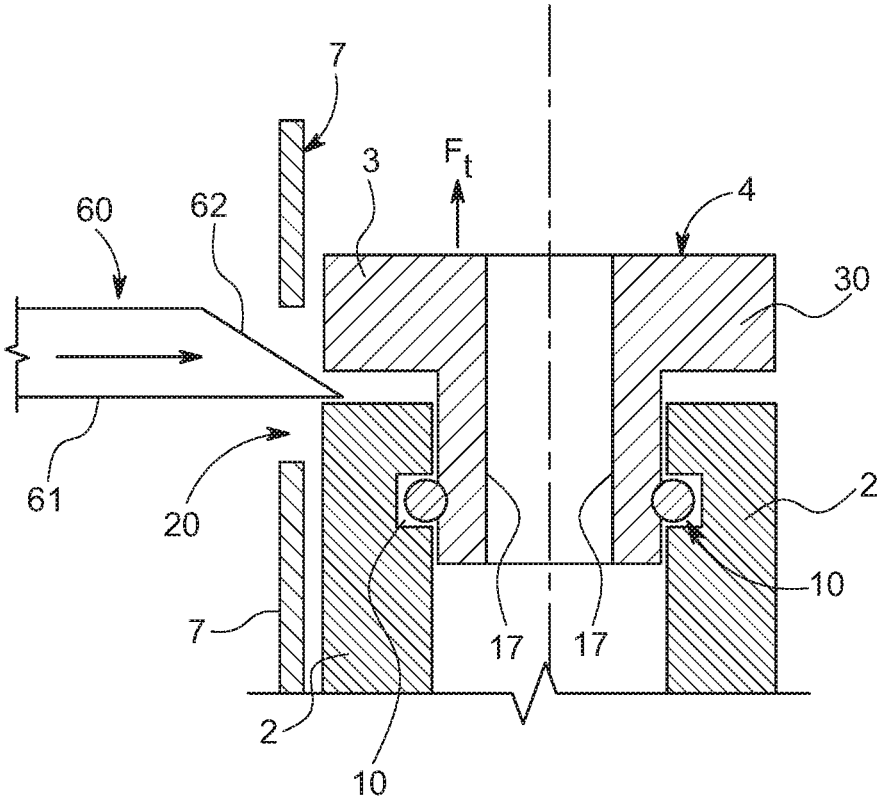
FIG. 47 illustrates a side cross-section view of the coupling assembly and arming tool, a tine of the arming tool partly inserted in to the re-engagement opening.
Figure 48:
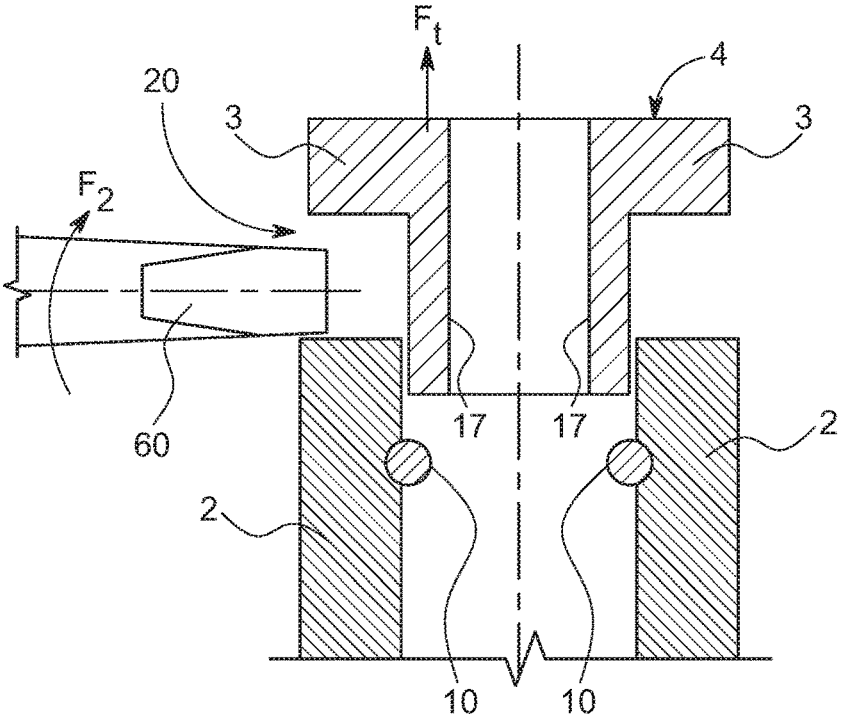
FIG. 48 illustrates shows a side cross-section view of the coupling assembly and arming tool, a tine of the arming tool fully inserted into the re-engagement opening and rotated to cause the release member to move free of the snap ring and groove alignment position and cause anchor re-engagement.

The coupling assembly 1 sleeve 7 in this example provides a bearing area Fb to transfer a lateral force $F_l$ imposed on the column 30 to a predominantly tensile force on the coupling assembly 1. This may be important in the event of a seismic event that causes both vertical plane movement and horizontal plane movement. FIG. 36 in particular illustrates the relationship between the anchor sleeve 7 and a surrounding column 30. In more detail, the coupling assembly 1 anchor is enclosed within a large diameter sleeve 7. For a column 30 splice connection an additional extension sleeve 11 may also be fitted (described further below) to increase the overall length of the sleeve 7/coupling assembly 1. The sleeve 7 (and extension sleeve 11 if used) have a close fit into matching bore 32 holes in the column(s) there are used in. The sleeve 7 and extension sleeve 11 length (A, B) is sized to provide sufficient projected bearing area $F_b$ to support lateral force $F_l$ stability requirements. For building column 30 connections, this lateral force $F_l$ demand is typically in the range 1-5% of gravity force $F_g$.

The coupling assembly 1 and rod 100 in this example are located almost entirely within a column 30 bore 32 and the rod 100 and coupling assembly 1 are centrally located within the column 30.

The coupling assembly 1 in this example is attached to a base plate 90 and the base plate 90 fixed to a substrate. The substrate may be a foundation, the ground, a concrete pad, a pile or piles and so on. The base plate 90 is located between column 30 base and a substrate and no gap may exist between the column 30 and base plate 90.

A bolt 91 is located beneath the base plate 90 that the coupling assembly 1 engages to permanently or semi-permanently connect the coupling assembly 1 and the base plate 90.

The base plate 90 has fastening openings and fasteners to allow the base plate 90 to be secured to a substrate.

The base plate 90 includes one or more locating members such as roll pin 81*s*.

The base plate 90 size corresponds to the size of the column 30 base.

Example 3

In this example and specifically referring to FIGS. 17 to 30 and 36 to 37, an embodiment is shown where two columns 30*a*, 30*b* are coupled together via the coupling assembly 1.

In this example a first column 30*a* is connected vertically to a second column 30*b*. The connection comprises a first rod 101 coupled to the first column 30*a* and a second rod 102 coupled to the second column 30*b* and intermediate the first and second columns 30*a*, 30*b* coupling the first and second rods 101, 102 is a coupling assembly 1 like that described above. Spring pins 35 may be used between the columns 30*a*, 30*b*.

The above illustrates how two or more columns 30*a*, 30*b* may be connected using the coupling assembly 1. Further columns (not shown) may be attached as to either the first or second column 30*a*, 30*b* described by use of further coupling assemblies and rods 100.

In this example, an extension sleeve 11 may be used. The extension sleeve 11 shown in the Figures mates with the coupling assembly 1 sleeve 7 including having a similar diameter and length as the coupling assembly 1 sleeve 7.

The extension sleeve 11 as shown is located in a bore 32 in the lower column opposite the bore 32 in the first column.

The extension sleeve 11 encloses part or all of the second rod 102, the second rod 102 extending longitudinally along the extension sleeve 11 longitudinal axis.

A bearing plate 80 may be located between columns 30*a*, 30*b*. The upper column 30*a* bottom and lower column 30*b* top may be located directly against the bearing plate 80 and any coupling assembly 1 or assemblies hidden within the columns and no gap may exist between the columns 30*a*, 30*b* and bearing plate 80. The bearing plate 80 may include one or more locating members such as roll pin 81*s*. The column 30 and base plate 80 may have an anchor pocket 92.

Example 4

In this example and with specific reference to FIGS. 31 to 35 more detail is provided on the way the coupling assembly 1 and a rod 100 interact.

A rod 100 is inserted into the coupling assembly 1 and between the jaws 15. The end of the rod 100 has a leading pilot diameter with a specific length to expand the jaw assembly 6 to match the largest rod 100 diameter and displace the compression spring 5 at the base of the coupling assembly 1.

When a tensile force Ft is applied, the jaw assembly 6 wedges into the internal taper 12 of the anchor body 2, locking the rod 100 in position.

The coupling assembly 1 has an added advantage that it can accommodate compression forces Fc without increasing tensile slip. For example, when the coupling assembly 1 is used in construction, a further compression force $F_c$ may be applied to a first or further column causing compression force $F_c$ direction movement about a lower coupling assembly 1. The coupling assembly 1 can take up this added compression force $F_c$ movement and this does not detract from the tensile strength of the coupling assembly 1.

The compression spring 5 as described above keeps the jaw assembly 6 taper 13 in contact with the body taper 12 in order to provide an initial activation of tensile force Ft capacity.

Example 5

This example further illustrates the release and arming aspects of the coupling assembly 1 with reference to various Figures but in particular, FIGS. 38 to 50 and 54.

One method of releasing a rod 100 from a coupling assembly 1 described above comprises depressing the release member 4 collar 3 to move it from a first position to a second position that pushes the anchor jaws 15 down and into a compression force $F_c$ direction against the bias member bias force.

The release member 4 collar 3 can be depressed using a release tool 40 that, when inserted between the release member 4 collar 3 and top cap 8 of the sleeve 7, pushes the wedge jaws 15 down, releasing the tensile connection of the rod 100. Insertion of the release tool 40 may be urged using a hammer 50. The release tool 40 may access the collar 3 and cap opening by inserting the release tool 40 tine or tines 41 through access holes in the sleeve 7. The top cap 8 acts as a reaction for the lever action of the release tool 40. Various forms of release collar 3 and release tool 40 are possible such as a taper fork, lever, piston, cam, helix, thread and clamp.

As noted above, the release member 4 may be captured in a second position.

In one embodiment, the release tool 40 may comprise two tines 41 that interfere with the release member 4 and causes urging of the release member 4 to the second compression position. Each release tool 40 tine comprises an angled ending 42 so that so that as the tine 41 inserts between the sleeve 7 and release member 4 collar 3, the size of the tine 41 ending 42 increases and in doing so, increases the gap between the sleeve 7 top cap 8 and release member 4 collar 3 top, urging the release member 4 to the second compression position. The release tool 40 as shown has two parallel tines 41 with a spacing between the tines 41, the two tines 41 linked by a release tool 40 body.

The release openings 19 in the embodiments shown are located proximate an interface between the release member 4 and the sleeve 7 top cap 8 being towards the top of the sleeve 7 to expose the interface between the top cap 8 and release member 4 collar 3.

The release opening(s) 19 are sufficiently long so that the release opening 19 length matches the extent of movement of the release member 4 between the first and second positions. The release opening(s) 19 are sufficiently wide to accommodate the release tool 40 tine described above.

The release openings 19 may in term correspond to opening 33 in the column if a column is present so as to allow the tines 41 of the release tool 40 to pass through the column 30 and to the coupling assembly 1.

FIGS. 44 to 48 show how the anchor coupling may be re-armed post disengagement. Inserting an arming tool 60 through an opening in the sleeve 7 may be completed to arm the coupling assembly 1 again. In this case, the arming tool 60 urges upward movement of the release member 4 away from the anchor jaw assembly 6 and towards the top cap 8 again. The anchor body 2 in this case may act as a reaction for the lever action of the arming tool 60. Once the arming tool 60 levers the release member 4 from the captured second position, the release member 4 may move to the first position via the bias force of the bias member.

The arming tool 60 may like the release tool 40 have a tine or tines 61 and the tine or tines 61 may have an angled ending 62 to urge part separation. The arming tool 60 may in this example by rotated in direction $F_z$ so as to urge an upwards force on the release member 4 collar 3 relative to the arming opening 20 base.

The arming opening 20 in the sleeve 7 may be sized like the release opening 19 to allow access for the tool to the interface between the anchor body 2 and release member 4 collar 3 and have a length commensurate with the extent of movement of the release member 4 between the first and second positions. The arming opening 20 may be offset by distance 23 in a vertical plane relative to the release opening (s) 19, this offset 23 coordinated with the relative positions of the release member 4.

The arming opening 20 in the sleeve 7 may also be located as to correspond to a similar sized opening 34 through the column 30 assuming a column 30 is present to allow arming tool 60 access from outside the column 30.

A guide opening 24 may also be included in the sleeve 7 that interfaces with an alignment tool 70 described further below.

While in the above description separate tools have been described, it may be appreciated that the same tool may be used for both release and arming. A single tool for both actions may comprise a tine and an angled tine end.

Example 6

Figure 51:
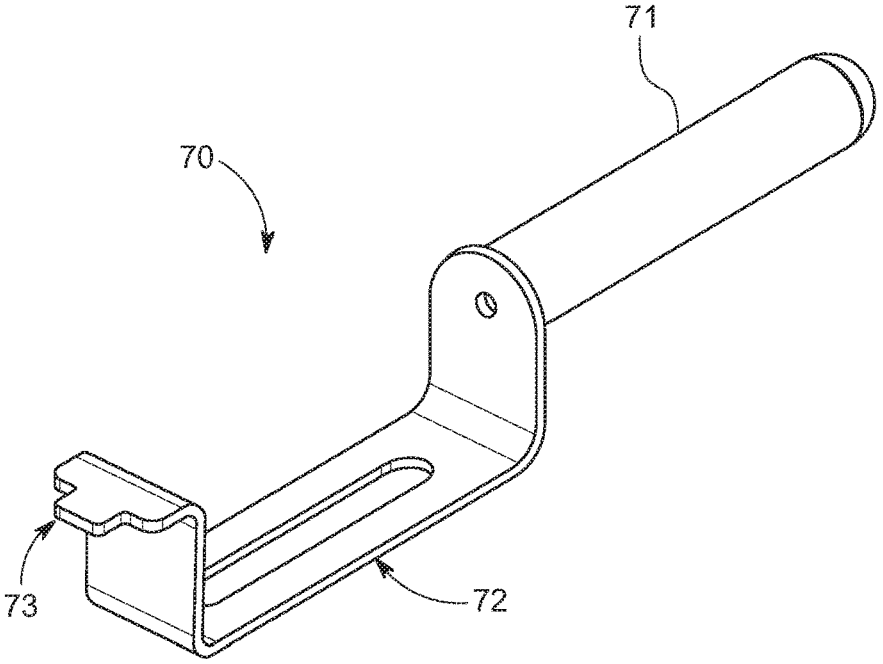
FIG. 51 illustrates a perspective view of an embodiment of an alignment tool.
Figure 52:
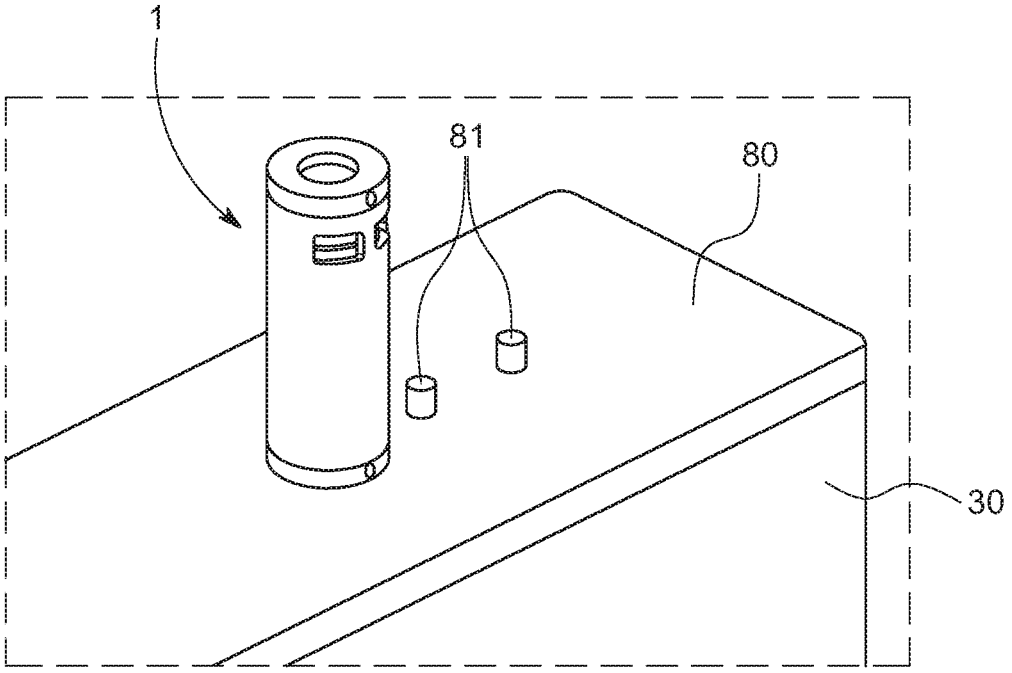
FIG. 52 illustrates two schematic perspective views of a base plate or bearing plate comprising roll pins (top) and the relationship of the plate and roll pins with the alignment tool (bottom)
Figure 52:
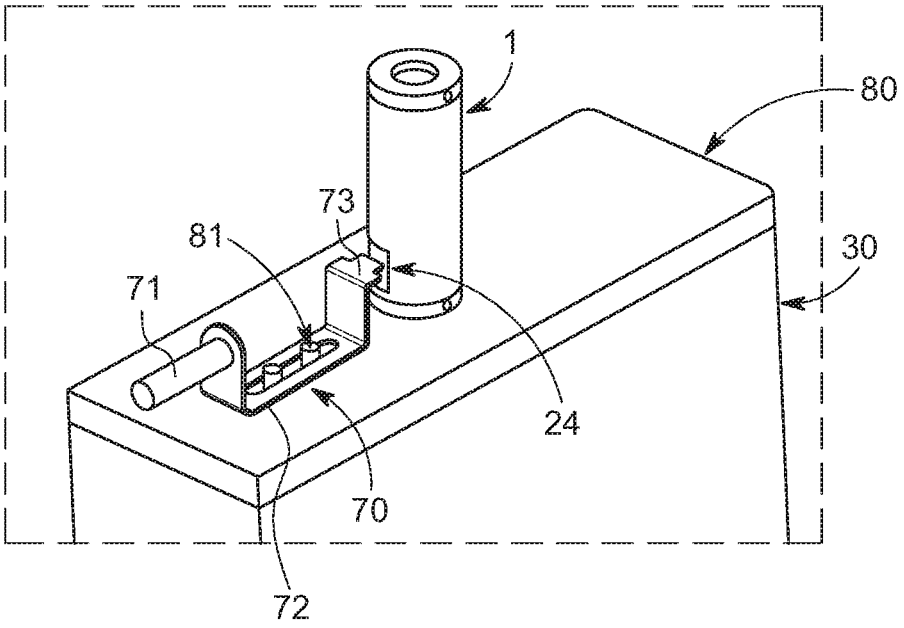

In this example and referring to FIGS. 51 and 52 an alignment tool 70 is described to ensure correction rotational alignment. The alignment tool 70 is used to set and check the correct rotational position of the connector around its vertical axis. This ensure that the tool release openings 19 and arming opening will align with the sleeve 7 cut-outs.

The alignment tool 70 may comprise a tongue 73 configured to extend through an alignment opening 24 in the sleeve 7 and, connected to the tongue 73 is an elongated member 72 with a guide slot, the guide slot elongated in a longitudinal direction to mate with roll pins 81 on a bearing plate 80 or base plate 90 and therefore restrict movement of the tongue 73 towards or away from a side of the coupling assembly 1 but not from side to side. The alignment tool 70 further comprises a handle 71 extending from the elongated member 72. The alignment tool 70 has a U-shape cross-section, the lower part of the U-shape corresponding to the elongated member 72 and the tongue 73 and handle 71 raised relative to the elongated member 72.

Example 7

Figure 53:
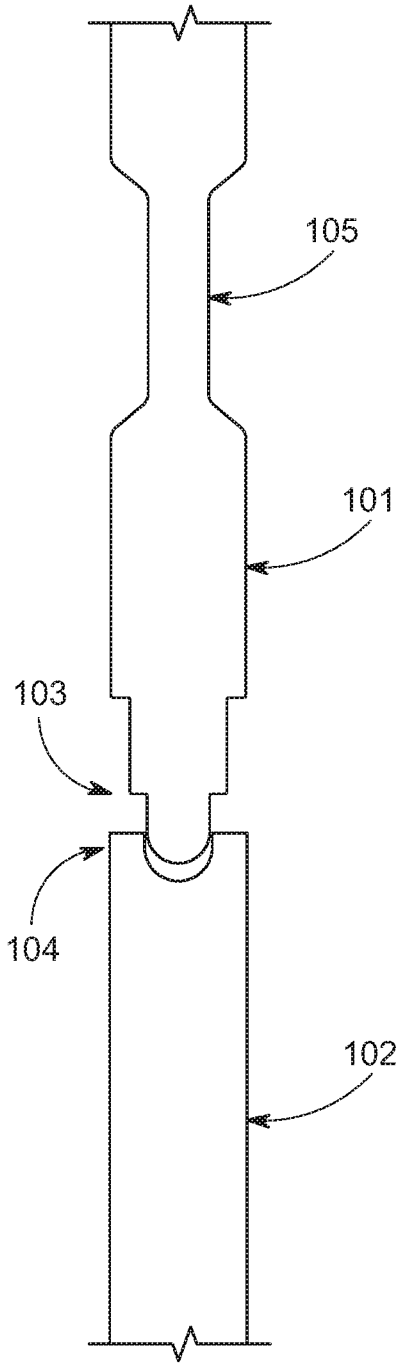
FIG. 53 illustrates a schematic front view of two rods and a mechanical fuse.

In this example and specifically referring to FIG. 53 an example is illustrated of a way to design in a safe ductile failure mode.

Most structural design regulations for seismic and other sudden events (e.g. collapse due to explosion) require that connections demonstrate a safe ductile failure mode.

As shown in FIG. 53, the rod 100 used may comprise a mechanical fuse 105 where the diameter of the rod 100 is reduced locally to guarantee ductile failure of the rod 100 within a predetermined range, preventing brittle failure of any other components.

Other components in the connections could also be designed as the mechanical fuse 105. For example, a specific low strength steel could be specified for the rod 100 in place of a geometric mechanical fuse 105.

Example 8

In this example and examples 9 and 10 below, FIGS. 55 to 74 are referred to and an alternative embodiment of the coupling assembly is described with reference to the following parts and their item numbers as below:

Coupling assembly 501
Anchor body 502
Anchor base 510
Release member 504

Figure 55:
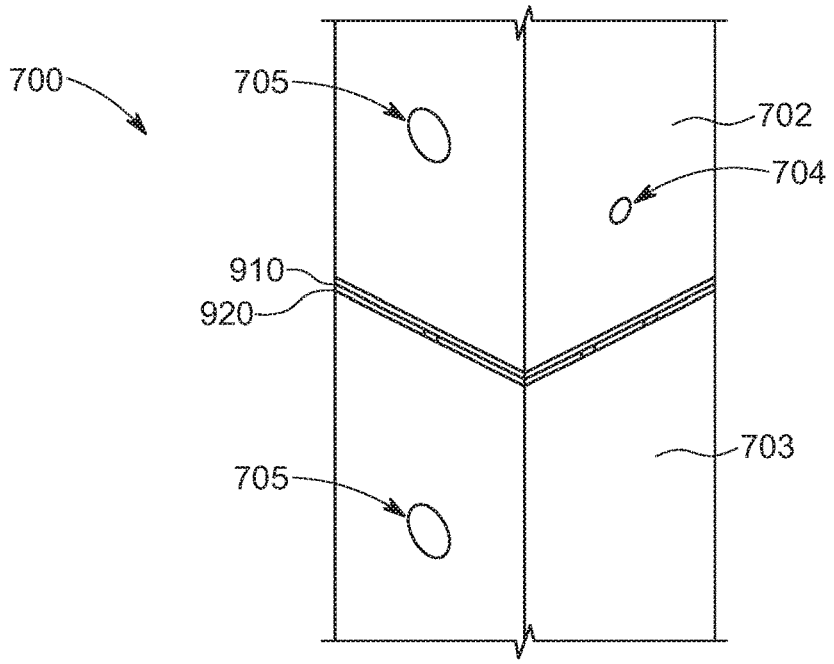
FIG. 55 illustrates a perspective view of two columns coupled to together using an alternative embodiment of coupling.
Figure 56:
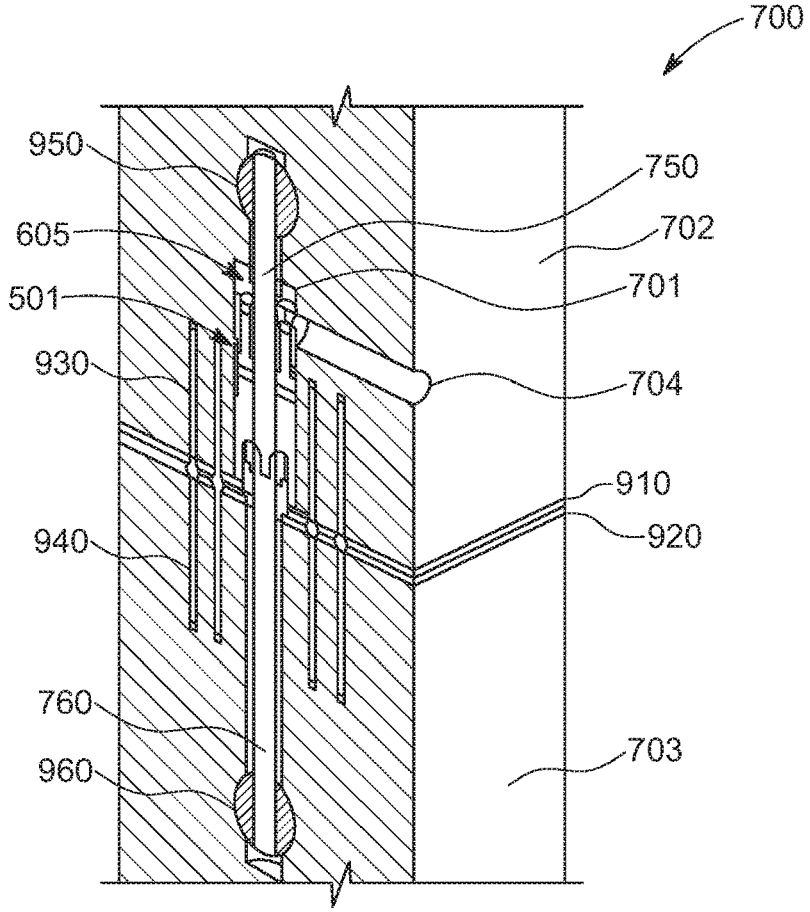
FIG. 56 illustrates a section perspective view of the above alternative coupling.
Figure 57:
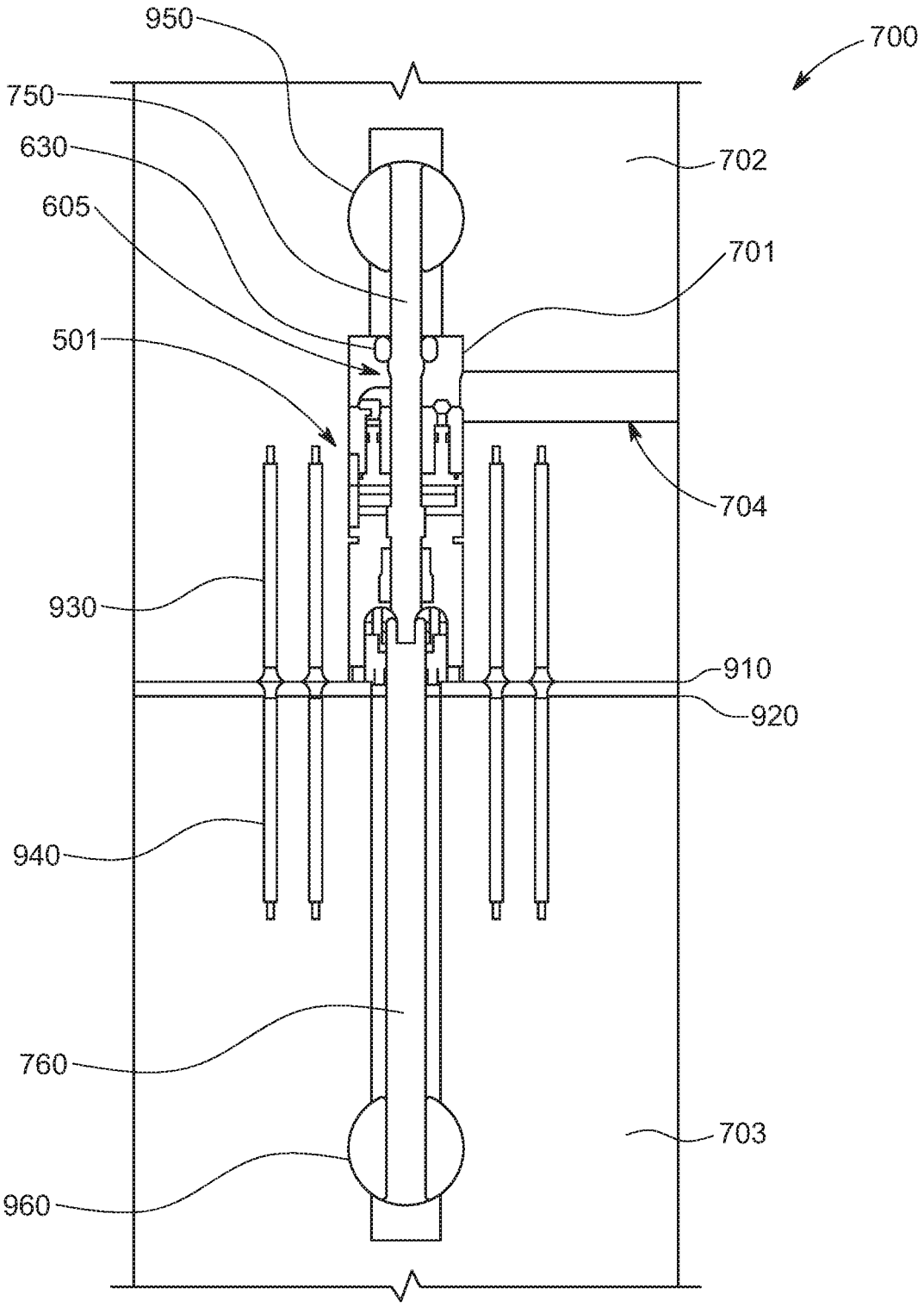
FIG. 57 illustrates a section front elevation of the above alternative coupling.
Figure 58:
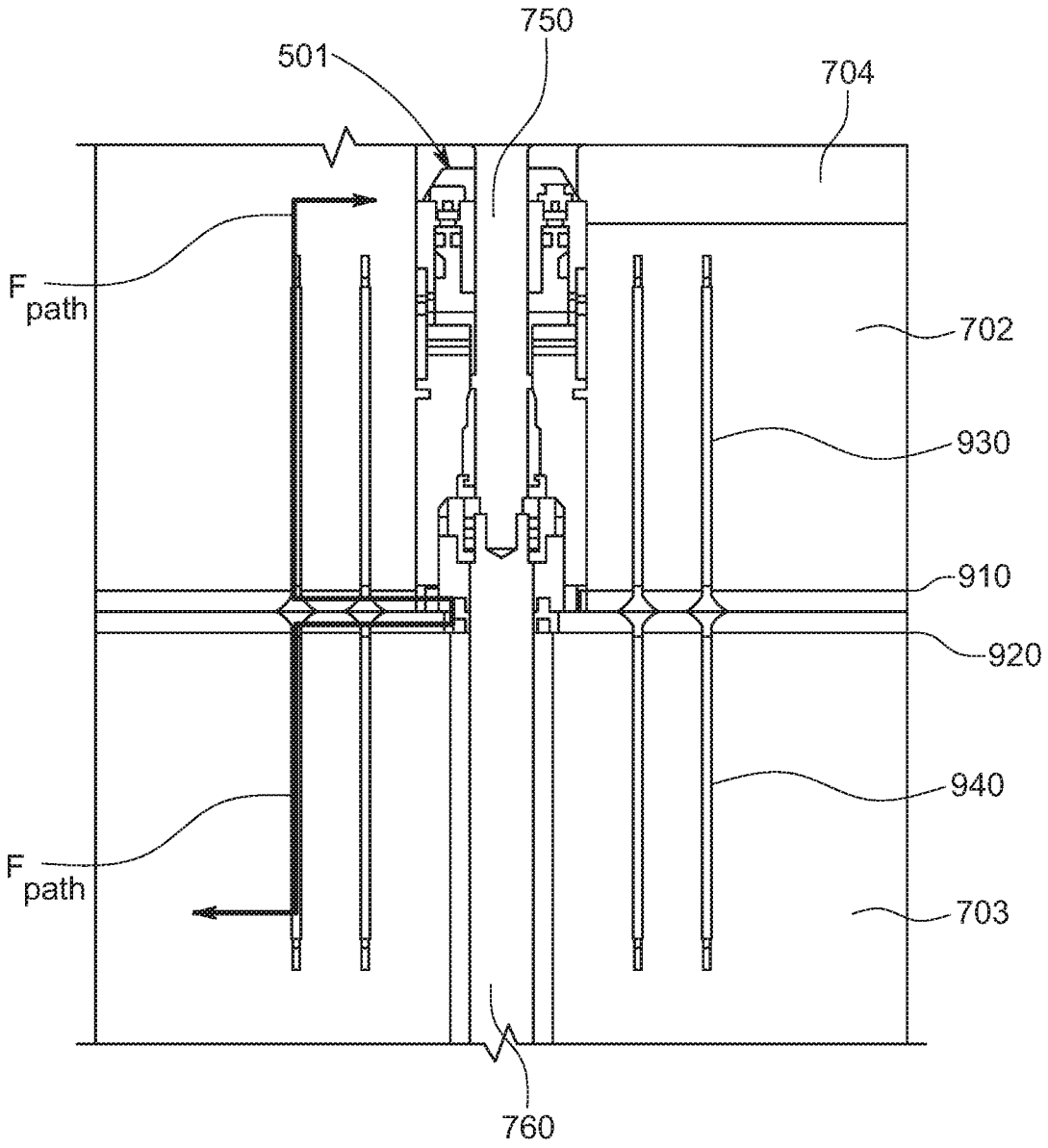
FIG. 58 illustrates the above section front elevation and a load path that occurs in the event of an over turning force being imposed on the column(s)
Figure 59:
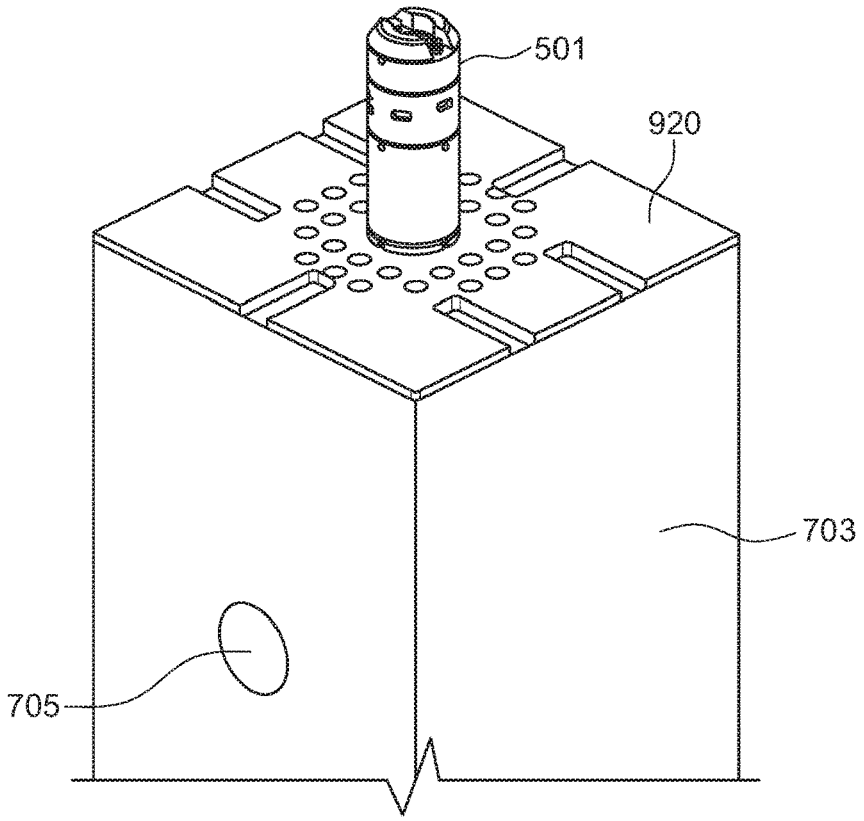
FIG. 59 illustrates a perspective view of a lower column assembly.
Figure 60:
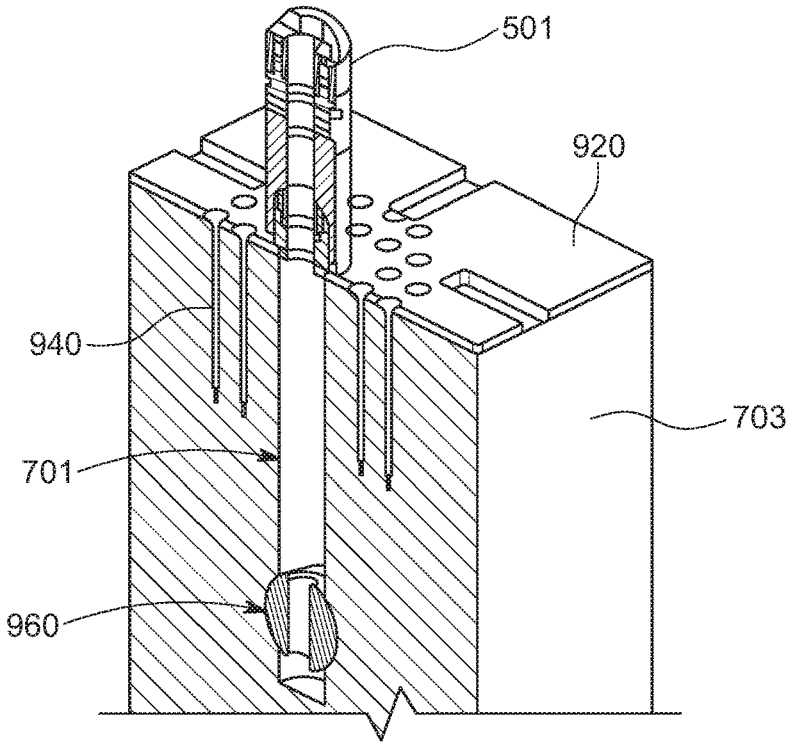
FIG. 60 illustrates a section perspective view of a lower column assembly.
Figure 61:
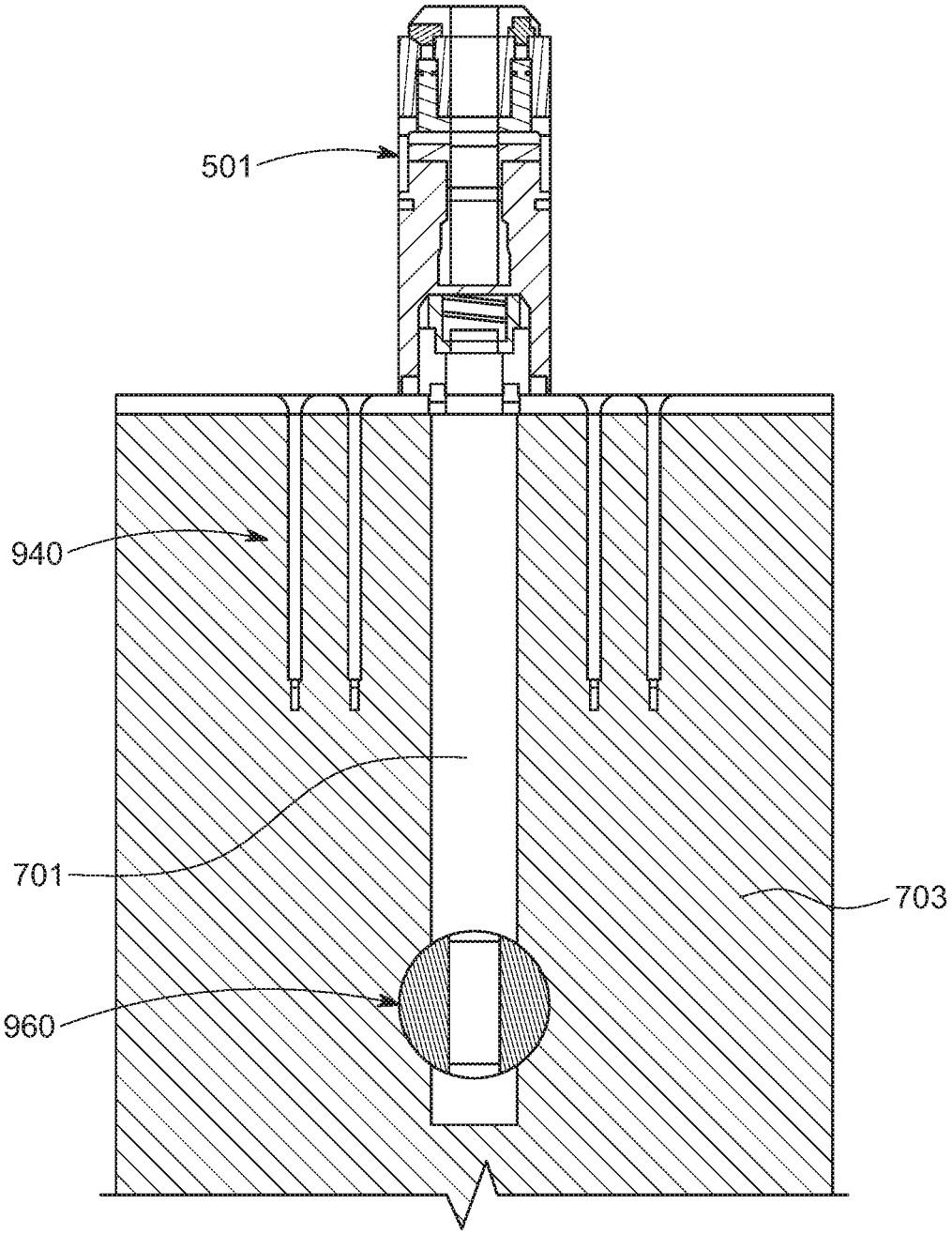
FIG. 61 illustrates a section front elevation view of a lower column assembly.
Figure 62:
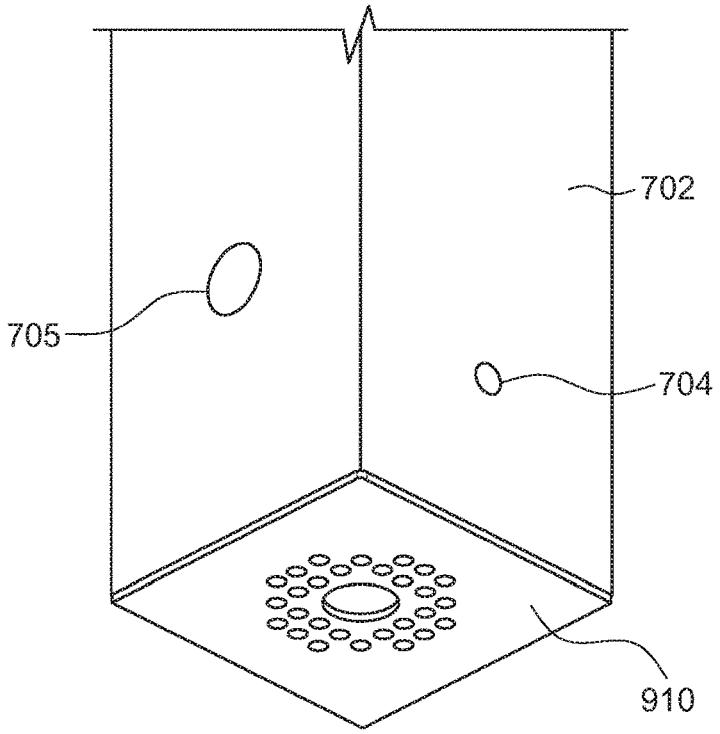
FIG. 62 illustrates a perspective view of an upper column assembly.
Figure 63:
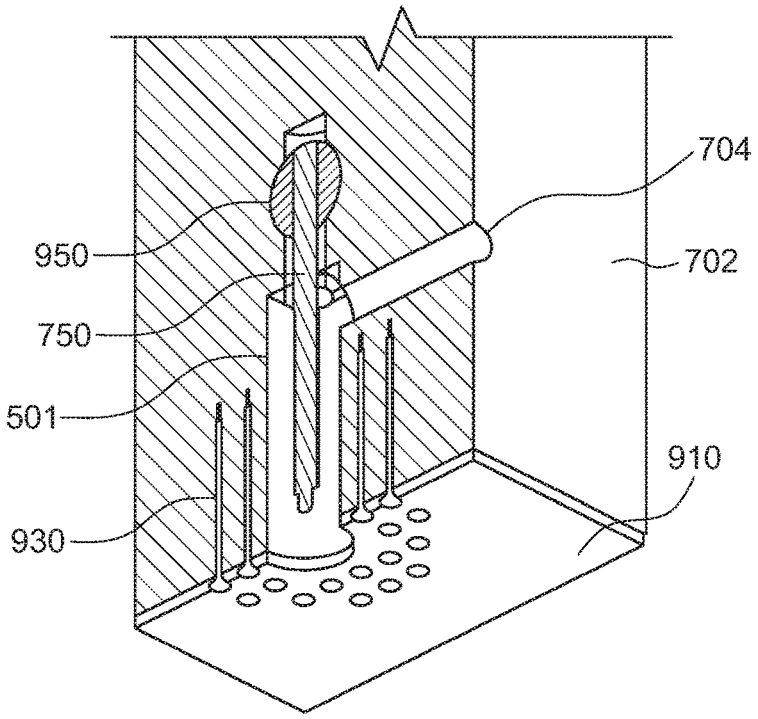
FIG. 63 illustrates a section perspective view of an upper column assembly.
Figure 64:
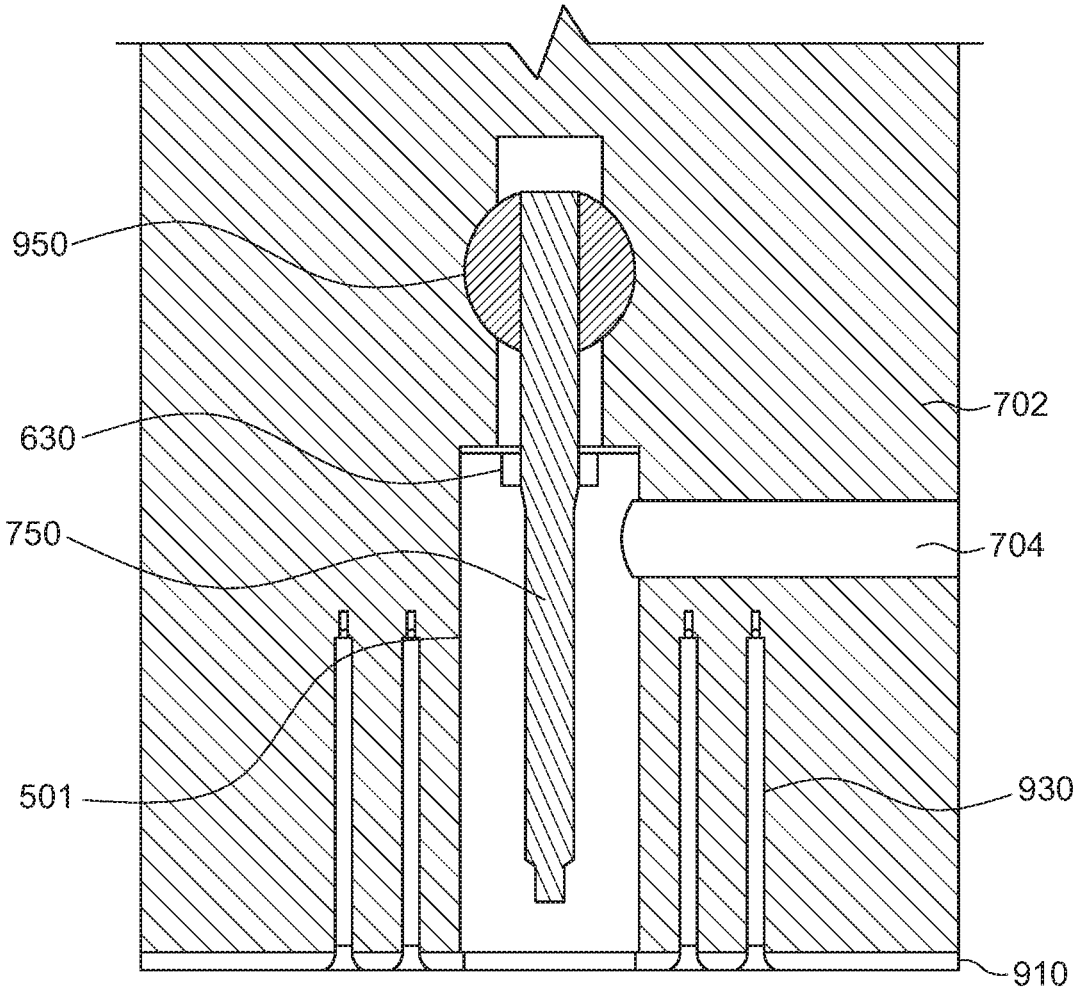
FIG. 64 illustrates a section front elevation view of an upper column assembly.

Release member collar 503
Release member shaft 517
Bias member/compression spring 515
Enclosing member/sleeve 507
Jaw travel limiter 511
Coupling assembly base 512
Bearing ring 513
O-ring 518
Top cap 508
Arming opening in sleeve 520
Piston 505
Non-return grease nipple 506
Cone 550
Lock nut 514
Hydraulic plug/bleed screw 509
Jaws 516
Hydraulic cavity 530*a* (empty), 530*b* (full)
Tension nut 630
Ductile failure fuse 605
Reduced diameter necked area 610
Normal diameter region 620
Column 700
Column bore 701
Upper column 702
Lower column 703
Hydraulic access hole in column 704
Barrel nut access hole in column 705
Upper rod 750
Lower rod 760
Hook 800
Manual release for the hook 810
Top plate 910
Bottom plate 920
Top plate to column screws 930
Bottom plate to column screws 940
Upper barrel nut 950
Lower barrel nut 960
Charring zone 970
Building floor panel 980
Art coupling rod ZZ FIGS. 55 to 57 show this alternative embodiment with two columns 702, 703 coupled together as they would be in-situ in a building (not shown). FIG. 55 shows the assembly un-sectioned while FIG. 56 shows the columns 702,703 sectioned in perspective and a front view to show internal details. FIG. 58 illustrates the mode of transfer of an over-turning force load through the columns 702, 703. FIGS. 59 to 61 show the lower column 703 part assembled and sectioned perspective and front elevation views in a part assembled manner as might be delivered to a build site. FIGS. 62 to 64 show the upper column 702 part assembled and sectioned perspective and front elevation views in a part assembled manner as might be delivered to a build site.

More detail on the coupling assembly 501 itself is provided in detail views shown in FIGS. 65 to 73. The coupling assembly 501 in this example comprise similar details to the earlier examples including an anchor body 502, anchor base 510, coupling assembly base 512, top cap 508 and release member 504, the release member 504 having a collar 503 and shaft 517. A bias member in the form of a compression spring 515 is also used that urges the coupling assembly 501 jaws 516 to an 'armed' position where the jaws 516 bite on a rod 750, 760 located inside the coupling assembly 501. The coupling assembly 501 also comprises a sleeve 507.

Figure 70A:
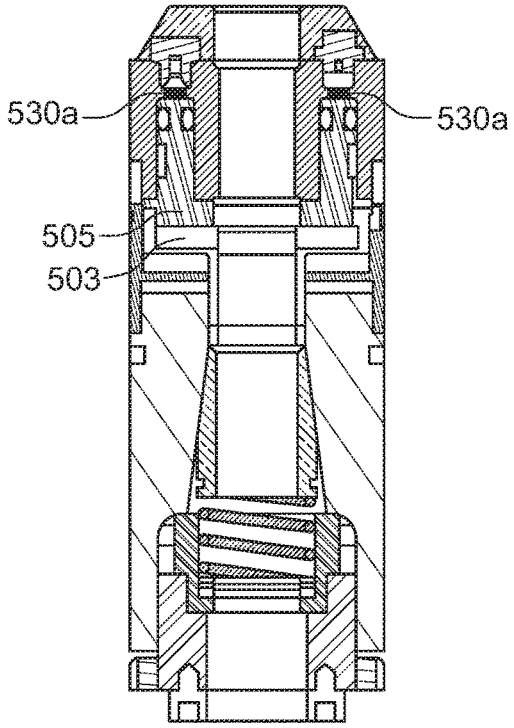
FIG. 70 illustrates a section front elevation view of the coupling assembly in an armed position (70A top) and a release position (70A bottom)
Figure 70B:
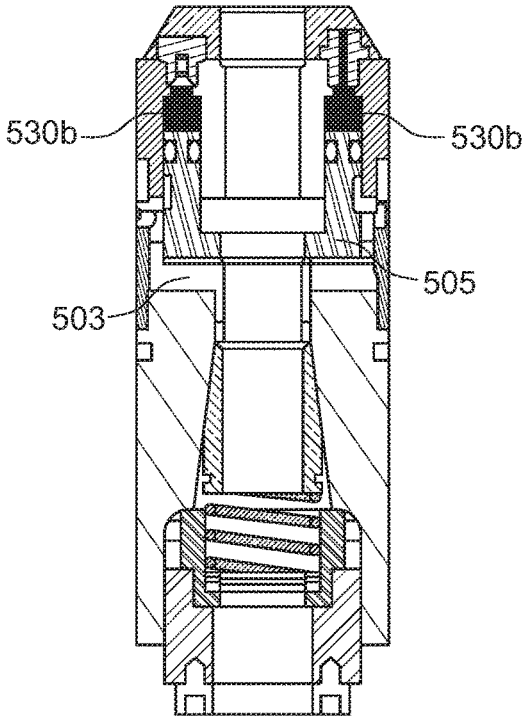

The release member 504 collar 503 in this example may be urged against the bias of the spring 515 by use of hydraulic fluid that enters a hydraulic cavity 530*a*, 530*b* (best seen in FIG. 70). The hydraulic fluid forces piston 505 to move the release member 504 against the urging force of the compression spring 515 and in doing so, the release member 504 shaft 517 forces the jaws 516 from an armed position to a release position, the extent of jaw 516 movement defined by the jaw travel limiter 511 being a shoulder that stops further movement. This use of hydraulic fluid may either remove the use of a mechanical release mechanism such as that described in earlier examples or may be used in conjunction with a mechanical release mechanism described in earlier examples. Dual hydraulic fluid and mechanical release may be useful to decrease the force needed to cause coupling release.

The hydraulic fluid shown as dark region 530*a* and 530*b* in FIG. 70 used to drive piston 505 movement may be an incompressible oil or grease. The oil or grease may be pressurised using a manual dispenser (e.g. grease gun), hand pump, electric pump or similar (not shown). Pressurising may occur via an access hole 704 in the upper column 702. Only a single and small access hole 704 may be needed such as that shown in FIGS. 55-57.

Hydraulic pressure acts on a piston 505, which is housed and sealed by O-rings 518 (or other seals) into the top cap 508. An external bearing ring 513 may be located on the piston 505 exterior to smooth movement relative to the sleeve 507.

Unlike the earlier embodiment, the piston 505 may be held in the extended release position by retaining hydraulic fluid in the chamber 530*b*. There is no need in this hydraulic embodiment to include a mechanical latch such as a snap-ring 21 described in earlier embodiments.

The fill point for hydraulic fluid may be a non-return device 506 (such as a grease nipple or similar) located on the top cap 508 of the coupling assembly 501. The top cap 508 may also comprise a bleed screw or hydraulic plug 509 that may be used to remove hydraulic fluid/hydraulic pressure from the coupling assembly 501. Opening of the screw may release pressure and surplus grease from the top cap 508. As hydraulic pressure is released, the spring 515 bias returns the jaws 516 to an armed position.

The bleed screw 509 size and shape may be selected to optimise the reset speed and piston 505 movement speed. Excess hydraulic fluid from the bleed screw 509 can be captured in a specially-designed cavity (not shown), or wiped away.

As may be noted from at least FIGS. 55 to 57, the coupling assembly 501 does not use an extension sleeve for a lower rod 760 and lower column 703. Instead, this alternative embodiment of coupling assembly 501 uses top and bottom plates 910, 920 that are fastened to either end of the columns 702, 703 and butted together (uncoupled) about the column 702, 703 ends. The coupling assembly 501 acts to centre the unconnected top and bottom plates 910, 920 and aligns the upper and lower columns 702, 703 together. In this embodiment, the load path from an overturning force differs to the earlier embodiments. FIG. 58 shows how the load path (dark line/arrow) runs from an upper column 702, to an upper screw 930, to the top plate 910, to the coupling assembly 501 to the bottom plate 920, to the bottom screw 940 and out to the lower column 703. The force load path may be via the opposite path to the above described path as well and via multiple screws (upper and lower) 930, 940. The inventors have found that this load path appears to give up to 10 times more resistance to an overturning force than earlier embodiments which may be useful in selected embodiments.

In this further embodiment, the coupling assembly 501 may further comprise pre-tensioning elements that act to tension a rod or rods 750, 760 against a column or columns 702, 703 prior to an over-turning force being applied. Pre-tensioning minimises any slack in movement prior to the coupling assembly 501 taking effect and the load path noted above being imposed. Without pre-tensioning it is possible that some degree of movement may occur before the load path engages which may not be ideal.

As shown, particularly in FIGS. 55 to 64, pre-tensioning of the upper rod 750 may be completed using an upper barrel nut 950 and tension nut 630. The upper barrel nut 950 may be inserted through a bore 701 in the upper column 702 that the upper rod 750 engages, for example via a thread (not shown), the upper rod 750 threading into the upper barrel nut 950 about an upper end of the upper rod 750. The upper barrel nut 950 side wall bears onto the walls of the bore 701 in the upper column 702 and thus act to seat the upper barrel nut 950 and upper rod 750 therein. The tension nut 630 may be located towards the top of the coupling assembly 501 and the tension nut 630 engages a lower end of the upper rod 750. Engagement may be via a thread (not shown) that the upper rod 750 passes through. Once the upper rod 750 is threaded into the upper barrel nut 950, the tension nut 630 is wound onto the upper rod 750 until the tension nut 630 abuts a bore 701 shoulder in the upper column 702 and in doing so, any slip between the upper rod 750 and upper column 702 bore 701 is taken up so that the upper barrel nut 950 side bears on the upper column 702 bore 701 side.

A similar process may occur for the lower column 703 and lower rod 760. The lower column 703 may comprise a bore 701 that a lower barrel nut 960 may be fitted into. The lower rod 760 engages the lower barrel nut 960 and a lock nut 514, in this embodiment located on the base of the coupling assembly 501, engages an upper end of the lower rod 760. The lock nut 514 is tightened so as to pull the lower rod 760 up towards the coupling assembly 501 and cause the lower barrel nut 960 side to bear on the bore 701 side in the lower column 703 and thus take up any slack in movement of the lower rod 760 relative to the lower column 703.

This barrel nut 950, 960 approach may be used instead of adhesive between the column 700 and rod 750, 760 described elsewhere in this specification. Alternatively the barrel nut 950, 960 or rod 750, 760 or both may also be adhered to the column 700 as well. The inventors have found that barrel nut 950, 960 use not only provides a way to pre-tension the rods 750, 760 but also is a very strong and effective way to link the rods 750, 760 to the column 700.

As best seen in FIGS. 59-61 and 65, the top of the coupling assembly 501 may be shaped to be an alignment member. As shown in FIGS. 59-61 and 65, the upper column 702 and upper rod 750 therein may be aligned with the coupling assembly 501 via a cone shape section 550. The cone shape section 550 may be integral to the top cap 508 or sleeve 507 to guide the upper column 702 and rod 750 and bore 701 therein into position relative to the coupling assembly 501 located on a lower column 703. This cone 550 may also provide protection for hydraulic fittings 506, 509 described above during column 700 installation (assuming a hydraulic system is used).

Figure 65:
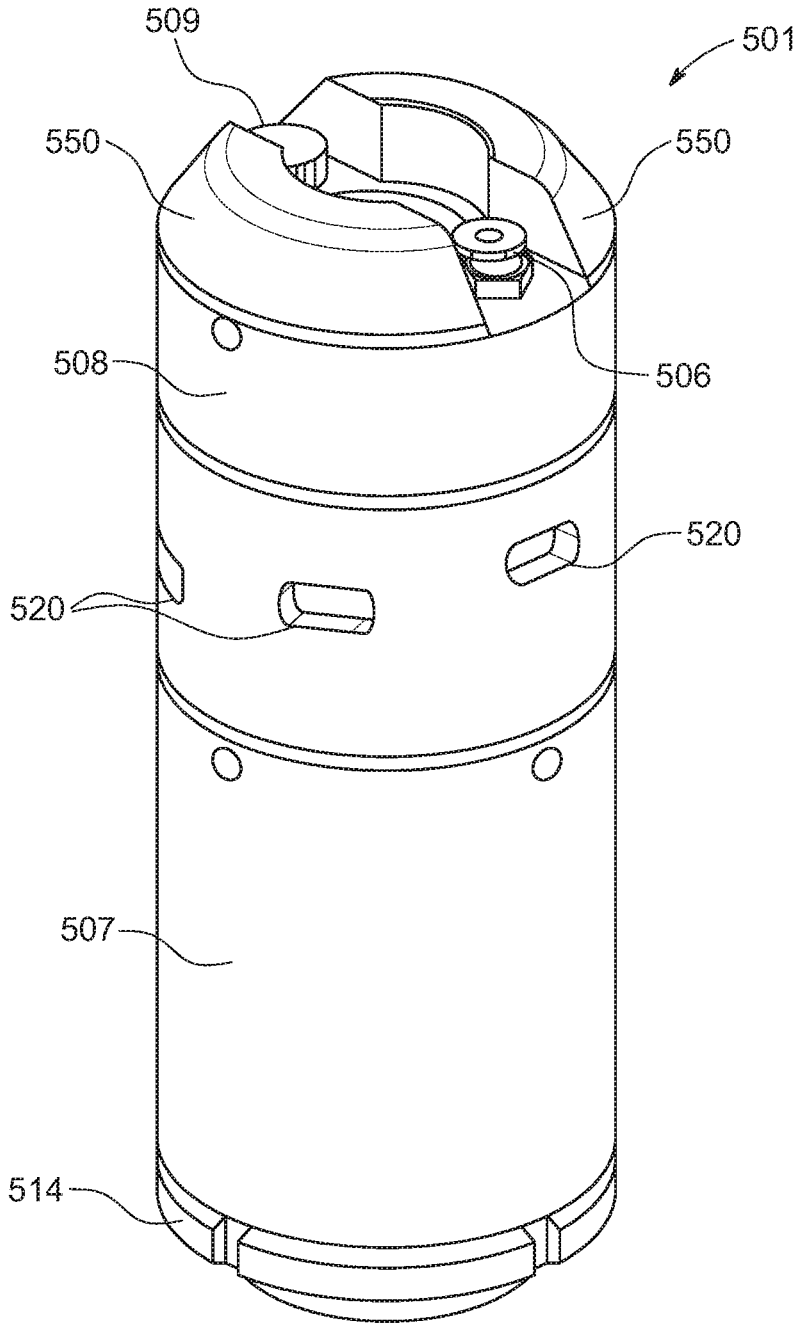
FIG. 65 illustrates a perspective view of the coupling assembly.
Figure 66:
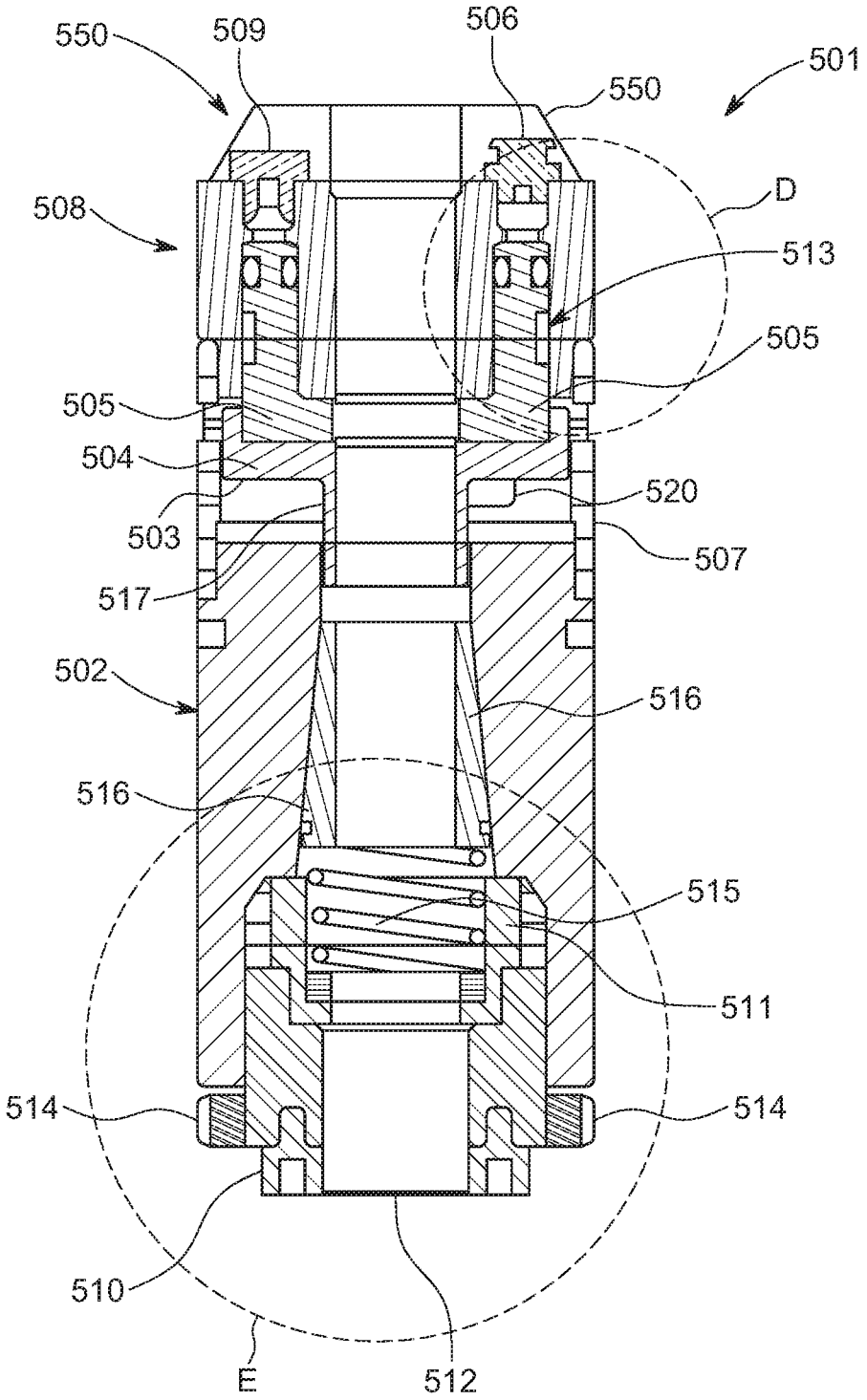
FIG. 66 illustrates a section front elevation of the coupling assembly.
Figure 67:
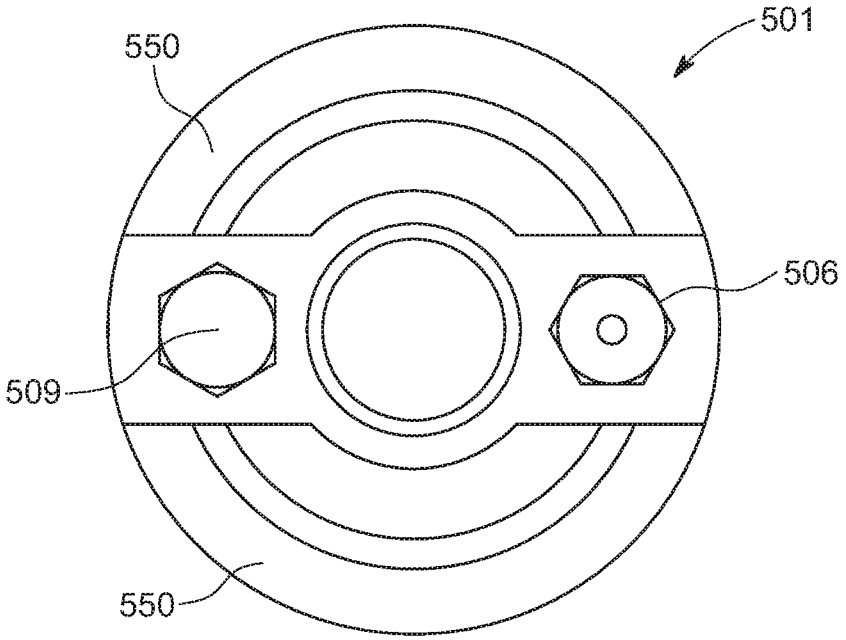
FIG. 67 illustrates a plan view from above of the coupling assembly.
Figure 68:
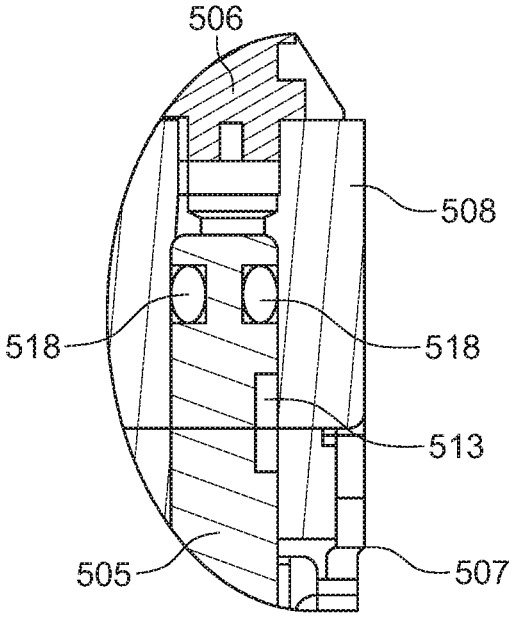
FIG. 68 illustrates a detail section front elevation view of the piston arrangement.
Figure 69:
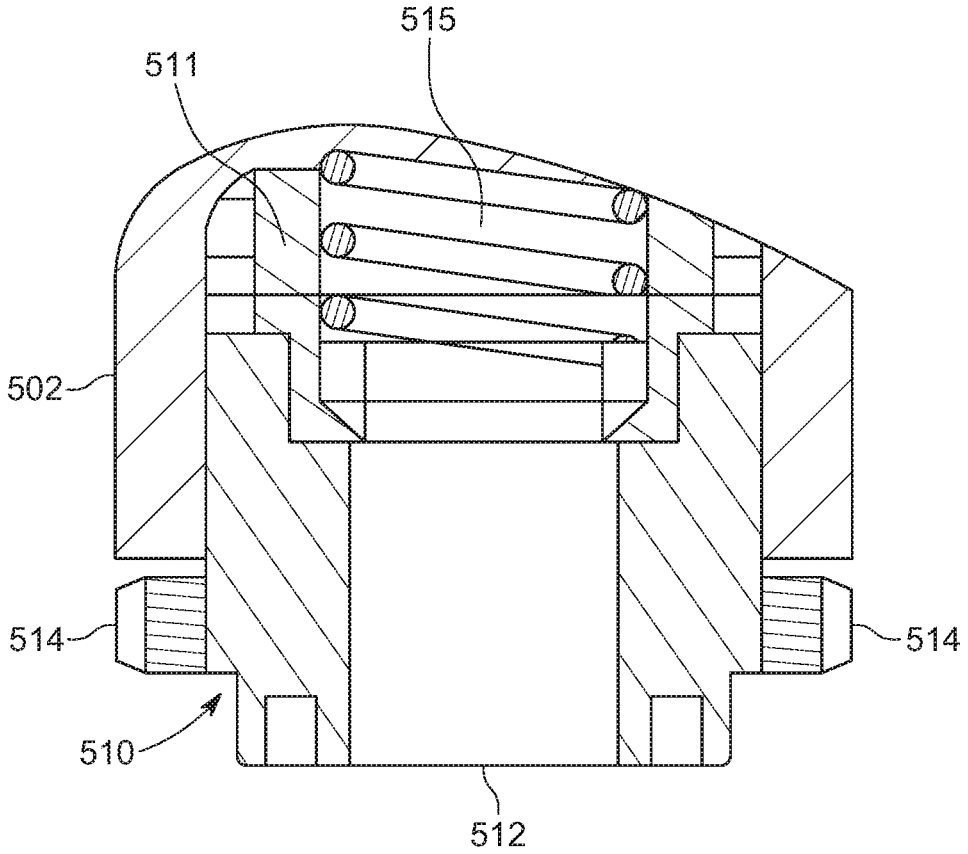
FIG. 69 illustrates a detail cross-section front elevation view of the base of the coupling assembly.

The sleeve 507 for the coupling assembly 501 may, as noted in earlier embodiments, comprise openings 520 that allow a tool to be inserted to act on the release member 504. In this embodiment, the openings 520 are provided only at sleeve 507 positions corresponding to re-arming points where the release member 504 might be urged to move upwards against the piston 505 to cause the spring 515 to urge the jaws 516 to recouple with a rod 750, 760. Asymmetric sleeve 507 opening 520 placement about the sleeve 507 circumference and at variable heights may be used as shown in FIG. 65 which allows the re-arming tool to be inserted at a point best aligned with the release member 504 and at a point easy to access. There may be some variation in rotation of the sleeve 507, surrounding obstructions about the coupling assembly 501, and release member 504 position that means asymmetric opening 520 placement may be useful during re-arming.

Figure 73:
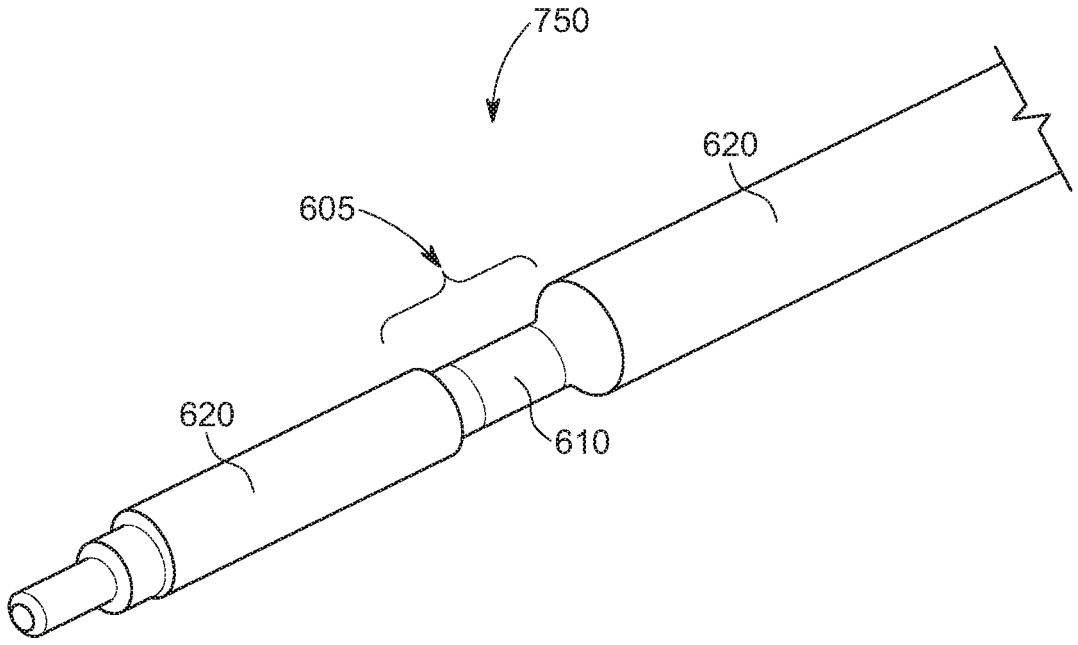
FIG. 73 illustrates a perspective view of an example of an upper rod with a fuse.

Ductile failure may be important as this is a predictable form of failure and avoids unwanted damage possible from brittle failure. As noted elsewhere in this specification, the ductile failure mode may be achieved via a mechanical fuse or by use of geometry to cause a weak point that is designed to fail via ductile means in advance of failure elsewhere. Many steel coupler systems (e.g. reinforcing bar couplers) are known to struggle to achieve this ductile failure requirement because brittle failure can occur at or within the coupler. In this example, and as particularly shown in FIG. 73, a fuse 605 in the form of a reduced diameter necked area 610 of the upper rod 750 may be used to induce ductile failure in advance of failure of the coupling assembly 501 itself. That is, the mechanical fuse 605 is located outside of the coupling assembly 501 which makes replacement of parts post failure much easier. Further, because the upper rod 750 is carefully designed and manufactured, the material properties of the upper rod 750 are well understood and uniform across the rod 750 length. The machined 'necked' area 610 shown in FIG. 73 may be calculated and tested to provide a consistent ductile failure with high elongation. This establishes a capacity hierarchy, where other brittle failure modes (e.g. timber shear) will not govern due to their higher calculated failure load. FIG. 73 shows an exaggerated and large reduction in diameter 610 at the fuse 605 region. In reality, the inventors have found that the reduction in diameter need only be very small to achieve the desired ductile failure—perhaps only a reduction in diameter of less than 10, or 9, or 8, or 7, or 6, or 5, or 4, or 3, or 2, or 1% of the whole diameter 620 of the upper rod 750 e.g. a 20 mm diameter rod 750 may only have a fuse region 605 with a reduced diameter 610 of 19 mm—that is a 1 mm reduction in diameter is sufficient in this case to achieve a predictable and repeatable ductile failure region.

One method of assembly of the above further embodiment may be as per the following steps:

1. Pre-install a locking nut 514 onto the base of a pre-assembled coupling assembly 501;
2. Torque the lower rod 760 onto the coupling assembly 501 against the position-limit shoulder;
3. Pre-install the bottom plate 920 onto the lower column 703;
4. Pre-install the lower barrel nut 960 into the lower column 703;
5. Insert the coupling assembly 501 and lower rod 760 into the lower column 703 bore 701, and screw into the lower barrel nut 960 until the coupling assembly 501 contacts the bottom plate 920;
6. Tighten the locking nut 514 which will also pre-tension the lower rod 760;
7. Pre-install the top plate 910 onto the upper column 702;
8. Pre-install the upper barrel nut 950 into the upper column 702;
9. Insert the upper rod 750 into the upper column 702 bore 701, and screw into the upper barrel nut 950 and then screw on the tension nut 630 so as to pre-tension the upper barrel nut 950;

10. Lift the upper column 702 assembly over the lower column 701 assembly so that the upper rod 750 and bore 701 in the upper column 702 fit over the coupling assembly 1 located proud of the lower column 701 and as the upper rod inserts into the coupling assembly 1, the jaws 516 will bear on the upper rod sides and couple the columns 702, 703 together.

Example 9

Figure 74A:
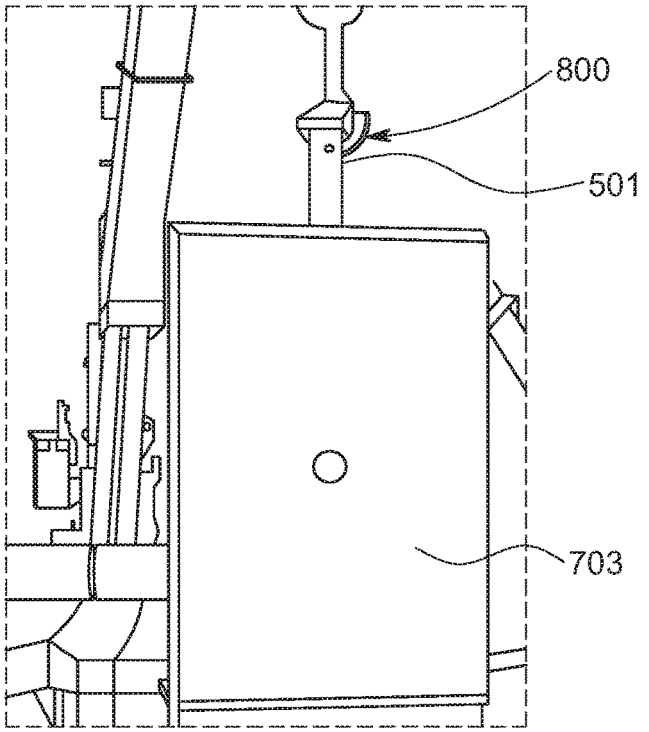
FIG. 74 illustrates a lower column being lifted into position using a hook linked to the coupling assembly (74A top) and a section front elevation view (74B bottom) showing release of the hook.
Figure 74B:
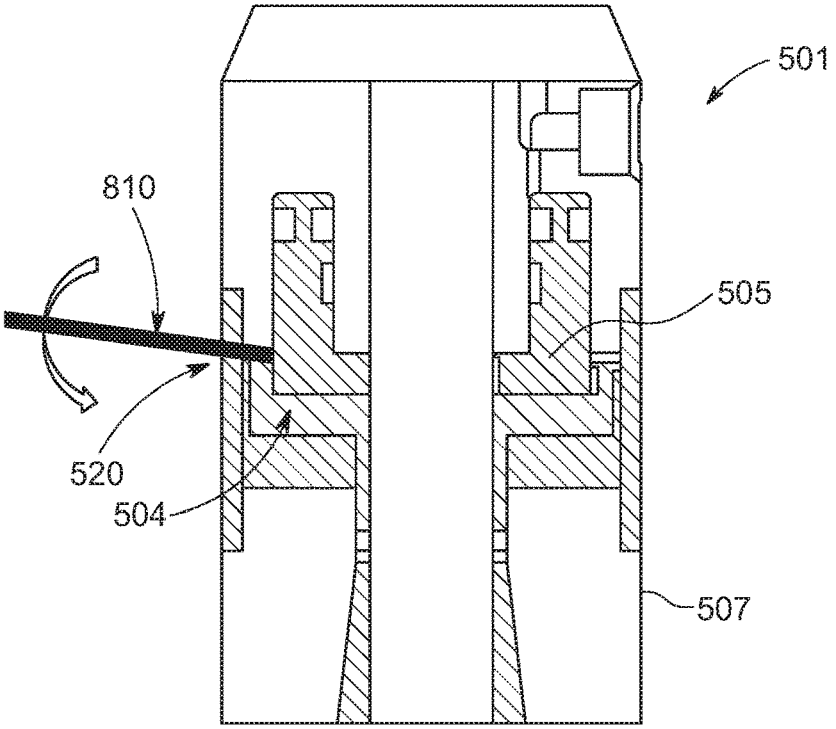
Figure 75:
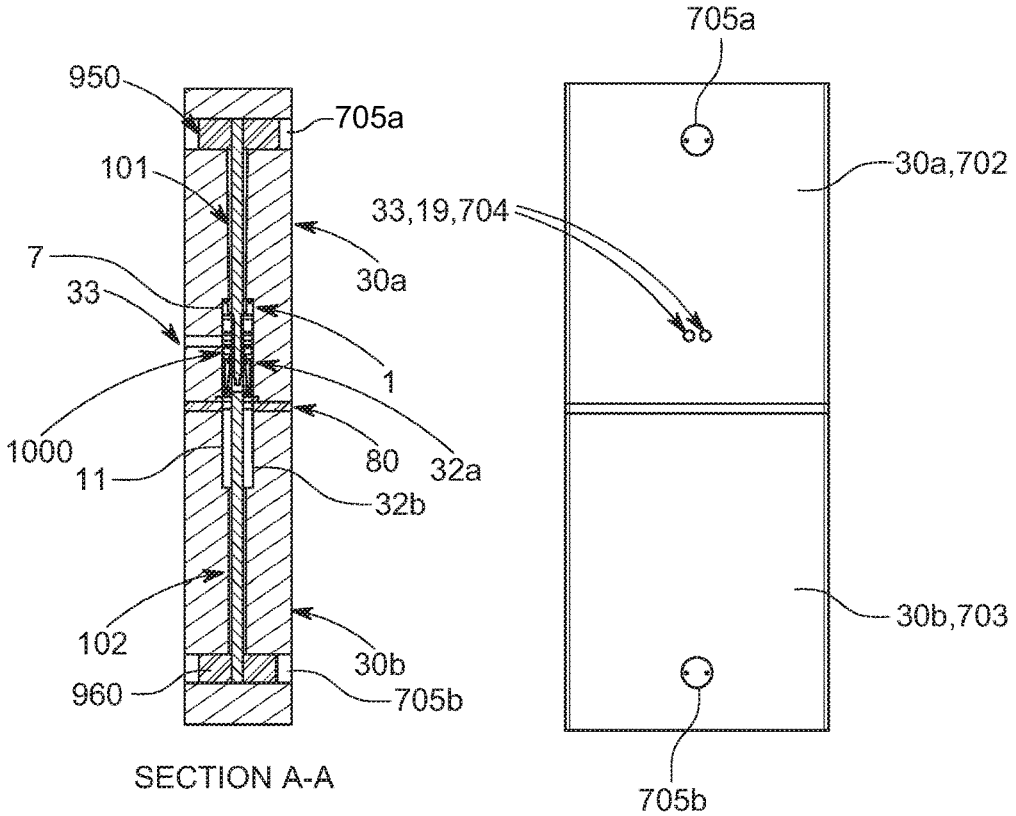
FIG. 75 illustrates a cross section view of a coupling assembly, upper and lower columns, extension sleeve, upper and lower coupled members and barrel nuts linking the coupled member ends to the columns and a first release point.

In this example, a lifting arrangement is shown where the coupling is used to hold a hook 800 that may be used to lift and install a lower column 703. FIG. 74 illustrates a photo (FIG. 74A) of a lower column 703 being lifted into position using the hook 800 installed on the coupling assembly 501, the coupling assembly 501 installed on the lower column 703. An example of a secondary manual release for the hook 800 is also shown (FIG. 74B) 810. The coupling assembly 501 can be used to retain a lifting device 800 such a hook or eye in place of an upper rod 750 and may be used as part of the lifting equipment to hoist a column 703 into position as shown in FIG. 74A. Once lifting is complete, the secondary anchor release mechanism 810 shown in FIG. 74B could then be used to quickly disconnect the hook 800 for re-use. The secondary manual release 810 may be provided for low-force situations such as this, using a tool shown as a bar or lever in FIG. 74B such as a blade, driver or fork levering against an opening 520 in the sleeve 507.

Manual release may be enabled by providing a separation between the hydraulic piston 505 if used, and the release member 504. This may allow the release member 504 collar 503 to be depressed by a tool, without needing to displace the hydraulically-locked piston 505.

Example 10

As noted elsewhere in this specification, the coupling assembly described herein locates the coupling parts within the column bulk and in doing so, increases fire resistance. This is because there is no direct exposure to fire of the metal parts of the coupling that might conduct heat and cause localised charring about the coupling/column interface. In many art couplings, the metal parts are exposed and heat from a fire is rapidly conducted through the metal coupling causing localised charring and possible degradation of the coupling interface and risk of coupling failure. Concealment is also beneficial for aesthetic reasons. Further, concealment of the steel parts of the connections can provide an advantage for mass timber construction by enabling protection of the connection by sacrificial charring of the cover layer of timber which is non-structural and hence the building remains stable.

The International Building Code 2021 (US) specifies a maximum temperature for steel connection components during a fire in a tall timber building. These cannot currently be achieved by conventional technology (e.g. intumescent paint) if the steel is exposed. The ability to conceal the connection within a protective char layer of timber is often deemed essential by the building designer.

Guidance notes for similar mass timber design practice are being issued in other regions (e.g. Europe, New Zealand, Australia), and legislation in these countries is likely to follow suit.

Figure 71:
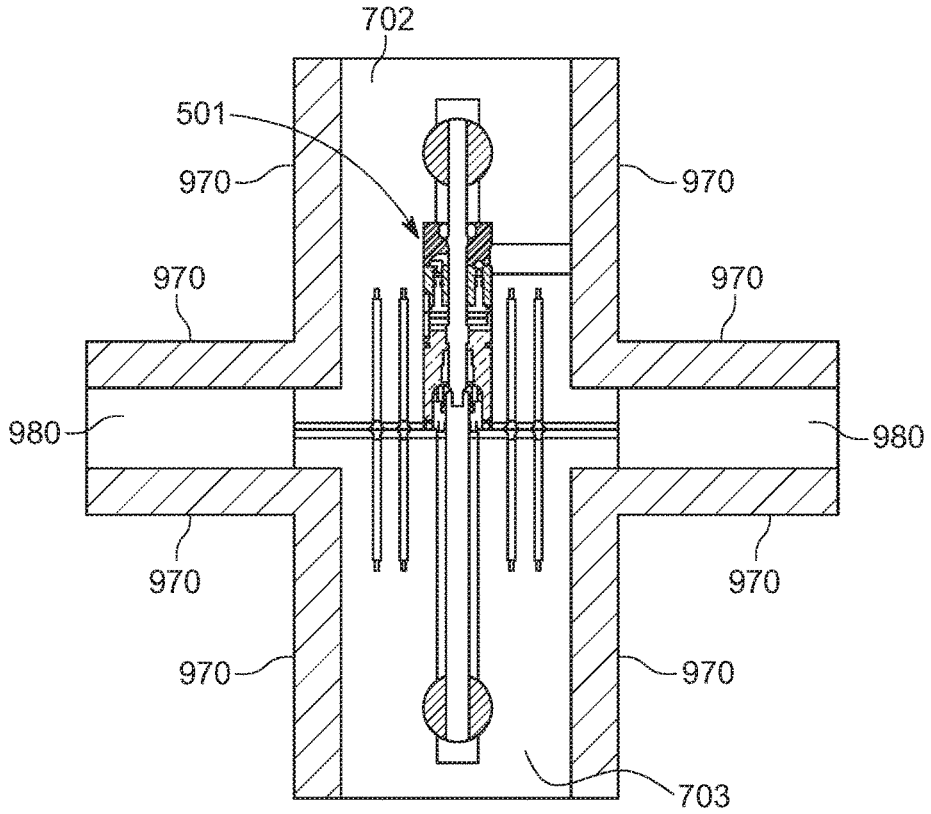
FIG. 71 illustrates a cross-section view of a column in a building and how charring would occur in the event of a fire.
Figure 72:
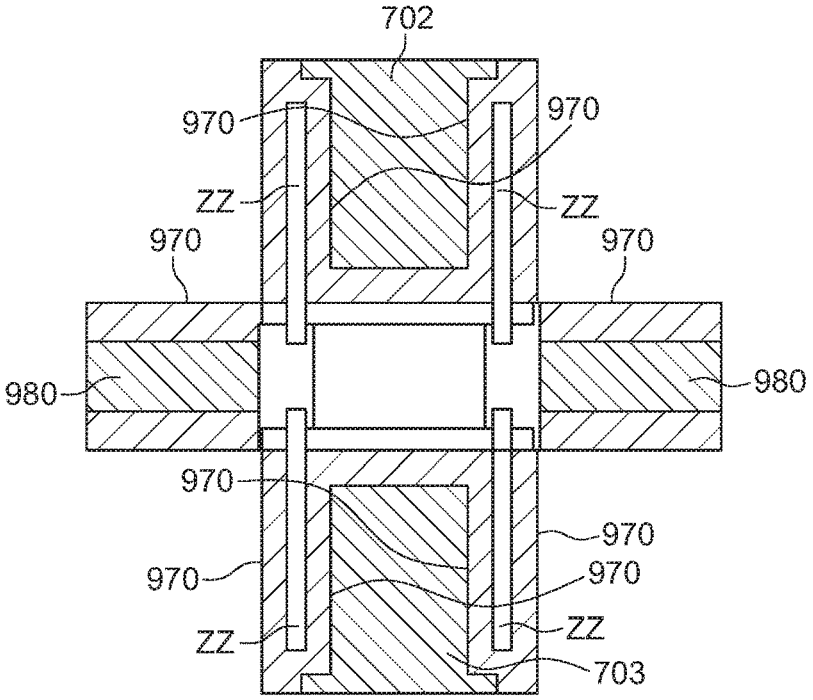
FIG. 72 (PRIOR ART)
FIG. 72 illustrates a cross-section view of a prior art column coupling in a building and how charring would occur in the event of a fire.

The described embodiments herein can achieve desired codes around fire protection due to the nature of the concealment. To illustrate this, FIG. 71 shows an embodiment of the coupling assembly 1, 501 as described herein. The coupling assembly 1, 501 is located inside the column 700 mass timber and between building floor panels 980 as shown. Charring 970 shown in black shading as might occur in a fire can only reach the outer surfaces of the column 700 and floor panels 980 but cannot reach the coupling assembly 1, 501 itself. By contrast, an art coupling assembly ZZ is shown in FIG. 72. In this case steel parts of the connection are located close to the surface, which allow heat to transfer to the steel of the coupling assembly ZZ and charring 970 to occur alongside the coupling ZZ. This results in a reduction and coupling ZZ strength and even the potential of coupling ZZ failure.

Example 11

In this example, FIGS. 75 to 81 are referred to and an alternative embodiment of the coupling assembly is described with reference to the following parts and their item numbers as below:

Upper column 30*a*, 702
Lower column 30*b*, 703
Upper column bore 32*a*
Lower column bore 32*b*
Coupling assembly 1, 501
Central release point 1000
Upper release point 1010
Lower release point 1020
Extension sleeve 11
Base plate 80
Upper coupled member 101
Lower coupled member 102
Single coupled member 1030
Upper retention means/barrel nut 950
Lower retention means/barrel nut 960
Upper retention means opening in upper column 705*a*
Lower retention means opening in lower column 705*b*
Column and coupling assembly release mechanism opening 33, 19, 704
Set screw 1040
Machined groove in rod 1050
Threaded bore in barrel nut 1060
Though pin 1070
Drilled cross-hole in barrel nut 1080
Coupled member/rod head 1090
Coupled member/rod end 1100
Split barrel nut 1110
Barrel nut halves 1120
Barrel nut centre plane 1130
Barrel nut screws 1150
Tapered wedge jaws around coupled member/rod shaft 1160

As may be appreciated from the above description, release of the coupling may be a useful feature to enhance installation and re-installation or maintenance as required. Release of the coupling assembly described above is largely as shown in FIG. 75 where a cross section view is shown illustrating the coupling assembly 1, 501, upper and lower columns 30*a*, 702, 30*b*, 703, a bearing plate 80, extension sleeve 11, upper and lower coupled members 101, 102 and barrel nuts 705*a*, 705*b* linking the coupled member 101, 102 ends to the columns 30*a*, 702, 30*b*, 703 and a first release point 1000. The first release point 1000 or where release occurs in this embodiment is centred around the coupling assembly 1. This embodiment achieves objectives around allowing for disassembly at end-of-life or for re-use. This embodiment also allows for the ability to remove a damaged column 30*a*, 702, 30*b*, 703 for remedial work and to correct site installation errors.

Figure 76:
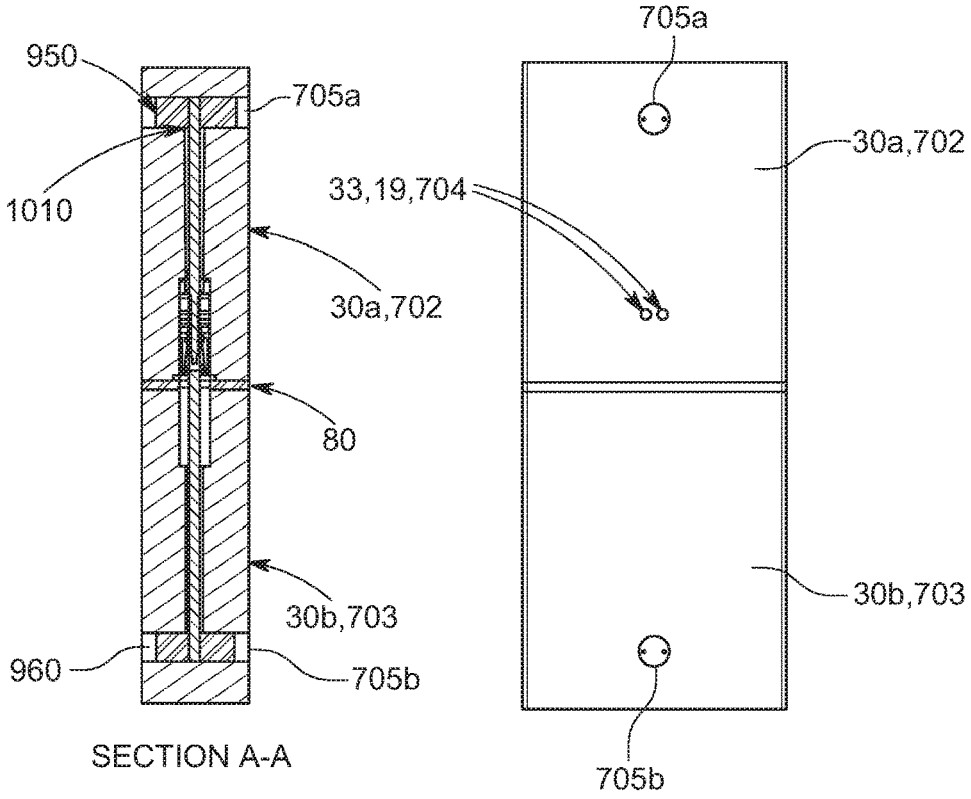
FIG. 76 illustrates the above cross-section view demonstrating an amended release point.

FIG. 76 illustrates an alternative release embodiment. In this case the coupling assembly 1 is not releasable and instead, release is achieved at an upper release point 1010 located at or about the retention means, in this example being at or about the barrel nut 950. This upper release point 1010 would allow for the elimination of the release openings 33, 19, 704 in the column 30*a*, 702 and coupling assembly 1. Rotational alignment requirements for the anchor in the coupling assembly 1 are avoided. Further, an upper release point 1010 may lower the effort needed to mechanically release the coupling avoiding hydraulic or impact release methods.

Figure 77:
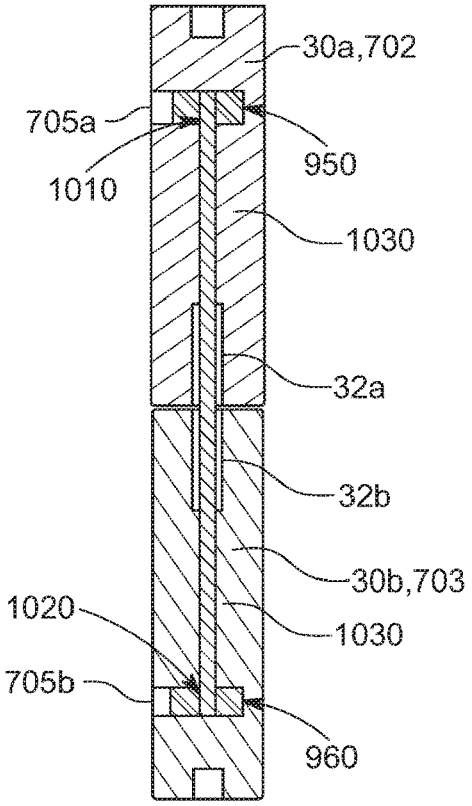
FIG. 77 illustrates an alternative embodiment of coupling comprising a single coupled member, one end of which is releasably coupled to the upper column via a barrel nut and the other end of which is releasably coupled to the lower column via a barrel nut.

FIG. 77 illustrates an alternative embodiment of coupling comprising a single coupled member 1030, one end of which is releasably coupled to the upper column 30*a*, 702 via a barrel nut 950 and the other end of which is releasably coupled to the lower column 30*b*, 703 via a barrel nut 950, 960. In this case, two release points are allowed for being an upper release point 1010 and a lower release point 1020. The anchor and jaw detail is also removed. It is envisaged that this embodiment may have uses but for potentially different applications to where a coupling assembly 1 is used. The coupling assembly 1 described elsewhere in this specification provides the advantage of a quick connection, it allows for varying thickness of bearing plate 80—e.g. to shim up or down the relative heights of the columns. This embodiment does not have an integrated shear path like other embodiments and there may be some initial slip between the columns when a tensile or over turning force is applied.

FIGS. 78, 79, 80 and 81 illustrate embodiments that could be used to allow for a release point 1010, 1020 at or about a barrel nut.

Figure 78:
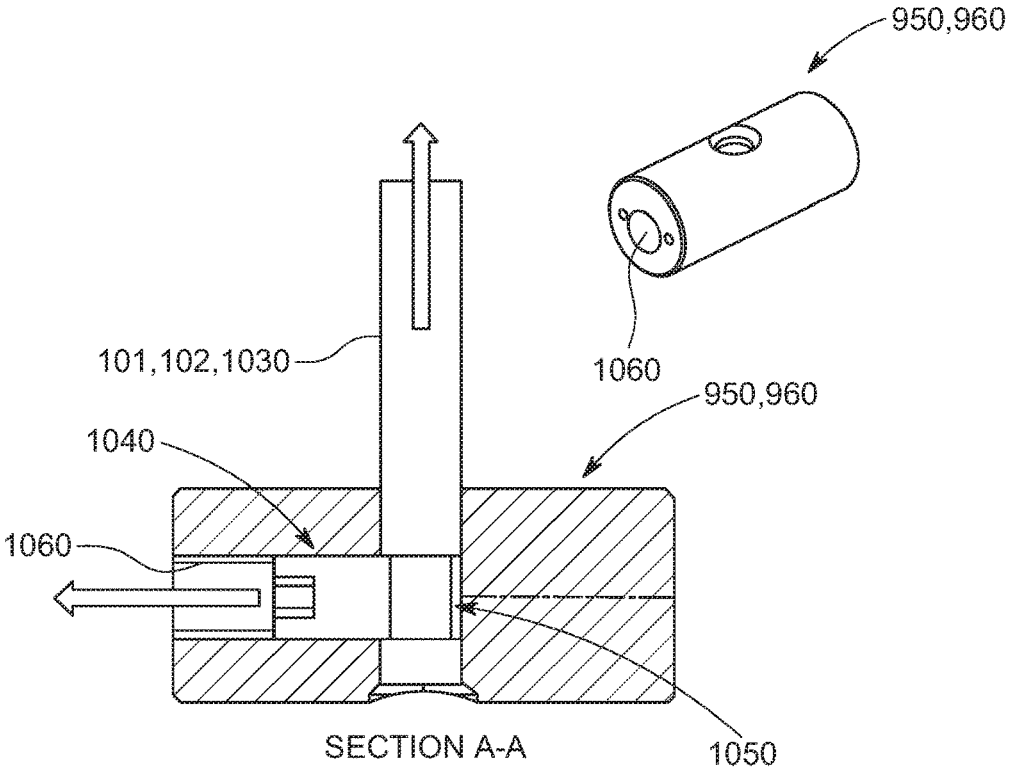
FIG. 78 illustrates a side cross section view of a barrel nut release mechanism comprising a set screw that communicates with a groove in the coupled member to couple or further couple the coupled member and barrel nut.

In FIG. 78, a side cross section view of a barrel nut 950, 960 release mechanism is shown comprising a set screw 1040 that communicates with a groove 1050 in the coupled member 101, 102, 1030 to couple or further couple the coupled member 101, 102, 1030 and barrel nut 950, 960. The set screw 1040 may have a large diameter relative to the barrel nut 950. 960 and the set screw 1040 may retain the coupled member 101, 102, 1030 by engaging with a groove 1050 in the coupled member 101, 102, 1030. Once engaged, the coupled member 101, 102, 1030 cannot be removed from the barrel nut 950, 960. An advantage of this approach is that a thread is not essential or even needed on the coupled member 101, 102, 1030 as the set screw 1040 and groove 1050 interlock and prevent coupled member 101, 102, 1030 release. The barrel nut 950, 960 has a central threaded bore 1060 from at least one side of the barrel nut 950, 960 that the set screw 1040 threads into and out of. A simple tool such as a hex key (not shown) may be used to wind in or out the set screw 1040 in the threaded bore 1060 and couple or release the coupled member 101, 102, 1030 from the barrel nut 950, 960. A second set screw (not shown) could be added that threads into the barrel nut via a bore on the opposing side of the barrel nut 950, 960 to allow for additional capacity if needed.

Figure 79:
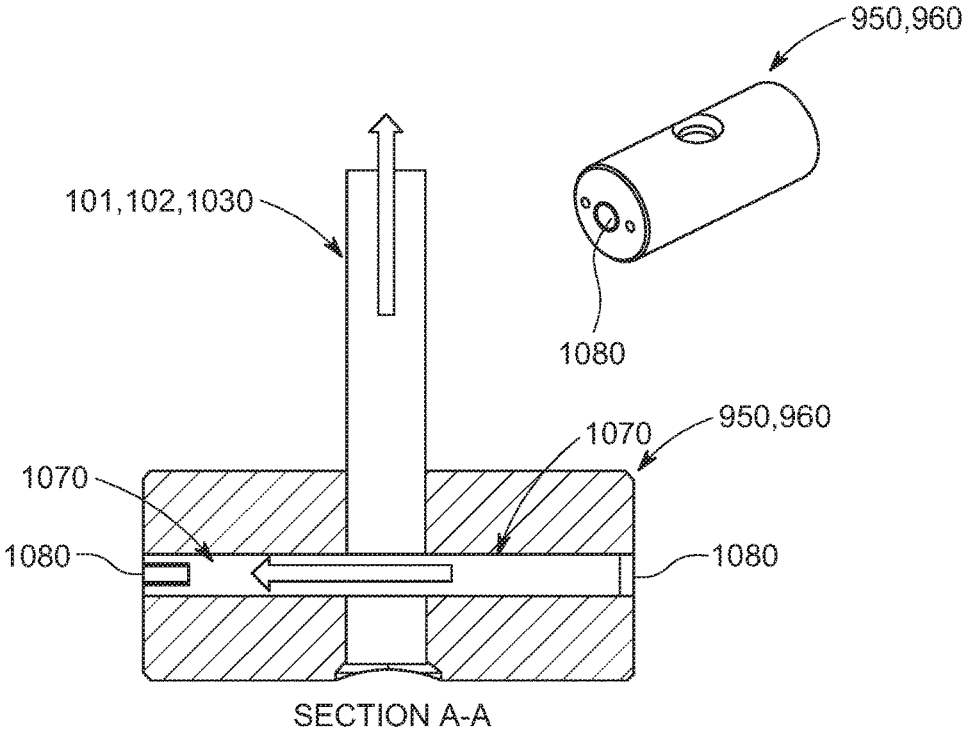
FIG. 79 illustrates a side cross section view of an alternative barrel nut release mechanism comprising a through pin that communicates with an opening in the coupled member to couple or further couple the coupled member and barrel nut.

FIG. 79 illustrates a side cross section view of an alternative barrel nut 950, 960 release mechanism comprising a through pin 1070 that communicates with an opening 1080 in the barrel nut 950, 960 and through the coupled member 101, 102, 1030 to couple or further couple the coupled member 101, 102, 1030 and barrel nut 950, 960. The through pin 1070 may be a high strength steel pin. The coupled member 101, 102, 1030 has a drilled cross hole that receives the through pin therethrough. Like the above embodiment, a thread on the coupled member is not required or essential in this embodiment to achieve secure coupling. In this case, the barrel nut 950, 960 may not have a threaded bore 1080 and instead may have a plain internal bore 1080. The through pin 1070 may have a threaded end that communicates with a complementary thread end of the barrel nut bore 1080. This threaded end may be useful for extraction using a puller (not shown). Further variations of this embodiment may require multiple through pins 1070.

Figure 80:
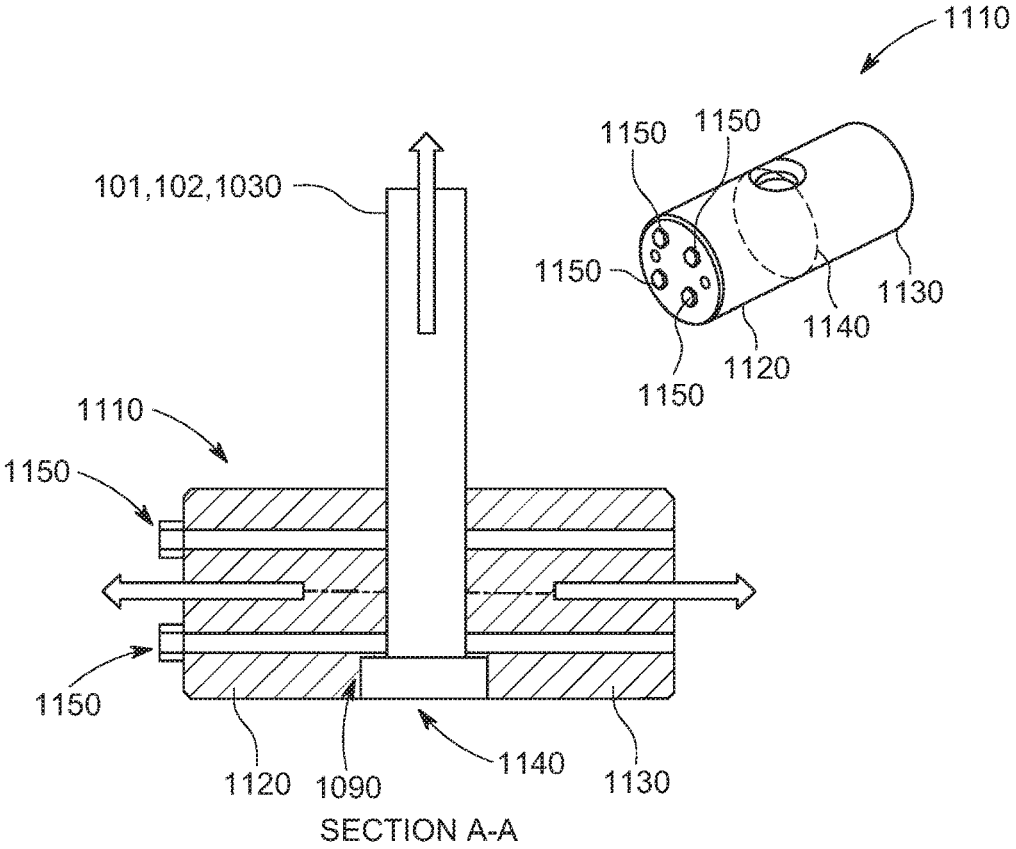
FIG. 80 illustrates a side cross section view of a further alternative barrel nut release mechanism comprising a split barrel nut and screws that clamp the barrel halves together about the coupled member.

FIG. 80 illustrates a side cross section view of a further alternative barrel nut 1110 release mechanism comprising a split barrel nut 1110 made up of two halves 1120, 1130 and screws 1150 that clamp the barrel 1110 halves 1120, 1130, together about the coupled member 101, 102, 1030. In this embodiment, the coupled member 101, 102, 1030 may have a head 1090 which provides a load path into the barrel nut 1110. The barrel nut 1110 is split into two identical halves 1120, 1130 through a centre plane 1140. Four or more screws 1150 may clamp the barrel nut 1110 halves 1120, 1130 together about the coupled member 101, 102, 1030. Screws may be removed to split the barrel nut 1110 and release the coupled member 101, 102, 1030.

Figure 81:
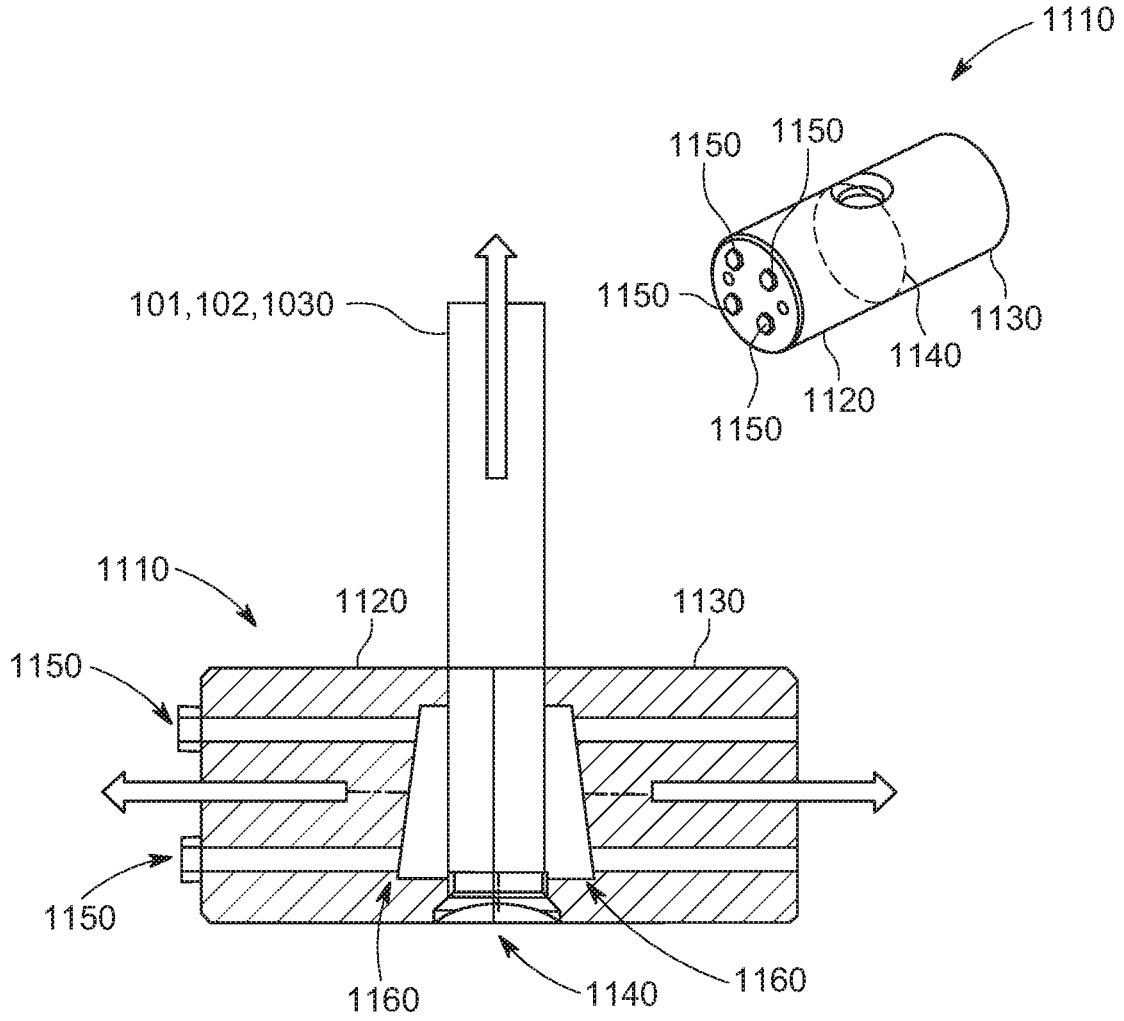
FIG. 81 illustrates a side cross section view of a further alternative barrel nut release mechanism comprising a split barrel nut along with wedges and screws that clamp the barrel halves and wedges together about the coupled member.

FIG. 81 illustrates a side cross section view of a further alternative barrel nut 1110 release mechanism comprising a split barrel nut 1110 along with wedges 1160 and screws 1150 that clamp the barrel 1110 halves 1120, 1130 and wedges 1160 together about the coupled member 101, 102, 1030. The barrel nut 1110 is again formed of two identical halves 1120, 1130 that meet about a centre plane 1140. The tapered wedge jaws 1160 are placed around the coupled member 101, 102, 1030 and provide a load path into the barrel nut 1110. The screws 1150 and wedges 1160 are removed to uncoupled the coupled member 101, 102, 1030.

Aspects of the above described coupling system, coupler tools and methods of use thereof have been described by way of example only and it should be appreciated that modifications and additions may be made thereto without departing from the scope of the claims herein.

What is claimed is:

1. A coupling assembly configured to releasably couple with a coupleable member, the coupling assembly comprising:

an anchor comprising:

at least one jaw having an internal jaw side and an external taper, the internal jaw side configured to interfere with movement of the coupleable member relative to the anchor; and a body with an internal taper complementary to the external taper;

an enclosing member, the enclosing member at least partly surrounding the anchor an opening to allow passage of the coupleable member to the anchor inside the enclosing member;

a release member movable relative to the body between a first position and a second position; and at least one tool-access opening;

wherein, when the release member is in the first position, the at least one jaw is configured to engage the coupleable member and the body to thereby prevent separation of the coupleable member from the anchor, and, when the release member is actuated to move to the second position, the release member forces the at least one jaw to disengage the body; and wherein the at least one tool-access opening allows insertion of a tool into or through the at least one tool-access opening to thereby mechanically urge the release member towards the second position and move the release member from the first position to the second position, and withdrawal of the tool allows the release member to return from the second position to the first position.

2. The coupling assembly as claimed in claim 1, wherein at least one tine is insertable into or through the at least one tool-access opening to interfere with the release member and urge the release member towards the second position.

3. The coupling assembly as claimed in claim 1, wherein the release member, when actuated to move to the first position, is urged away from the at least one jaw so as not to impose a compression force on the at least one jaw, and, when actuated to move to the second position, urges the at least one jaw at least partly from the internal taper of the body so as to allow release of a coupleable member from the anchor.

4. The coupling assembly as claimed in claim 1, wherein the release member is located intermediate the enclosing member and the anchor.

5. The coupling assembly as claimed in claim 1, wherein the release member is located between a cap of the enclosing member and the at least one jaw.

6. The coupling assembly as claimed in claim 1, comprising a bias member configured to pre-engage the anchor by biasing the external taper of the at least one jaw and the internal taper of the body together.

7. A coupling system comprising:

the coupling assembly as claimed in claim 1; and a coupleable member locatable within, and coupleable to, the coupling assembly.

8. The coupling system of claim 7, wherein the coupleable member is a lifting device.

9. The coupling system of claim 8, wherein the lifting device is a hook or an eye.

10. A column assembly comprising:

at least one a column, the at least one column comprising a first column;

at least one coupling assembly as claimed in claim 1; and at least one coupleable member, the at least one coupleable member comprising a first coupleable member having first and second ends, the first end of the first coupleable member coupleable with the first column and the second end of the first coupleable member coupleable with the at least one coupling assembly.

11. The column assembly as claimed in claim 10, wherein the at least one coupling assembly is connected to a base plate secured to a substrate.

12. The column assembly as claimed in claim 10, comprising a bearing plate fastened to an end of the first column.

13. The column assembly as claimed in claim 12, wherein the coupling assembly is attached to the bearing plate.

14. The column assembly as claimed in claim 10, wherein the coupling assembly is at least partly located inside the first column.

15. The column assembly as claimed in claim 14, wherein the coupling assembly is located entirely or at least almost entirely inside the first column.

16. The column assembly as claimed in claim 14, wherein the column comprises at least one access opening for a tool to access the at least one coupling assembly, whereby said tool is insertable, via the access opening of the column, into or through the at least one tool-access opening of the coupling assembly, to urge the release member towards the second position.

17. The column assembly as claimed in claim 10, comprising a barrel nut releasably engageable with the first end of the first coupleable member and engageable with the column or a part thereof to releasably couple the first coupleable member with the first column.

18. The column assembly as claimed in claim 10, wherein:

the at least one column comprises a second column; and the at least one coupleable member comprises a second coupleable member having first and second ends, the first end of the second coupleable member coupleable with the second column and the second end of the second coupleable member coupleable with the at least one coupling assembly to connect an end of the first column to an end of the second column.

19. The column assembly as claimed in claim 18, wherein the first and second columns are indirectly connected end to end with at least one bearing plate located between the ends of the first and second columns.

20. The column assembly as claimed in 19, wherein the at least one bearing plate comprises two bearing plates, wherein one of the two bearing plates is fastened to the end of each column, and the bearing plates abut each other.

21. The coupling assembly as claimed in claim 1, comprising a lock ring locatable between a part of the release member and a part of the anchor to capture the release member in the second position.

* * * * *